US010047299B2

(12) United States Patent
Rubin-Pitel et al.

(10) Patent No.: US 10,047,299 B2
(45) **Date of Patent: *Aug. 14, 2018**

(54) FUEL PRODUCTION FROM FCC PRODUCTS

(71) Applicant: ExxonMobil Research and Engineering Company, Annandale, NJ (US)

(72) Inventors: Sheryl B. Rubin-Pitel, Newtown, PA (US); Kenneth C. H. Kar, Philadelphia, PA (US); Stephen H. Brown, Lebanon, NJ (US); Federico Barrai, Houston, TX (US); Brian A. Cunningham, Gladstone, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 61 days.

This patent is subject to a terminal disclaimer.

(21) Appl. No.: 15/197,999

(22) Filed: Jun. 30, 2016

(65) Prior Publication Data

US 2017/0002273 A1 Jan. 5, 2017

Related U.S. Application Data

(60) Provisional application No. 62/186,678, filed on Jun. 30, 2015.

(51) Int. Cl.
*C10L 1/06* (2006.01)
*C10G 11/18* (2006.01)
(Continued)

(52) U.S. Cl.
CPC ..... *C10G 11/18* (2013.01); *C10G 47/02* (2013.01); *C10G 69/04* (2013.01); *C10L 1/06* (2013.01);
(Continued)

(58) Field of Classification Search
CPC ..... C10L 1/06; C10L 1/08
See application file for complete search history.

(56) References Cited

U.S. PATENT DOCUMENTS 3,702,886 A 11/1972 Argauer et al.
3,709,979 A 1/1973 Chu
(Continued)

FOREIGN PATENT DOCUMENTS

CN 102051221 A 5/2011
CN 103102980 A 5/2013
(Continued)

OTHER PUBLICATIONS

International Search Report and Written Opinion PCT/US2016/040354 dated Sep. 28, 2016.
(Continued)

*Primary Examiner* — Ellen M McAvoy
(74) *Attorney, Agent, or Firm* — Anthony G. Boone

(57) ABSTRACT

Systems and methods are provided for upgrading catalytic slurry oil to form naphtha boiling range and/or distillate boiling range fuel products. It has been unexpectedly discovered that catalytic slurry oil can be separately hydroprocessed under fixed bed conditions to achieve substantial conversion of asphaltenes within the slurry oil (such as substantially complete conversion) while reducing or minimizing the amount of coke formation on the hydroprocessing catalyst. After hydroprocessing, the hydroprocessed effluent can be processed under fluid catalytic cracking conditions to form various products, including distillate boiling range fuels and/or naphtha boiling range fuels. Another portion of the effluent can be suitable for use as a low sulfur fuel oil, such as a fuel oil having a sulfur content of 0.1 wt % or less.

20 Claims, 22 Drawing Sheets

(51) Int. Cl.
*C10G 69/04* (2006.01)
*C10L 1/08* (2006.01)
*C10G 47/02* (2006.01)

(52) U.S. Cl.
CPC ..... *C10L 1/08* (2013.01); *C10G 2300/206* (2013.01); *C10G 2400/00* (2013.01)

(56) References Cited

U.S. PATENT DOCUMENTS

| | | | | |
|---|---|---|---|---|
| 3,770,614 | A | 11/1973 | Graven | |
| 3,832,449 | A | 8/1974 | Rosinski et al. | |
| 3,948,758 | A | 4/1976 | Bonacci et al. | |
| 4,016,245 | A | 4/1977 | Plank et al. | |
| 4,076,842 | A | 2/1978 | Plank et al. | |
| 4,229,424 | A | 10/1980 | Kokotailo | |
| 4,254,297 | A | 3/1981 | Frenken et al. | |
| 4,310,440 | A | 1/1982 | Wilson et al. | |
| 4,480,871 | A | 11/1984 | Fox | |
| 4,500,651 | A | 2/1985 | Lok et al. | |
| 5,871,634 | A | 2/1999 | Wiehe et al. | |
| 7,736,491 | B2 * | 6/2010 | Baptista | C10G 11/18 208/113 |
| 8,007,662 | B2 * | 8/2011 | Lomas | C10G 11/18 208/108 |
| 8,114,678 | B2 | 2/2012 | Chawla et al. | |
| 8,691,076 | B2 | 4/2014 | Kim et al. | |
| 8,951,406 | B2 * | 2/2015 | Koseoglu | C10G 45/20 208/108 |
| 9,101,854 | B2 * | 8/2015 | Koseoglu | B01J 8/26 |
| 9,228,140 | B2 * | 1/2016 | Abba | C10G 45/00 |
| 9,434,892 | B2 * | 9/2016 | Pradeep | C10G 11/18 |
| 9,499,752 | B2 * | 11/2016 | Sundararaman | B01J 23/8906 |
| 9,783,749 | B2 * | 10/2017 | Davydov | C10G 69/04 |
| 2001/0052482 | A1 | 12/2001 | Winter | |
| 2010/0243527 | A1 | 9/2010 | Lomas et al. | |
| 2010/0314287 | A1 | 12/2010 | Niu et al. | |
| 2013/0081977 | A1 | 4/2013 | Woo et al. | |
| 2014/0374314 | A1 * | 12/2014 | Sundararaman | C10G 49/06 208/78 |

FOREIGN PATENT DOCUMENTS

| | | | |
|---|---|---|---|
| CN | 103540356 | A | 1/2014 |
| CN | 103540359 | A | 1/2014 |
| CN | 104593062 | A | 5/2015 |
| EP | 0229295 | A2 | 7/1987 |
| EP | 1050572 | A2 | 11/2000 |

OTHER PUBLICATIONS

International Search Report and Written Opinion PCT/US2016/040359 dated Sep. 28, 2016.

* cited by examiner

| Property | Result | |
|---|---|---|
| Kinematic Viscosity @ 50 °C, $mm^2/s$ | 51.43 | Test method = D445 |
| Density at 15 °C, estimated, g/ml | 0.9771 | Estimated from SG, thermal expansion coefficient = 0.0007/°C |
| Specific gravity at 60 °F | 0.9776 | Calculated from API Gravity |
| API gravity at 60 °F | 13.24 | |
| CCAI | 863 | |
| BMCI | 82 | |
| Sulfur, mg/kg | 117 | Test method = D3922 |
| Hydrogen, mass% | 11.2 | |
| Nitrogen, mg/kg | 54 | |
| Saturates, wt% | 35 | Test method = Star7 |
| 1 aromatic ring, wt% | 23.2 | Test method = Star7 |
| 2 aromatic ring, wt% | 17.9 | Test method = Star7 |
| 3 aromatic ring, wt% | 11.1 | Test method = Star7 |
| 4+ aromatic ring, wt% | 10.5 | Test method = Star7 |
| Carbon residue, estimated, wt% | 1.11 | Estimated from mass fractions and asphaltenes content of 316C- and 316C+ cuts |
| Energy content (net), estimated, MJ/kg | 41.1 | Estimated using equation in ISO 8217, Annex E. Assumed 0.10 vol% water and 0.01%wt ash. |
| N-Heptane Insolubles, estimated, % | 0.03 | Assumed to be no higher than the value of 316C+ cut |
| Asphaltenes, estimated, wt% | 0.76 | Estimated from mass fractions and asphaltenes content of 316C- and 316C+ cuts |
| Pour Point, estimated, °C | -9 | Method = D97 |
| Simulated Distillation IBP, °C | 200 | |
| Simulated Distillation 5% off, °C | 271 | |
| Simulated Distillation 10% off, °C | 296 | |
| Simulated Distillation 30% off, °C | 338 | |
| Simulated Distillation 50% off, °C | 371 | |
| Simulated Distillation 70% off, °C | 412 | |
| Simulated Distillation 90% off, °C | 484 | |
| Simulated Distillation 95% off, °C | 530 | |
| Simulated Distillation EP, °C | 625 | |

FIG. 6

| Property | Result | |
|---|---|---|
| Kinematic Viscosity @ 40 °C, $mm^2/s$ | 5.4 | Method = D445 |
| Density at 15 °C, g/ml | 0.92 | |
| Cetane Index | 29.2 | Method = D4737 |
| Derived Cetane Number | 31.2 | Method = D6890 |
| Cloud Point, °C | -58 | Method = D2500 |
| Specific gravity at 60 °F | 0.92 | Calculated from API gravity |
| API gravity at 60 °F | 22.3 | |
| CFPP, °C | -19 | Method = D6371 |
| Energy content (net), estimated, MJ/kg | 41.9 | Estimated by ISO8217, Annex E. Assumed 0.02 vol% water and 0.0005 %wt ash. |
| Sulfur, mg/kg | 12 | |
| Hydrogen, mass% | 12.1 | |
| Nitrogen, mg/kg | 5 | |
| Paraffins, wt% | 1.5 | |
| 1 naphthene ring, wt% | 2.7 | |
| 2+ naphthene ring, wt% | 60.4 | |
| Total naphthenes, wt% | 63.1 | |
| 1 aromatic ring, wt% | 28.7 | |
| 2 aromatic ring, wt% | 5.5 | |
| 3+ aromatic ring, wt% | 1.2 | |
| Total aromatics, wt% | 35.4 | |
| Distillation IBP, °C | 247 | Method = D86 |
| Distillation 5% off, °C | 260 | Method = D86 |
| Distillation 10% off, °C | 266 | Method = D86 |
| Distillation 30% off, °C | 283 | Method = D86 |
| Distillation 50% off, °C | 294 | Method = D86 |
| Distillation 70% off, °C | 303 | Method = D86 |
| Distillation 90% off, °C | 314 | Method = D86 |
| Distillation 95% off, °C | 319 | Method = D86 |
| Distillation FBP, °C | 322 | Method = D86 |

FIG. 7

| Property | Result | |
|---|---|---|
| Kinematic Viscosity @ 50 °C, $mm^2/s$ | ~177 - 180 | Method = D445 |
| Density at 15 °C, estimated, g/ml | 0.99 | Estimated from SG, thermal expansion coefficient = 0.0007/°C |
| Specific gravity at 60°F | 0.99 | Calculated from API gravity |
| API gravity at 60°F | 11.3 | |
| CCAI | 858 | |
| BMCI | 66.3 | |
| Carbon residue, mass% | 1.4 | Method = D4530 |
| Pour Point, °C | 3 | Method = D97 |
| Energy content (net), estimated, MJ/kg | 41.2 | Est. by ISO8217, Annex E. Assumed 0.10 vol% water and 0.01%wt ash. |
| N-Heptane Insolubles, % | 0.03 | Method = D3279 |
| Asphaltenes, estimated, wt% | 0.92 | Estimated from carbon residue |
| Sulfur, mg/kg | 154 | Method = D2622 |
| Hydrogen, mass% | 10.86 | |
| Nitrogen, mg/kg | 62 | |
| Saturates, wt% | 56.8 | Method = Star 7 |
| 1 aromatic ring, wt% | 22.8 | |
| 2 aromatic ring, wt% | 16.8 | |
| 3 aromatic ring, wt% | 10.8 | |
| 4+ aromatic ring, wt% | 9.2 | |
| Simulated Distillation IBP, °C | 300 | |
| Simulated Distillation 5% off, °C | 320 | |
| Simulated Distillation 10% off, °C | 329 | |
| Simulated Distillation 30% off, °C | 357 | |
| Simulated Distillation 50% off, °C | 388 | |
| Simulated Distillation 70% off, °C | 425 | |
| Simulated Distillation 90% off, °C | 497 | |
| Simulated Distillation 95% off, °C | 545 | |
| Simulated Distillation EP, °C | 627 | |

FIG. 8

| Property | Result | |
|---|---|---|
| Kinematic Viscosity @ 50 °C, $mm^2/s$ | 52.03 | Test method = D445 |
| Density at 15°C, estimated, g/ml | 0.9782 | Estimated from SG, thermal expansion coefficient = 0.00007/°C |
| Specific gravity at 60°F | 0.9787 | Calculated from API Gravity |
| API gravity at 60°F | 13.06 | |
| CCAI | 864 | |
| BMCI | 82.5 | |
| Sulfur, mg/kg | 125 | Test method = D2622 |
| Hydrogen, mass% | 11.04 | |
| Nitrogen, mg/kg | 51.4 | |
| Saturates, wt% | 40.7 | Test method = Star7 |
| 1 aromatic ring, wt% | 22.0 | Test method = Star7 |
| 2 aromatic ring, wt% | 18.4 | Test method = Star7 |
| 3 aromatic ring, wt% | 10.2 | Test method = Star7 |
| 4+ aromatic ring, wt% | 6.5 | Test method = Star7 |
| Carbon residue, estimated, wt% | 1.13 | Estimated from mass fractions and asphaltenes content of 371C- and 371C+ cuts |
| Energy content (net), estimated, MJ/kg | 41.1 | Estimated using equation in ISO 6217, Annex E. Assumed 0.10 vol% water and 0.01%wt ash. |
| N-Heptane Insolubles, estimated, % | 0.14 | Assumed to be no higher than the value of 371C+ cut |
| Asphaltenes, estimated, wt% | 0.75 | Estimated from mass fractions and asphaltenes content of 371C- and 371C+ cuts |
| Pour Point, estimated, °C | -13 | Method = D97 |
| Simulated Distillation IBP, °C | 250 | |
| Simulated Distillation 5% off, °C | 271 | |
| Simulated Distillation 10% off, °C | 286 | |
| Simulated Distillation 30% off, °C | 339 | |
| Simulated Distillation 50% off, °C | 371 | |
| Simulated Distillation 70% off, °C | 412 | |
| Simulated Distillation 90% off, °C | 482 | |
| Simulated Distillation 95% off, °C | 524 | |
| Simulated Distillation EP, °C | 608 | |

FIG. 9

| Property | Result | |
|---|---|---|
| Kinematic Viscosity @ 40 °C, $mm^2/s$ | 13.1 | Method = D445 |
| Density at 15 °C, g/ml | 0.95 | |
| Cetane Index | 57.1 | Method = D4737 |
| Derived Cetane Number | 29.2 | Method = D6890 |
| Cloud Point, °C | -36 | Method = D2500 |
| Specific gravity at 60 °F | 0.95 | Calculated from API gravity |
| API gravity at 60 °F | 18.1 | |
| CFPP, °C | 7 | Method = D6371 |
| Energy content (net), estimated, MJ/kg | 41.6 | Estimated by ISO8217, Annex E. Assumed 0.02 vol% water and 0.0005 %wt ash. |
| Sulfur, mg/kg | 8 | |
| Hydrogen, mass% | 11.75 | |
| Nitrogen, mg/kg | 1 | |
| Paraffins, wt% | 1.2 | |
| 1 naphthene ring, wt% | 1.6 | |
| 2+ naphthene ring, wt% | 53.9 | |
| Total naphthenes, wt% | 55.5 | |
| 1 aromatic ring, wt% | 28.3 | |
| 2 aromatic ring, wt% | 10.7 | |
| 3+ aromatic ring, wt% | 4.3 | |
| Total aromatics, wt% | 43.3 | |
| Distillation IBP, °C | 266 | Method = D86 |
| Distillation 5% off, °C | 281 | Method = D86 |
| Distillation 10% off, °C | 293 | Method = D86 |
| Distillation 30% off, °C | 316 | Method = D86 |
| Distillation 50% off, °C | 326 | Method = D86 |
| Distillation 70% off, °C | 338 | Method = D86 |
| Distillation 90% off, °C | 349 | Method = D86 |
| Distillation 95% off, °C | 354 | Method = D86 |
| Distillation FBP, °C | 358 | Method = D86 |

FIG. 10

| Property | Result | |
|---|---|---|
| Kinematic Viscosity @ 50 °C, $mm^2/s$ | ~920 - 935 | Method = D445 |
| Density at 15 °C, estimated, g/ml | 1.01 | Estimated from SG, thermal expansion coefficient = 0.0007/°C |
| Specific gravity at 60 °F | 1.01 | Calculated from API gravity |
| API gravity at 60 °F | 9.1 | |
| CCAI | 865 | |
| BMCI | 89.7 | |
| Carbon residue, mass% | 2.5 | Method = D4530 |
| Pour Point, °C | -18 | Method = D97 |
| Energy content (net), estimated, MJ/kg | 40.9 | Est. by ISO8217, Annex E. Assumed 0.10 vol% water and 0.01%wt ash. |
| N-Heptane Insolubles, % | 0.14 | Method = D3279 |
| Asphaltenes, estimated, wt% | 1.65 | Estimated from carbon residue |
| Sulfur, mg/kg | 219 | Method = D2622 |
| Hydrogen, mass% | 10.04 | |
| Nitrogen, mg/kg | 105 | |
| Saturates, wt% | 29.2 | Method = Star 7 |
| 1 aromatic ring, wt% | 17.3 | Method = Star 7 |
| 2 aromatic ring, wt% | 19.6 | Method = Star 7 |
| 3 aromatic ring, wt% | 16.2 | Method = Star 7 |
| 4+ aromatic ring, wt% | 14.6 | Method = Star 7 |
| Simulated Distillation IBP, °C | 352 | |
| Simulated Distillation 5% off, °C | 367 | |
| Simulated Distillation 10% off, °C | 374 | |
| Simulated Distillation 30% off, °C | 397 | |
| Simulated Distillation 50% off, °C | 422 | |
| Simulated Distillation 70% off, °C | 456 | |
| Simulated Distillation 90% off, °C | 527 | |
| Simulated Distillation 95% off, °C | 570 | |
| Simulated Distillation EP, °C | 640 | |

FIG. 11

| Feed Description | | GTL Lube | 343C+ HDT MCB | | Hydraulic Oil | |
|---|---|---|---|---|---|---|
| Typical or Fully HDT | | | Typical | Fully HDT | Typical | Fully HDT |
| Properties | Units | | | | | |
| API Gravity (60F) | API | 38.6 | 11.5 | 19.3 | 21.0 | 23.2 |
| Avg Molecular Weight | AMU | 367 | 310 | 317 | 449 | 433 |
| Hydrogen | WT% | 14.68 | 10.99 | 12.97 | 12.97 | 13.55 |
| Sulfur | PPMW | 0 | 155 | 0 | 457 | 0 |
| Nitrogen | PPMW | 0 | 72 | 0 | 160 | 0 |
| Composition | WT% | | | | | |
| Normal Paraffins | | 0.0 | 0.6 | 0.7 | 0.0 | 0.0 |
| Iso-Paraffins | | 100.0 | 5.1 | 5.3 | 3.6 | 3.6 |
| 1-Ring Naphthenes | | 0.0 | 4.3 | 4.9 | 8.0 | 9.0 |
| 2-Ring Naphthenes | | 0.0 | 2.7 | 6.8 | 15.3 | 19.0 |
| 3-Ring Naphthenes | | 0.0 | 5.7 | 21.1 | 15.3 | 26.4 |
| 4-Ring Naphthenes | | 0.0 | 12.6 | 38.0 | 13.7 | 23.5 |
| 5-Ring Naphthenes | | 0.0 | 5.5 | 22.2 | 8.7 | 15.9 |
| 6+-Ring Naphthenes | | 0.0 | 1.0 | 1.1 | 2.6 | 2.6 |
| 1 Ring Aromatics | | 0.0 | 25.9 | 0.0 | 21.4 | 0.0 |
| 2 Ring Aromatics | | 0.0 | 15.7 | 0.0 | 6.7 | 0.0 |
| 3 Ring Aromatics | | 0.0 | 9.1 | 0.0 | 2.8 | 0.0 |
| 4+ Ring Aromatics | | 0.0 | 11.7 | 0.0 | 1.6 | 0.0 |
| Sulfides | | 0.0 | 0.0 | 0.0 | 0.2 | 0.0 |
| Polars | | 0.0 | 0.0 | 0.0 | 0.2 | 0.0 |
| | | | | | | |
| GCD ℃ | | | | | | |
| IBP | | 434 | 311 | 302 | 317 | 311 |
| 5%Off | | 469 | 337 | 326 | 373 | 367 |
| 10%Off | | 479 | 347 | 337 | 393 | 388 |
| 30%Off | | 498 | 370 | 360 | 436 | 429 |
| 50%Off | | 510 | 396 | 375 | 471 | 462 |
| 70%Off | | 524 | 426 | 402 | 505 | 504 |
| 90%Off | | 544 | 475 | 443 | 548 | 538 |
| 95%Off | | 550 | 496 | 470 | 568 | 560 |
| EP | | 560 | 534 | 523 | 595 | 591 |

FIG. 12

Yields from 8 cSt GTL Lube over High Rare Earth USY at 482°C and 3.9 Cat to Oil

| Gas Yields | nPar | iPar | Ole | CyOle | Nap | Total | | | |
|---|---|---|---|---|---|---|---|---|---|
| H2+H2S+NH3 | 0.0 | | | | | 0.0 | | | |
| C1 | 0.0 | | | | | 0.0 | | | |
| C2 | 0.0 | | 0.0 | | | 0.0 | | | |
| C3 | 0.7 | | 3.2 | | | 3.9 | | | |
| C4 | 0.9 | 4.3 | 7.8 | | | 12.9 | | | |
| C5 | 0.4 | 3.6 | 3.8 | 0.0 | 0.0 | 7.8 | | | |
| Total C3-C5 | 2.0 | 7.9 | 14.7 | 0.0 | 0.0 | 24.6 | | | |
| C6-430F | nPar | iPar | Ole | CyOle | Nap | Arom | Total | | |
| C6 | 0.3 | 5.2 | 2.9 | 0.0 | 0.1 | 0.1 | 8.7 | | |
| C7 | 0.3 | 4.6 | 1.8 | 0.1 | 0.2 | 1.0 | 8.1 | | |
| C8 | 0.2 | 3.8 | 1.2 | 0.1 | 0.1 | 1.6 | 7.0 | | |
| C9 | 0.2 | 3.2 | 1.1 | 0.0 | 0.1 | 1.2 | 5.8 | | |
| C10 | 0.1 | 2.5 | 0.9 | 0.0 | 0.1 | 1.1 | 4.8 | | |
| C11 | 0.1 | 2.3 | 0.7 | 0.0 | 0.1 | 0.7 | 4.0 | | |
| C12+ | 0.1 | 2.8 | 0.6 | 0.0 | 0.1 | 0.4 | 4.0 | | |
| Total | 1.3 | 24.5 | 9.2 | 0.3 | 0.9 | 6.1 | 42.3 | | |
| 430-650F | Paraffins | Olefins | Nap | Nap | Nap | Arom | Arom | Arom | Total |
| C11- | 0.0 | 0.0 | 0.0 | 0.0 | 0.0 | 0.0 | 0.0 | 0.0 | 0.0 |
| C12 | 0.2 | 0.0 | 0.0 | 0.0 | 0.0 | 0.3 | 0.0 | 0.0 | 0.5 |
| C13 | 1.0 | 0.2 | 0.1 | 0.0 | 0.0 | 0.4 | 0.1 | 0.1 | 1.8 |
| C14 | 1.7 | 0.3 | 0.1 | 0.0 | 0.0 | 0.2 | 0.0 | 0.3 | 2.5 |
| C15 | 1.5 | 0.3 | 0.1 | 0.0 | 0.0 | 0.1 | 0.0 | 0.2 | 2.1 |
| C16 | 1.3 | 0.2 | 0.0 | 0.0 | 0.0 | 0.1 | 0.0 | 0.1 | 1.7 |
| C17 | 1.1 | 0.1 | 0.0 | 0.0 | 0.0 | 0.1 | 0.0 | 0.0 | 1.4 |
| C18+ | 2.8 | 0.3 | 0.1 | 0.0 | 0.0 | 0.1 | 0.0 | 0.0 | 3.2 |
| Total | 9.6 | 1.5 | 0.4 | 0.0 | 0.0 | 1.1 | 0.1 | 0.7 | 13.3 |

| | Paraffin | Nap | Nap | Nap | Arom | Arom | Arom | Arom | Total |
|---|---|---|---|---|---|---|---|---|---|
| 650F+ CSO | 17.5 | 0.3 | 0.0 | 0.0 | 0.1 | 0.0 | 0.2 | 0.1 | 18.3 |
| Coke | | | | | | | | | 1.4 |

FIG. 13

Yields from 8 cSt GTL Lube over Low Rare Earth USY at 482°C and 3.9 Cat to Oil

| Gas Yields | nPar | iPar | Ole | CyOle | Nap | Total | | | |
|---|---|---|---|---|---|---|---|---|---|
| H2+H2S+NH3 | 0.0 | | | | | 0.0 | | | |
| C1 | 0.0 | | | | | 0.0 | | | |
| C2 | 0.0 | | 0.0 | | | 0.0 | | | |
| C3 | 0.7 | | 6.2 | | | 7.0 | | | |
| C4 | 0.6 | 3.8 | 10.8 | | | 15.2 | | | |
| C5 | 0.8 | 4.1 | 9.4 | 0.0 | 0.0 | 14.3 | | | |
| Total C3-C5 | 2.1 | 8.0 | 26.4 | 0.0 | 0.0 | 36.5 | | | |
| C6-430F CN | nPar | iPar | Ole | CyOle | Nap | Arom | Total | | |
| C6 | 0.4 | 3.2 | 10.7 | 0.1 | 0.3 | 0.1 | 14.8 | | |
| C7 | 0.3 | 2.9 | 6.7 | 0.2 | 1.1 | 0.6 | 11.9 | | |
| C8 | 0.2 | 2.3 | 3.1 | 0.3 | 1.7 | 1.7 | 9.3 | | |
| C9 | 0.2 | 1.6 | 2.0 | 0.1 | 0.9 | 1.3 | 6.1 | | |
| C10 | 0.1 | 1.2 | 1.0 | 0.1 | 0.7 | 0.8 | 4.0 | | |
| C11 | 0.1 | 1.3 | 0.4 | 0.0 | 0.6 | 0.5 | 3.0 | | |
| C12+ | 0.1 | 1.7 | 0.2 | 0.0 | 0.6 | 0.3 | 2.9 | | |
| Total | 1.5 | 14.4 | 24.2 | 0.8 | 5.8 | 5.2 | 51.9 | | |
| 430-650F LCO | Paraffins | Olefins | 1 Ring Nap | 2 Ring Nap | 3+ Ring Nap | 1 Ring Arom | 2 Ring Arom | 3+ Ring Arom | Total |
| C11- | 0.0 | 0.0 | 0.0 | 0.0 | 0.0 | 0.0 | 0.0 | 0.0 | 0.0 |
| C12 | 0.1 | 0.0 | 0.2 | 0.0 | 0.0 | 0.2 | 0.0 | 0.0 | 0.5 |
| C13 | 0.6 | 0.1 | 0.3 | 0.0 | 0.0 | 0.3 | 0.0 | 0.0 | 1.3 |
| C14 | 1.1 | 0.1 | 0.2 | 0.0 | 0.0 | 0.2 | 0.0 | 0.0 | 1.6 |
| C15 | 1.0 | 0.1 | 0.2 | 0.0 | 0.0 | 0.1 | 0.0 | 0.0 | 1.5 |
| C16 | 0.9 | 0.0 | 0.1 | 0.0 | 0.0 | 0.1 | 0.0 | 0.0 | 1.0 |
| C17 | 0.7 | 0.0 | 0.1 | 0.0 | 0.0 | 0.0 | 0.0 | 0.0 | 0.8 |
| C18+ | 1.6 | 0.1 | 0.1 | 0.0 | 0.0 | 0.0 | 0.0 | 0.0 | 1.8 |
| Total | 6.1 | 0.4 | 1.1 | 0.0 | 0.0 | 0.8 | 0.0 | 0.0 | 8.4 |

| | Paraffin | 1 Nap | 2 Nap | 3+ Nap | 1 Arom | 2 Arom | 3 Arom | 4+ Arom | Total | | |
|---|---|---|---|---|---|---|---|---|---|---|---|
| 650F+ CSO | 3.1 | 0.1 | 0.0 | 0.0 | 0.0 | 0.0 | 0.0 | 0.0 | 3.3 | Coke | 0.0 |

FIG. 14

Yields from 8 cSt GTL Lube over Ultra Low Hydrogen Transfer USY at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| C1 | 0.0 | | | | | 0.0 | | | |
| C2 | 0.0 | | 0.0 | | | 0.0 | | | |
| C3 | 0.7 | | 6.4 | | | 7.1 | | | |
| C4 | 0.5 | 1.1 | 13.8 | | | 15.4 | | | |
| C5 | 0.6 | 1.0 | 12.8 | 0.0 | 0.0 | 14.4 | | | |
| Total C3-C5 | 1.8 | 2.1 | 33.0 | 0.0 | 0.0 | 36.9 | | | |
| C6-430F | nPar | iPar | Ole | CyOle | Nap | Arom | Total | | |
| C6 | 0.3 | 1.5 | 12.6 | 0.0 | 0.4 | 0.0 | 14.9 | | |
| C7 | 0.3 | 1.4 | 8.1 | 0.0 | 1.8 | 0.0 | 11.6 | | |
| C8 | 0.2 | 1.4 | 3.7 | 0.0 | 3.6 | 0.0 | 8.9 | | |
| C9 | 0.2 | 1.1 | 2.2 | 0.0 | 2.3 | 0.0 | 5.8 | | |
| C10 | 0.1 | 1.0 | 1.1 | 0.0 | 1.6 | 0.0 | 3.8 | | |
| C11 | 0.1 | 1.0 | 0.5 | 0.0 | 1.3 | 0.0 | 2.9 | | |
| C12+ | 0.1 | 1.3 | 0.3 | 0.0 | 1.3 | 0.0 | 3.0 | | |
| Total | 1.4 | 8.6 | 28.5 | 0.1 | 12.2 | 0.0 | 50.8 | | |
| 430-650F | Paraffins | Olefins | Nap | Nap | Nap | Arom | Arom | Arom | Total |
| C11- | 0.0 | 0.0 | 0.0 | 0.0 | 0.0 | 0.0 | 0.0 | 0.0 | 0.0 |
| C12 | 0.1 | 0.0 | 0.4 | 0.0 | 0.0 | 0.0 | 0.0 | 0.0 | 0.5 |
| C13 | 0.5 | 0.1 | 0.9 | 0.0 | 0.0 | 0.0 | 0.0 | 0.0 | 1.5 |
| C14 | 0.9 | 0.1 | 0.7 | 0.0 | 0.0 | 0.0 | 0.0 | 0.0 | 1.6 |
| C15 | 0.8 | 0.1 | 0.5 | 0.0 | 0.0 | 0.0 | 0.0 | 0.0 | 1.4 |
| C16 | 0.7 | 0.0 | 0.3 | 0.0 | 0.0 | 0.0 | 0.0 | 0.0 | 1.1 |
| C17 | 0.6 | 0.0 | 0.2 | 0.0 | 0.0 | 0.0 | 0.0 | 0.0 | 0.9 |
| C18+ | 1.4 | 0.1 | 0.4 | 0.0 | 0.0 | 0.0 | 0.0 | 0.0 | 1.9 |
| Total | 5.1 | 0.3 | 3.4 | 0.0 | 0.0 | 0.0 | 0.0 | 0.0 | 8.9 |

| | Paraffin | Nap | Nap | Nap | Arom | Arom | Arom | Arom | Total |
|---|---|---|---|---|---|---|---|---|---|
| 650F+CSO | 3.0 | 0.3 | 0.0 | 0.0 | 0.0 | 0.0 | 0.0 | 0.0 | 3.3 |
| Coke | | | | | | | | | 0.0 |

FIG. 15

Yields from 8 cSt GTL Lube over High Rare Earth USY + 10 wt% ZSM-5 at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| C1 | 0.0 | | | | | 0.0 | | | |
| C2 | 0.0 | | 0.3 | | | 0.3 | | | |
| C3 | 0.8 | | 6.0 | | | 6.8 | | | |
| C4 | 0.9 | 4.8 | 11.7 | | | 17.5 | | | |
| C5 | 0.4 | 3.8 | 4.8 | 0.0 | 0.0 | 9.0 | | | |
| Total C3-C5 | 2.0 | 8.6 | 22.5 | 0.0 | 0.0 | 33.2 | | | |
| C6-430F | nPar | iPar | Ole | CyOle | Nap | Arom | Total | | |
| C6 | 0.3 | 4.7 | 2.7 | 0.0 | 0.1 | 0.1 | 8.0 | | |
| C7 | 0.3 | 3.7 | 1.3 | 0.1 | 0.1 | 0.9 | 6.3 | | |
| C8 | 0.2 | 3.0 | 0.8 | 0.1 | 0.1 | 1.4 | 5.5 | | |
| C9 | 0.2 | 2.6 | 0.8 | 0.0 | 0.0 | 1.1 | 4.7 | | |
| C10 | 0.1 | 2.1 | 0.8 | 0.0 | 0.1 | 1.0 | 4.1 | | |
| C11 | 0.1 | 2.1 | 0.6 | 0.0 | 0.1 | 0.7 | 3.6 | | |
| C12+ | 0.1 | 2.6 | 0.6 | 0.0 | 0.1 | 0.4 | 3.7 | | |
| Total | 1.2 | 20.7 | 7.6 | 0.3 | 0.6 | 5.7 | 36.1 | | |
| 430-650F | Paraffins | Olefins | Nap | Nap | Nap | Arom | Arom | Arom | Total |
| C11- | 0.0 | 0.0 | 0.0 | 0.0 | 0.0 | 0.0 | 0.0 | 0.0 | 0.0 |
| C12 | 0.2 | 0.0 | 0.0 | 0.0 | 0.0 | 0.3 | 0.0 | 0.0 | 0.5 |
| C13 | 0.9 | 0.2 | 0.1 | 0.0 | 0.0 | 0.4 | 0.0 | 0.1 | 1.7 |
| C14 | 1.5 | 0.3 | 0.0 | 0.0 | 0.0 | 0.2 | 0.0 | 0.3 | 2.3 |
| C15 | 1.4 | 0.2 | 0.0 | 0.0 | 0.0 | 0.1 | 0.0 | 0.1 | 2.0 |
| C16 | 1.2 | 0.2 | 0.0 | 0.0 | 0.0 | 0.1 | 0.0 | 0.1 | 1.6 |
| C17 | 1.1 | 0.1 | 0.0 | 0.0 | 0.0 | 0.1 | 0.0 | 0.0 | 1.3 |
| C18+ | 2.7 | 0.3 | 0.0 | 0.0 | 0.0 | 0.1 | 0.0 | 0.0 | 3.1 |
| Total | 9.0 | 1.4 | 0.3 | 0.0 | 0.0 | 1.2 | 0.1 | 0.6 | 12.6 |

| | Paraffin | Nap | Nap | Nap | Arom | Arom | Arom | Arom | Total |
|---|---|---|---|---|---|---|---|---|---|
| 650F+ CSO | 15.9 | 0.3 | 0.0 | 0.0 | 0.1 | 0.0 | 0.2 | 0.1 | 16.6 |
| Coke | | | | | | | | | 1.2 |

FIG. 16

Yields from 8 cSt GTL Lube over Low Rare Earth USY + 10 wt% ZSM-5 at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| C1 | 0.0 | | | | | 0.0 | | | |
| C2 | 0.0 | | 1.5 | | | 1.5 | | | |
| C3 | 1.2 | | 16.0 | | | 17.1 | | | |
| C4 | 0.7 | 5.2 | 18.5 | | | 24.4 | | | |
| C5 | 0.8 | 4.2 | 9.0 | 0.0 | 0.0 | 14.1 | | | |
| Total C3- | 2.7 | 9.4 | 43.5 | 0.0 | 0.0 | 55.6 | | | |
| C6-430F | nPar | iPar | Ole | CyOle | Nap | Arom | Total | | |
| C6 | 0.4 | 2.0 | 7.2 | 0.1 | 0.2 | 0.1 | 10.9 | | |
| C7 | 0.4 | 2.4 | 2.5 | 0.2 | 0.5 | 0.6 | 6.9 | | |
| C8 | 0.2 | 1.9 | 1.2 | 0.2 | 0.7 | 1.8 | 6.1 | | |
| C9 | 0.2 | 1.5 | 0.8 | 0.1 | 0.4 | 1.4 | 4.2 | | |
| C10 | 0.1 | 1.1 | 0.4 | 0.1 | 0.4 | 0.5 | 3.0 | | |
| C11 | 0.1 | 1.1 | 0.2 | 0.0 | 0.3 | 0.5 | 2.3 | | |
| C12+ | 0.1 | 1.4 | 0.1 | 0.0 | 0.3 | 0.2 | 2.1 | | |
| Total | 1.6 | 12.1 | 12.8 | 0.8 | 2.7 | 5.6 | 35.6 | | |
| 430-650F | Paraffins | Olefins | Nap | Nap | Nap | Arom | Arom | Arom | Total |
| C11- | 0.0 | 0.0 | 0.0 | 0.0 | 0.0 | 0.0 | 0.0 | 0.0 | 0.0 |
| C12 | 0.1 | 0.0 | 0.1 | 0.0 | 0.0 | 0.2 | 0.0 | 0.0 | 0.4 |
| C13 | 0.5 | 0.0 | 0.1 | 0.0 | 0.0 | 0.2 | 0.0 | 0.0 | 0.9 |
| C14 | 0.8 | 0.0 | 0.1 | 0.0 | 0.0 | 0.1 | 0.0 | 0.0 | 1.0 |
| C15 | 0.7 | 0.0 | 0.1 | 0.0 | 0.0 | 0.0 | 0.0 | 0.0 | 0.8 |
| C16 | 0.5 | 0.0 | 0.0 | 0.0 | 0.0 | 0.0 | 0.0 | 0.0 | 0.6 |
| C17 | 0.4 | 0.0 | 0.0 | 0.0 | 0.0 | 0.0 | 0.0 | 0.0 | 0.4 |
| C18+ | 0.8 | 0.0 | 0.0 | 0.0 | 0.0 | 0.0 | 0.0 | 0.0 | 0.8 |
| Total | 3.8 | 0.2 | 0.4 | 0.0 | 0.0 | 0.5 | 0.0 | 0.0 | 4.9 |

| | Paraffin | 1 Ring Nap | 2 Ring Nap | 3+ Ring Nap | 1 Ring Arom | 2 Ring Arom | 3 Ring Arom | 4+ Ring Arom | Total |
|---|---|---|---|---|---|---|---|---|---|
| 650F+ CSO | 2.4 | 0.0 | 0.0 | 0.0 | 0.0 | 0.0 | 0.0 | 0.0 | 2.4 |
| Coke | | | | | | | | | 0.0 |

FIG. 17

Yields from 8 cSt GTL Lube over Ultra Low Hydrogen Transfer USY + 10 wt% ZSM-5 at 482°C and 3.9 Cat to Oil

| Gas Yields | nPar | iPar | Ole | CyOle | Nap | Total | | | |
|---|---|---|---|---|---|---|---|---|---|
| H2+H2S+NH3 | 0.0 | | | | | 0.0 | | | |
| C1 | 0.0 | | | | | 0.0 | | | |
| C2 | 0.0 | | 1.8 | | | 1.8 | | | |
| C3 | 0.8 | | 17.0 | | | 17.7 | | | |
| C4 | 0.3 | 1.2 | 22.8 | | | 24.5 | | | |
| C5 | 0.7 | 1.1 | 11.7 | 0.0 | 0.0 | 13.5 | | | |
| Total C3-C5 | 2.0 | 2.3 | 51.4 | 0.0 | 0.0 | 55.7 | | | |
| C6-430F CN | nPar | iPar | Ole | CyOle | Nap | Arom | Total | | |
| C6 | 0.4 | 1.6 | 8.4 | 0.0 | 0.3 | 0.0 | 10.7 | | |
| C7 | 0.4 | 1.5 | 3.4 | 0.0 | 1.1 | 0.0 | 6.4 | | |
| C8 | 0.2 | 1.4 | 1.3 | 0.0 | 2.5 | 0.0 | 5.5 | | |
| C9 | 0.2 | 1.0 | 0.8 | 0.0 | 1.7 | 0.0 | 3.8 | | |
| C10 | 0.1 | 0.9 | 0.5 | 0.0 | 1.3 | 0.0 | 2.8 | | |
| C11 | 0.1 | 0.9 | 0.2 | 0.0 | 1.1 | 0.0 | 2.4 | | |
| C12+ | 0.1 | 1.2 | 0.1 | 0.0 | 1.1 | 0.0 | 2.4 | | |
| Total | 1.5 | 8.6 | 14.7 | 0.1 | 9.1 | 0.0 | 34.1 | | |
| 430-650F LCO | Paraffin | Olefins | Nap | Nap | Nap | Arom | Arom | Arom | Total |
| C11- | 0.0 | 0.0 | 0.0 | 0.0 | 0.0 | 0.0 | 0.0 | 0.0 | 0.0 |
| C12 | 0.1 | 0.0 | 0.3 | 0.0 | 0.0 | 0.0 | 0.0 | 0.0 | 0.4 |
| C13 | 0.4 | 0.0 | 0.7 | 0.0 | 0.0 | 0.0 | 0.0 | 0.0 | 1.2 |
| C14 | 0.7 | 0.0 | 0.5 | 0.0 | 0.0 | 0.0 | 0.0 | 0.0 | 1.2 |
| C15 | 0.6 | 0.0 | 0.3 | 0.0 | 0.0 | 0.0 | 0.0 | 0.0 | 0.9 |
| C16 | 0.5 | 0.0 | 0.2 | 0.0 | 0.0 | 0.0 | 0.0 | 0.0 | 0.7 |
| C17 | 0.4 | 0.0 | 0.1 | 0.0 | 0.0 | 0.0 | 0.0 | 0.0 | 0.5 |
| C18+ | 0.7 | 0.0 | 0.2 | 0.0 | 0.0 | 0.0 | 0.0 | 0.0 | 1.0 |
| Total | 3.4 | 0.2 | 2.4 | 0.0 | 0.0 | 0.0 | 0.0 | 0.0 | 5.9 |

| | Paraffin | Nap | Nap | Nap | Arom | Arom | Arom | Arom | Total |
|---|---|---|---|---|---|---|---|---|---|
| 650F+ CSO | 2.3 | 0.2 | 0.0 | 0.0 | 0.0 | 0.0 | 0.0 | 0.0 | 2.5 |
| Coke | | | | | | | | | 0.0 |

FIG. 18

Yields from Hydrotreated Hydraulic Oil over Low Rare Earth USY + 10 wt% ZSM-5 at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| C1 | 0.0 | | | | | 0.0 | | | |
| C2 | 0.0 | | 2.4 | | | 2.4 | | | |
| C3 | 1.4 | | 11.8 | | | 13.3 | | | |
| C4 | 0.8 | 7.1 | 11.0 | | | 18.9 | | | |
| | 0.3 | 5.8 | 1.8 | 0.7 | 0.4 | 9.0 | | | |
| Total C3- | 2.5 | 12.9 | 24.6 | 0.7 | 0.4 | 41.2 | | | |
| C6-430F | nPar | iPar | Ole | CyOle | Nap | Arom | Total | | |
| C6 | 0.1 | 4.2 | 0.3 | 1.0 | 1.2 | 0.7 | 7.6 | | |
| C7 | 0.1 | 2.3 | 0.1 | 1.4 | 2.0 | 3.1 | 9.0 | | |
| C8 | 0.1 | 1.6 | 0.0 | 1.7 | 2.3 | 5.7 | 11.2 | | |
| C9 | 0.0 | 1.0 | 0.0 | 0.5 | 1.1 | 3.4 | 6.1 | | |
| C10 | 0.0 | 0.7 | 0.0 | 0.0 | 0.5 | 1.9 | 3.2 | | |
| C11 | 0.0 | 0.0 | 0.0 | 0.1 | 0.7 | 2.8 | 4.2 | | |
| C12 | 0.0 | 0.5 | 0.0 | 0.1 | 0.6 | 1.6 | 2.8 | | |
| Total | 0.4 | 10.9 | 0.5 | 4.8 | 8.4 | 19.2 | 44.2 | | |
| 430-650F | Paraffin | Olefins | Nap | Nap | Nap | Arom | Arom | Arom | Total |
| C11- | 0.0 | 0.0 | 0.0 | 0.1 | 0.0 | 0.2 | 0.4 | 0.0 | 0.7 |
| C12 | 0.0 | 0.1 | 0.0 | 0.3 | 0.0 | 1.5 | 1.2 | 0.0 | 3.1 |
| C13 | 0.1 | 0.1 | 0.0 | 0.5 | 0.0 | 1.6 | 1.0 | 0.0 | 3.3 |
| C14 | 0.1 | 0.0 | 0.0 | 0.3 | 0.1 | 0.8 | 0.5 | 0.0 | 1.8 |
| C15 | 0.1 | 0.0 | 0.0 | 0.1 | 0.2 | 0.3 | 0.2 | 0.0 | 0.8 |
| C16 | 0.0 | 0.0 | 0.0 | 0.0 | 0.3 | 0.1 | 0.0 | 0.0 | 0.4 |
| C17 | 0.0 | 0.0 | 0.0 | 0.0 | 0.2 | 0.0 | 0.0 | 0.0 | 0.2 |
| C18 | 0.0 | 0.0 | 0.0 | 0.0 | 0.3 | 0.0 | 0.0 | 0.0 | 0.3 |
| Total | 0.4 | 0.3 | 0.0 | 1.3 | 0.8 | 4.6 | 3.4 | 0.0 | 10.6 |

| | Paraffin | Nap | Nap | Nap | Arom | Arom | Arom | Arom | Total |
|---|---|---|---|---|---|---|---|---|---|
| 850F+ CSO | 0.7 | 0.0 | 0.0 | 0.3 | 0.0 | 0.0 | 0.0 | 0.2 | 1.5 |
| Coke | | | | | | | | | 0.1 |

FIG. 19

Yields from Hydrotreated Hydraulic Oil over Ultra Low Hydrogen Transfer USY + 10 wt% ZSM-5 at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| S | 0.0 | | | | | 0.0 | | | |
| C1 | 0.0 | | 3.9 | | | 3.9 | | | |
| C2 | 0.2 | | 16.8 | | | 17.1 | | | |
| C3 | 0.1 | 0.3 | 19.5 | | | 20.2 | | | |
| C4 | 0.1 | 0.4 | 4.3 | 1.3 | 0.2 | 6.3 | | | |
| Total C3- | 0.4 | 0.8 | 40.7 | 1.3 | 0.2 | 43.6 | | | |
| C6-430F | nPar | iPar | Ole | CyOle | Nap | Arom | Total | | |
| C6 | 0.1 | 0.5 | 1.8 | 2.5 | 0.8 | 0.1 | 5.6 | | |
| C7 | 0.0 | 0.3 | 0.3 | 4.3 | 1.3 | 0.3 | 6.8 | | |
| C8 | 0.0 | 0.2 | 0.2 | 5.2 | 1.0 | 0.9 | 7.8 | | |
| C9 | 0.0 | 0.2 | 0.1 | 1.4 | 0.8 | 0.4 | 2.9 | | |
| C10 | 0.0 | 0.1 | 0.0 | 1.2 | 0.0 | 0.3 | 2.3 | | |
| C11 | 0.0 | 0.1 | 0.0 | 3.5 | 0.8 | 0.5 | 5.0 | | |
| C12 | 0.0 | 0.1 | 0.0 | 4.4 | 0.7 | 0.3 | 5.6 | | |
| Total | 0.2 | 1.5 | 2.8 | 22.5 | 6.6 | 2.4 | 36.0 | | |
| 430-650F | Paraffin | Olefins | Nap | Nap | Nap | Arom | Arom | Arom | Total |
| C11- | 0.0 | 0.3 | 0.0 | 0.1 | 0.0 | 0.0 | 0.0 | 0.0 | 0.6 |
| C12 | 0.0 | 3.2 | 0.0 | 0.4 | 0.0 | 0.3 | 0.0 | 0.0 | 3.9 |
| C13 | 0.0 | 4.4 | 0.0 | 0.6 | 0.0 | 0.3 | 0.0 | 0.0 | 5.4 |
| C14 | 0.0 | 2.2 | 0.0 | 0.4 | 0.1 | 0.1 | 0.0 | 0.0 | 2.8 |
| C15 | 0.0 | 0.3 | 0.0 | 0.1 | 0.2 | 0.0 | 0.0 | 0.0 | 0.6 |
| C16 | 0.0 | 0.3 | 0.0 | 0.0 | 0.2 | 0.0 | 0.0 | 0.0 | 0.6 |
| C17 | 0.0 | 0.2 | 0.0 | 0.0 | 0.2 | 0.0 | 0.0 | 0.0 | 0.4 |
| C18 | 0.0 | 0.1 | 0.0 | 0.0 | 0.2 | 0.0 | 0.0 | 0.0 | 0.4 |
| Total | 0.2 | 11.2 | 0.0 | 1.5 | 0.8 | 0.9 | 0.0 | 0.0 | 14.7 |

| | Paraffin | Nap | Nap | Nap | Arom | Arom | Arom | Arom | Total |
|---|---|---|---|---|---|---|---|---|---|
| 650F+ CSO | 0.7 | 0.0 | 0.6 | 0.5 | 0.0 | 0.0 | 0.0 | 0.0 | 1.8 |
| Coke | | | | | | | | | 0.0 |

FIG. 20

Yields from Hydrotreated Hydraulic Oil over Low Rare Earth USY at 482°C and 3.9 Cat to Oil

| Gas Yields | nPar | iPar | Ole | CyOle | Nap | Total | | | |
|---|---|---|---|---|---|---|---|---|---|
| H2-H2S-NH3 | 0.0 | | | | | 0.0 | | | |
| C1 | 0.0 | | | | | 0.0 | | | |
| C2 | 0.0 | | 0.0 | | | 0.0 | | | |
| C3 | 0.8 | | 4.7 | | | 5.5 | | | |
| C4 | 0.6 | 4.2 | 7.3 | | | 12.1 | | | |
| Total C3- | 0.4 | 5.5 | 4.1 | 0.7 | 0.5 | 11.2 | | | |
| | 1.8 | 9.8 | 16.0 | 0.7 | 0.5 | 28.8 | | | |
| C6-430F | nPar | iPar | Ole | CyOle | Nap | Arom | Total | | |
| C6 | 0.2 | 6.8 | 2.0 | 1.0 | 1.5 | 0.7 | 12.3 | | |
| C7 | 0.2 | 5.1 | 0.7 | 1.4 | 2.8 | 3.1 | 13.5 | | |
| C8 | 0.1 | 3.4 | 0.3 | 1.7 | 3.0 | 5.6 | 14.1 | | |
| C9 | 0.1 | 1.9 | 0.1 | 0.5 | 1.5 | 3.4 | 7.6 | | |
| C10 | 0.0 | 1.1 | 0.1 | 0.0 | 0.7 | 1.9 | 3.9 | | |
| C11 | 0.0 | 0.9 | 0.0 | 0.1 | 0.7 | 2.8 | 4.5 | | |
| C12 | 0.0 | 0.6 | 0.0 | 0.1 | 0.6 | 1.6 | 2.9 | | |
| Total | 0.7 | 19.8 | 3.2 | 4.8 | 10.9 | 19.2 | 58.7 | | |
| 430-650F | Paraffin | Olefins | Nap | Nap | Nap | Arom | Arom | Arom | Total |
| C11- | 0.0 | 0.0 | 0.0 | 0.1 | 0.0 | 0.2 | 0.5 | 0.0 | 0.7 |
| C12 | 0.0 | 0.1 | 0.0 | 0.3 | 0.0 | 1.6 | 1.2 | 0.0 | 3.2 |
| C13 | 0.1 | 0.1 | 0.0 | 0.4 | 0.0 | 1.7 | 1.0 | 0.0 | 3.4 |
| C14 | 0.1 | 0.0 | 0.0 | 0.3 | 0.1 | 0.9 | 0.6 | 0.0 | 1.9 |
| C15 | 0.1 | 0.0 | 0.0 | 0.1 | 0.2 | 0.3 | 0.2 | 0.0 | 0.9 |
| C16 | 0.0 | 0.0 | 0.0 | 0.0 | 0.2 | 0.1 | 0.0 | 0.0 | 0.4 |
| C17 | 0.0 | 0.0 | 0.0 | 0.0 | 0.1 | 0.0 | 0.0 | 0.0 | 0.2 |
| C18 | 0.0 | 0.0 | 0.0 | 0.0 | 0.2 | 0.0 | 0.0 | 0.0 | 0.3 |
| Total | 0.4 | 0.2 | 0.0 | 1.1 | 0.7 | 4.9 | 3.6 | 0.0 | 11.0 |

| | Paraffin | Nap | Nap | Nap | Arom | Arom | Arom | Arom | Total |
|---|---|---|---|---|---|---|---|---|---|
| 650F+CSO | 0.5 | 0.0 | 0.0 | 0.4 | 0.0 | 0.0 | 0.0 | 0.2 | 1.2 |
| Coke | | | | | | | | | 0.2 |

FIG. 21

Yields from fully hydrotreated 343°C+ MCB over Conventional USY at 482°C and 3.9 Cat to Oil

| Gas Yields | nPar | iPar | Ole | CyOle | Nap | Total | | | |
|---|---|---|---|---|---|---|---|---|---|
| H2+H2S+ | 0.0 | | | | | 0.0 | | | |
| NH3 | 0.0 | | | | | 0.0 | | | |
| C1 | 0.0 | | 0.1 | | | 0.2 | | | |
| C2 | 3.4 | | 2.1 | | | 5.5 | | | |
| C3 | 2.8 | 8.0 | 1.7 | | | 12.6 | | | |
| C4 | 1.0 | 4.6 | 0.3 | 0.2 | 2.4 | 8.6 | | | |
| Total C3- | 7.2 | 12.6 | 4.1 | 0.2 | 2.4 | 26.7 | | | |
| C6-430F | nPar | iPar | Ole | CyOle | Nap | Arom | Total | | |
| C6 | 0.6 | 3.8 | 0.1 | 0.1 | 2.7 | 0.7 | 7.9 | | |
| C7 | 0.4 | 2.6 | 0.0 | 0.2 | 4.7 | 5.4 | 13.4 | | |
| C8 | 0.2 | 1.4 | 0.0 | 0.2 | 3.3 | 9.5 | 14.6 | | |
| C9 | 0.1 | 0.5 | 0.0 | 0.0 | 0.1 | 4.7 | 5.5 | | |
| C10 | 0.0 | 0.3 | 0.0 | 0.0 | 0.0 | 2.7 | 3.0 | | |
| C11 | 0.0 | 0.3 | 0.0 | 0.0 | 0.3 | 8.1 | 8.9 | | |
| C12+ | 0.0 | 0.4 | 0.0 | 0.0 | 0.0 | 3.6 | 4.0 | | |
| Total | 1.3 | 9.4 | 0.2 | 0.6 | 11.2 | 34.7 | 57.4 | | |
| 430-650F | Paraffins | Olefins | Nap | Nap | Nap | Arom | Arom | Arom | Total |
| C11- | 0.0 | 0.0 | 0.0 | 0.0 | 0.0 | 0.4 | 1.0 | 0.0 | 1.5 |
| C12 | 0.0 | 0.0 | 0.0 | 0.0 | 0.0 | 2.9 | 2.0 | 0.0 | 5.0 |
| C13 | 0.1 | 0.0 | 0.0 | 0.0 | 0.0 | 2.2 | 1.2 | 0.0 | 3.6 |
| C14 | 0.4 | 0.0 | 0.0 | 0.0 | 0.1 | 0.3 | 0.3 | 0.0 | 1.1 |
| C15 | 0.3 | 0.0 | 0.0 | 0.0 | 0.4 | 0.2 | 0.2 | 0.0 | 1.1 |
| C16 | 0.2 | 0.0 | 0.0 | 0.0 | 0.1 | 0.1 | 0.1 | 0.0 | 0.4 |
| C17 | 0.2 | 0.0 | 0.0 | 0.0 | 0.0 | 0.0 | 0.0 | 0.0 | 0.3 |
| C18+ | 0.3 | 0.0 | 0.0 | 0.0 | 0.2 | 0.1 | 0.0 | 0.0 | 0.6 |
| Total | 1.5 | 0.0 | 0.0 | 0.1 | 0.8 | 6.2 | 4.8 | 0.1 | 13.5 |

| | Paraffin | Nap | Nap | Nap | Arom | Arom | Arom | Arom | Total |
|---|---|---|---|---|---|---|---|---|---|
| 650F+ CSO | 0.3 | 0.0 | 0.0 | 0.9 | 0.0 | 0.1 | 0.1 | 0.5 | 1.9 |
| Coke | | | | | | | | | 0.3 |

FIG. 22

FUEL PRODUCTION FROM FCC PRODUCTS

CROSS-REFERENCE TO RELATED APPLICATIONS

This application claims the benefit of U.S. Provisional Ser. No. 62/186,678, filed Jun. 30, 2015, the entire contents of which are incorporated herein by reference.

FIELD

Systems and methods are provided for FCC processing and/or hydroprocessing of various feeds to form various FCC product fractions and/or hydroprocessed product fractions.

BACKGROUND

Fluid catalytic cracking (FCC) processes are commonly used in refineries as a method for converting feedstocks, without requiring additional hydrogen, to produce lower boiling fractions suitable for use as fuels. While FCC processes can be effective for converting a majority of a typical input feed, under conventional operating conditions at least a portion of the resulting products can correspond to a fraction that exits the process as a "bottoms" fraction. This bottoms fraction can typically be a high boiling range fraction, such as a ~650° F.+ (~343° C.+) fraction. Because this bottoms fraction may also contain FCC catalyst fines, this fraction can sometimes be referred to as a catalytic slurry oil.

U.S. Pat. No. 8,691,076 describes a method for manufacturing naphthenic base oils from effluences of a fluidized catalytic cracking unit. The method describes using an FCC unit to process an atmospheric resid to form a fuels fraction, a light cycle oil fraction, and a slurry oil fraction. Portions of the light cycle oil and/or the slurry oil are then hydrotreated and dewaxed to form a naphthenic base oil.

SUMMARY

In various aspects, hydrocarbonaceous compositions are provided based on products from FCC processing, hydrotreatment of products of FCC processing, or combinations thereof. Products from hydroprocessing of catalytic slurry oils derived from FCC processing can be characterized based on, for example, energy density, low temperature operability properties, hydrogen content, paraffin content, naphthenes content, aromatics content, and combinations thereof. Products from FCC processing of hydroprocessed catalytic slurry oil can be characterized based on, for example, energy density, low temperature operability properties, hydrogen content, paraffin content, naphthenes content, aromatics content, and combinations thereof. Products from FCC processing at low temperature and high conversion (optionally after hydroprocessing) can be characterized based on, for example, hydrogen content, paraffin content, naphthenes content, aromatics content, olefin to paraffin ratio for $C_3$, $C_4$, $C_5$, $C_6$, and/or $C_7$ components, and combinations thereof. In various aspects, hydrocarbonaceous compositions can be used in part to form a variety of fuel products, such as fuel oils, distillate fuels, and/or gasolines.

BRIEF DESCRIPTION OF THE DRAWINGS

FIG. 6 shows results from hydrotreatment of a catalytic slurry oil.

FIG. 7 shows results from hydrotreatment of a catalytic slurry oil.

FIG. 8 shows results from hydrotreatment of a catalytic slurry oil.

FIG. 9 shows results from hydrotreatment of a catalytic slurry oil.

FIG. 10 shows results from hydrotreatment of a catalytic slurry oil.

FIG. 11 shows results from hydrotreatment of a catalytic slurry oil.

FIG. 12 shows potential feeds for FCC processing.

FIG. 13 shows results from FCC processing of a paraffinic feed.

FIG. 14 shows results from FCC processing of a paraffinic feed under low temperature and high conversion conditions.

FIG. 15 shows model results for FCC processing of a paraffinic feed under low temperature and high conversion conditions.

FIG. 16 shows results from FCC processing of a paraffinic feed.

FIG. 17 shows results from FCC processing of a paraffinic feed under low temperature and high conversion conditions.

FIG. 18 shows model results for FCC processing of a paraffinic feed under low temperature and high conversion conditions.

FIG. 19 shows results from FCC processing of a naphthenic feed under low temperature and high conversion conditions.

FIG. 20 shows model results for FCC processing of a naphthenic feed under low temperature and high conversion conditions.

FIG. 21 shows results from FCC processing of a naphthenic feed under low temperature and high conversion conditions.

FIG. 22 shows results from FCC processing of a bottoms portion of a hydrotreatment effluent from hydrotreatment of a catalytic slurry oil.

DETAILED DESCRIPTION

Figure 1:
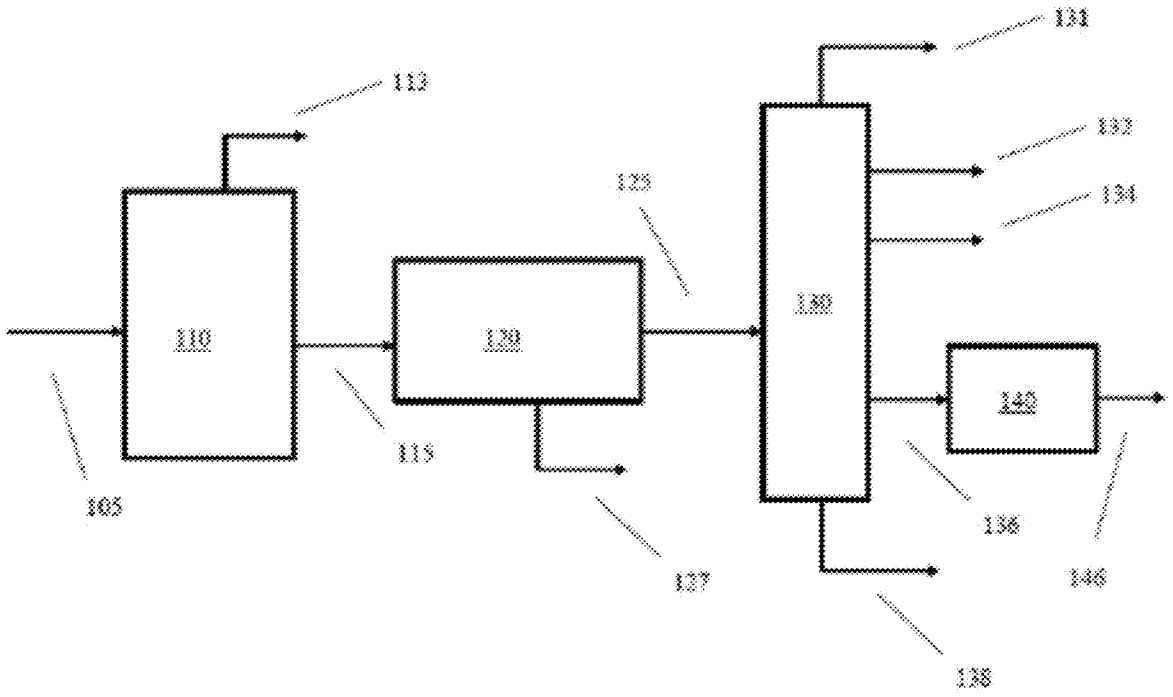
FIG. 1 shows an example of a reaction system for processing a feed comprising a catalytic slurry oil.

In various aspects, systems and methods are provided for upgrading catalytic slurry oil to form naphtha boiling range and/or distillate boiling range and/or residual fuel products. It has been unexpectedly discovered that catalytic slurry oil can be separately hydroprocessed under fixed bed conditions to achieve substantial conversion of asphaltenes within the slurry oil (such as substantially complete conversion) while reducing/minimizing the amount of coke formation on the hydroprocessing catalyst. Hydrotreating can be an example of a suitable type of hydroprocessing. After such hydroprocessing, a portion of the hydroprocessed effluent can be processed under fluid catalytic cracking conditions to form various products, including distillate boiling range fuels and/or naphtha boiling range fuels. Additionally or alternately, a portion of the hydroprocessed effluent can correspond to a distillate boiling range product, such as a fuel or fuel blendstock product. Additionally or alternately, a portion of the hydroprocessed effluent can be suitable for use as an (ultra) low sulfur fuel oil, such as a fuel oil having a sulfur content of ~0.5 wt % or less (or ~0.1 wt % or less).

In various aspects, systems and methods are provided for upgrading feedstocks using FCC processing under low temperature and high conversion conditions. Under conventional FCC operation, the amount of conversion of an input feed relative to a conversion temperature can be dependent in part on the temperature of the FCC process. Lower temperature operation of an FCC process can typically result in lower amounts of feed conversion. It has been unexpectedly discovered that an FCC reactor can be operated at low temperature while still achieving high conversion relative to a suitable conversion temperature, such as ~430° C., when using feeds with certain characteristics as the input feed to the FCC reactor. Operating at low temperature and high conversion conditions can allow for production of products with unexpected properties, such as naphtha boiling range fractions with high olefin content for compounds with a selected number of carbons. Additionally or alternately, when operating an FCC reactor under low temperature and high conversion conditions, using feeds with certain characteristics as the input feed to the FCC reactor can reduce/minimize the amount of coke formed during an FCC process. Due to the low amounts of coke produced, additional fuel can be needed for the FCC catalyst regenerator.

Fluid catalytic cracking (FCC) processes can commonly be used in refineries to increase the amount of fuels that can be generated from a feedstock. Because FCC processes do not typically involve addition of hydrogen to the reaction environment, FCC processes can be useful for conversion of higher boiling fractions to naphtha and/or distillate boiling range products at a lower cost than hydroprocessing. However, such higher boiling fractions can often contain multi-ring aromatic compounds not readily converted, in the absence of additional hydrogen, by the medium/large pore molecular sieves typically used in FCC processes. As a result, FCC processes can often generate a bottoms fraction that can be highly aromatic in nature. The bottoms fraction may contain catalyst fines generated from the fluidized bed of catalyst during the FCC process. This type of FCC bottoms fraction may be referred to as a catalytic slurry oil or main column bottoms.

Conventionally, identifying a method for processing FCC bottoms to generate a high value product has posed problems. A simple option could be to try to recycle the FCC bottoms to a pre-hydrotreater for the FCC process (sometimes referred to as a catalytic feed hydrotreater) and/or the FCC process itself. Unfortunately, recycle of FCC bottoms to a pre-hydrotreatment process has conventionally been ineffective, in part due to the presence of asphaltenes in the FCC bottoms. Typical FCC bottoms fractions can have a relatively high insolubility number (IN) of about 70 to about 130, which can correspond to the volume percentage of toluene that would be needed to maintain solubility of a given petroleum fraction. According to conventional practices, combining a feed with an IN of greater than about 50 with a virgin crude oil fraction can lead to rapid coking under hydroprocessing conditions.

More generally, it can be conventionally understood that conversion of ~1050° F.+ (~566° C.+) vacuum resid fractions by hydroprocessing and/or hydrocracking can be limited by incompatibility. Under conventional understanding, at somewhere between ~30 wt % and ~55 wt % conversion of the ~1050° F.+ (~566° C.+) portion, the reaction product during hydroprocessing can become incompatible with the feed. For example, as the ~566° C.+ feedstock converts to ~1050° F.− (~566° C.−) products, hydrogen transfer, oligomerization, and dealkylation reactions can occur which create molecules increasingly difficult to keep in solution. Somewhere between ~30 wt % and ~55 wt %~566° C.+ conversion, a second liquid hydrocarbon phase separates. This new incompatible phase, under conventional understanding, can correspond to mostly polynuclear aromatics rich in N, S, and metals. The new incompatible phase can potentially be high in micro carbon residue (MCR). The new incompatible phase can stick to surfaces in the unit where it can coke and then can foul the equipment. Based on this conventional understanding, catalytic slurry oil can conventionally be expected to exhibit properties similar to a vacuum resid fraction during hydroprocessing. A catalytic slurry oil can have an IN of about 70 to about 130, ~1-6 wt % n-heptane insolubles and a boiling range profile including about 3 wt % to about 12 wt % or less of ~566° C.+ material. Based on the above conventional understanding, it can be expected that hydroprocessing of a catalytic slurry oil could cause incompatibility as the asphaltenes and/or ~566° C.+ material becomes converted.

With regard to the FCC process itself, the large polyaromatic cores of typical asphaltene molecules are not readily cracked by typical FCC catalyst. As a result, recycling the bottoms to the FCC process itself can tend to result in only modest additional conversion of the bottoms. Due in part to these difficulties, a conventional use for catalytic slurry oil has been to use the slurry oil as a bunker fuel or fuel oil. In addition to fuel oil being a relatively low value product, increasing amounts of regulation on marine fuels may lead to more stringent requirements on the amount of sulfur that can be present in fuel oil.

In various aspects, one or more of the above difficulties can be overcome by using a catalytic slurry oil (i.e., bottoms from an FCC process) as feed for production of naphtha and distillate boiling range fuel products. A catalytic slurry oil can be processed as part of a feed where the catalytic slurry oil can correspond to at least about 25 wt % of the feed to a process for forming fuels, such as at least about 50 wt %, at least about 75 wt %, at least about 90 wt %, or at least about 95 wt %. Optionally, the feed can correspond to at least about 99 wt % of a catalytic slurry oil, therefore corresponding to a feed consisting essentially of catalytic slurry oil. In particular, a feed can comprise about 25 wt % to about 100 wt % catalytic slurry oil, about 25 wt % to about 99 wt %, about 50 wt % to about 90 wt %, or about 90 wt % to about 100 wt % (i.e., a feed comprising about 90 wt % to about 100 wt % of a catalytic slurry oil is defined herein as a feed substantially composed of a catalytic slurry oil). In contrast to many types of potential feeds for production of fuels, the asphaltenes in a catalytic slurry oil can apparently be converted on a time scale comparable to the time scale for conversion of other aromatic compounds in the catalytic slurry oil. In other words, without being bound by any particular theory, the asphaltene-type compounds in a catalytic slurry oil susceptible to precipitation/insolubility can be converted at a proportional rate to the conversion of compounds that help to maintain solubility of asphaltene-type compounds. This can have the effect that, during hydroprocessing, the rate of decrease of the SBN for the catalytic slurry oil can be similar to the rate of decrease of IN, so that precipitation of asphaltenes during processing can be reduced, minimized, or eliminated. As a result, it has been unexpectedly discovered that catalytic slurry oil can be processed at effective hydroprocessing conditions for substantial conversion of the feed without causing excessive coking of the catalyst. This can allow hydroprocessing to be used to at least partially break down the ring structures of the aromatic cores in the catalytic slurry oil. In a sense, hydroprocessing of a catalytic slurry oil as described herein can serve as a type of "hydrodeasphalting", where the asphaltene type compounds are removed by hydroprocessing rather than by solvent extraction. After this at least partial conversion, the hydroprocessed slurry oil can optionally then be processed under fluidized catalytic cracking conditions to form one or more naphtha and/or distillate fuel compounds as part of the product from the FCC process. The net result of the hydroprocessing (and optional FCC processing) of the catalytic slurry oil can be conversion of a potential high sulfur fuel oil product (catalytic slurry oil) into a combination of low sulfur diesel (and/or naphtha), low sulfur fuel oil, and/or FCC gasoline. The heptane asphaltenes or n-heptane insoluble (NHI) and ~1050° F.+ (~566° C.+) components of the catalytic slurry oil can be quantitatively converted to heptane soluble, ~1050° F.− (~566° C.−) components while remaining fully compatible.

An additional favorable feature of hydroprocessing a catalytic slurry oil can be the increase in product volume that can be achieved. Due to the high percentage of aromatic cores in a catalytic slurry oil, hydroprocessing of catalytic slurry oil can result in substantial consumption of hydrogen. The additional hydrogen added to a catalytic slurry oil can result in an increase in volume for the hydroprocessed catalytic slurry oil or volume swell. For example, the amount of $C_3$+ liquid products generated from hydrotreatment and FCC processing of catalytic slurry oil can be greater than ~100% of the volume of the initial catalytic slurry oil. The additional hydrogen for the hydrotreatment of the FCC slurry oil can be provided from any convenient source.

For example, hydrogen can be generated via steam reforming of a shale gas or another natural gas type feed. In such an example, input streams corresponding to inexpensive catalytic slurry oil and inexpensive hydrogen derived from U.S. shale gas can be combined to produce liquid propane gas (LPG), gasoline, diesel/distillate fuels, and/or (ultra) low sulfur fuel oil. By processing a feed composed substantially of catalytic slurry oil, the incompatibility that can occur with conventional blended feedstocks can be avoided. Hydroprocessing within the normal range of commercial hydrotreater operations can enable ~1500-3000 SCF/bbl (~260 $Nm^3/m^3$ to ~510 $Nm^3/m^3$) of hydrogen to be added to a feed substantially composed of catalytic slurry oil. This can result in substantial conversion of a feed to ~700° F.− (~371° C.−) products, such as at least about 40 wt % conversion to ~371° C.− products, or at least about 50 wt %, or at least about 60 wt %, and up to about 90 wt % or more. In some aspects, the ~371° C.− product can meet the requirements for a low sulfur diesel fuel blendstock in the U.S. Additionally or alternately, the ~371° C.− product(s) can be upgraded by further hydroprocessing to a low sulfur diesel fuel or blendstock. The remaining ~700° F.+(~371° C.+) product can meet the normal specifications for a <~0.5 wt % S bunker fuel or a <~0.1 wt % S bunker fuel, and/or may be blended with a distillate range blendstock to produce a finished blend that can meet the specifications for a <~0.1 wt % S bunker fuel. Additionally or alternately, a ~343° C.+ product can be formed that can be suitable for use as a <~0.1 wt % S bunker fuel without additional blending.

Additionally or alternately, the remaining ~371° C.+ product (and/or portions of the ~371° C.+ product) can be used as feedstock to an FCC unit and cracked to generate additional LPG, gasoline, and diesel fuel, so that the yield of ~371° C.− products relative to the total liquid product yield can be at least about 60 wt %, or at least about 70 wt %, or at least about 80 wt %. Relative to the feed, the yield of $C_3$+ liquid products can be at least about 100 vol %, such as at least about 105 vol %, at least about 110 vol %, at least about 115 vol %, or at least about 120 vol %. In particular, the yield of $C_3$+ liquid products can be about 100 vol % to about 150 vol %, or about 110 vol % to about 150 vol %, or about 120 vol % to about 150 vol %.

Another option for characterizing conversion can be to characterize conversion relative to 1050° F. (~566° C.). A catalytic slurry oil may only contain a few weight percent of ~566° C.+ components, such as about 3 wt % to about 12 wt %. However, under a conventional understanding, conversion of more than about 50% of this ~566° C.+ portion would be expected to lead to rapid coking and plugging of a fixed bed hydrotreatment reactor. It has been unexpectedly determined that the hydrotreatment conditions described herein can allow for at least about 50% conversion of ~566° C.+ compounds in a catalytic slurry oil with only minimal coke formation. In various aspects, the amount of conversion of ~566° C.+ components to ~566° C.− components can be at least about 50 wt %, or at least about 60 wt %, or at least about 70 wt %, or at least about 80 wt %, such as up to substantially complete conversion of ~566° C.+ components of a catalytic slurry oil. In particular, the amount of conversion of ~566° C.+ components to ~566° C.− components can be about 50 wt % to about 100 wt %, or about 60 wt % to about 100 wt %, or about 70 wt % to about 100 wt %.

As defined herein, the term "hydrocarbonaceous" includes compositions or fractions containing hydrocarbons and hydrocarbon-like compounds that may contain heteroatoms typically found in petroleum or renewable oil fraction and/or that may be typically introduced during conventional processing of a petroleum fraction. Heteroatoms typically found in petroleum or renewable oil fractions include, but are not limited to, sulfur, nitrogen, phosphorous, and oxygen. Other types of atoms different from carbon and hydrogen that may be present in a hydrocarbonaceous fraction or composition can include alkali metals as well as trace transition metals (such as Ni, V, and/or Fe).

In this discussion, reference may be made to catalytic slurry oil, FCC bottoms, and main column bottoms. These terms can be used interchangeably herein. It can be noted that, when initially formed, a catalytic slurry oil can include several weight percent of catalyst fines. Such catalyst fines can optionally be removed (such as partially removed to a desired level) by any convenient method, such as filtration. Any such catalyst fines can be removed prior to incorporating a fraction derived from a catalytic slurry oil into a product pool, such as a naphtha fuel pool or a diesel fuel pool. In this discussion, unless otherwise explicitly noted, references to a catalytic slurry oil are defined to include catalytic slurry oil either prior to or after such a process for reducing the content of catalyst fines within the catalytic slurry oil.

In some aspects, reference may be made to conversion of a feedstock relative to a conversion temperature. Conversion relative to a temperature can be defined based on the portion of the feedstock boiling at greater than the conversion temperature. The amount of conversion during a process (or optionally across multiple processes) can correspond to the weight percentage of the feedstock converted from boiling above the conversion temperature to boiling below the conversion temperature. As an illustrative hypothetical example, consider a feedstock including 40 wt % of components boiling at ~700° F. (~371° C.) or greater. By definition, the remaining ~60 wt % of the feedstock boils at less than ~700° F. (~371° C.). For such a feedstock, the amount of conversion relative to a conversion temperature of ~371° C. would be based only on the ~40 wt % initially boiling at ~371° C. or greater. If such a feedstock could be exposed to a process with 30% conversion relative to a ~371° C. conversion temperature, the resulting product would include ~72 wt % of ~371° C.~ components and ~28 wt % of ~371° C.+ components.

In various aspects, reference may be made to one or more types of fractions generated during distillation of a petroleum feedstock. Such fractions may include naphtha fractions, kerosene fractions, diesel fractions, and vacuum gas oil fractions. Each of these types of fractions can be defined based on a boiling range, such as a boiling range including at least ~90 wt % of the fraction, or at least ~95 wt % of the fraction. For example, for many types of naphtha fractions, at least ~90 wt % of the fraction, or at least ~95 wt %, can have a boiling point in the range of ~85° F. (~29° C.) to ~350° F. (~177° C.). For some heavier naphtha fractions, at least ~90 wt % of the fraction, and preferably at least ~95 wt %, can have a boiling point in the range of ~85° F. (~29° C.) to ~400° F. (~204° C.). For a kerosene fraction, at least ~90 wt % of the fraction, or at least ~95 wt %, can have a boiling point in the range of ~300° F. (~149° C.) to ~600° F. (~288° C.). For a kerosene fraction targeted for some uses, such as jet fuel production, at least ~90 wt % of the fraction, or at least ~95 wt %, can have a boiling point in the range of ~300° F. (~149° C.) to ~550° F. (~288° C.). For a diesel fraction, at least ~90 wt % of the fraction, and preferably at least ~95 wt %, can have a boiling point in the range of ~400° F. (~204° C.) to ~750° F. (~399° C.). For a (vacuum) gas oil fraction, at least ~90 wt % of the fraction, and preferably at least ~95 wt %, can have a boiling point in the range of ~650° F. (~343° C.) to ~1100° F. (~593° C.). Optionally, for some gas oil fractions, a narrower boiling range may be desirable. For such gas oil fractions, at least ~90 wt % of the fraction, or at least ~95 wt %, can have a boiling point in the range of ~650° F. (~343° C.) to ~1000° F. (~538° C.), or ~650° F. (~343° C.) to ~900° F. (~482° C.). A residual fuel product can have a boiling range that may vary and/or overlap with one or more of the above boiling ranges. A residual marine fuel product can satisfy the requirements specified in ISO 8217, Table 2.

A method of characterizing the solubility properties of a petroleum fraction can correspond to the toluene equivalence (TE) of a fraction, based on the toluene equivalence test as described for example in U.S. Pat. No. 5,871,634 (incorporated herein by reference with regard to the definition for toluene equivalence, solubility number ($S_{BN}$), and insolubility number ($I_N$)). The calculated carbon aromaticity index (CCAI) can be determined according to ISO 8217. BMCI can refer to the Bureau of Mines Correlation Index, as commonly used by those of skill in the art.

In this discussion, the effluent from a processing stage may be characterized in part by characterizing a fraction of the products. For example, the effluent from a processing stage may be characterized in part based on a portion of the effluent that can be converted into a liquid product. This can correspond to a $C_3$+ portion of an effluent, and may also be referred to as a total liquid product. As another example, the effluent from a processing stage may be characterized in part based on another portion of the effluent, such as a $C_5$+ portion or a $C_6$+ portion. In this discussion, a portion corresponding to a "$C_x$+" portion can be, as understood by those of skill in the art, a portion with an initial boiling point that can roughly correspond to the boiling point for an aliphatic hydrocarbon containing "x" carbons.

In this discussion, a low sulfur fuel oil can correspond to a fuel oil containing about 0.5 wt % or less of sulfur. An ultra low sulfur fuel oil, which can also be referred to as an Emission Control Area fuel, can correspond to a fuel oil containing about 0.1 wt % or less of sulfur. A low sulfur diesel can correspond to a diesel fuel containing about 500 wppm or less of sulfur. An ultra low sulfur diesel can correspond to a diesel fuel containing about 15 wppm or less of sulfur, or about 10 wppm or less.

Feedstock—Catalytic Slurry Oil

A catalytic slurry oil can correspond to a high boiling fraction, such as a bottoms fraction, from an FCC process. A variety of properties of a catalytic slurry oil can be characterized to specify the nature of a catalytic slurry oil feed.

One aspect that can be characterized can correspond to a boiling range of the catalytic slurry oil. Typically the cut point for forming a catalytic slurry oil can be at least about 650° F. (~343° C.). As a result, a catalytic slurry oil can have a T5 distillation (boiling) point or a T10 distillation point of at least about 650° F. (~343° C.), as measured according to ASTM D2887. In some aspects the D2887 ~10% distillation point can be greater, such as at least about 675° F. (~357° C.), or at least about 700° F. (~371° C.). In some aspects, a broader boiling range portion of FCC products can be used as a feed (e.g., a 350° F.+/177° C.+ boiling range fraction of FCC liquid product), where the broader boiling range portion includes a ~650° F.+ (~343° C.+) fraction corresponding to a catalytic slurry oil. The catalytic slurry oil (~650° F.+/~343° C.+) fraction of the feed does not necessarily have to represent a "bottoms" fraction from an FCC process, so long as the catalytic slurry oil portion comprises one or more of the other feed characteristics described herein.

In addition to and/or as an alternative to initial boiling points, T5 distillation point, and/or T10 distillation points, other distillation points may be useful in characterizing a feedstock. For example, a feedstock can be characterized based on the portion of the feedstock that boils above ~1050° F. (~566° C.). In some aspects, a feedstock (or alternatively a 650° F.+/~343° C.+ portion of a feedstock) can have an ASTM D2887 T95 distillation point of ~1050° F. (~566° C.) or greater, or a T90 distillation point of ~1050° F. (~566° C.) or greater. If a feedstock or other sample contains components not suitable for characterization using D2887, other standard methods, such as ASTM D1160, may be used instead for such components.

In various aspects, density, or weight per volume, of the catalytic slurry oil can be characterized. The density of the catalytic slurry oil (or alternatively a ~650° F.+/~343° C.+ portion of a feedstock) can be at least about 1.06 g/cc, or at least about 1.08 g/cc, or at least about 1.10 g/cc, such as up to about 1.20 g/cc. The density of the catalytic slurry oil can provide an indication of the amount of heavy aromatic cores present within the catalytic slurry oil. A lower density catalytic slurry oil feed can in some instances correspond to a feed that may have a greater expectation of being suitable for hydrotreatment without substantial and/or rapid coke formation.

Contaminants such as nitrogen and sulfur are typically found in catalytic slurry oils, often in organically-bound form. Nitrogen content can range from about 50 wppm to about 5000 wppm elemental nitrogen, or about 100 wppm to about 2000 wppm elemental nitrogen, or about 250 wppm to about 1000 wppm, based on total weight of the catalytic slurry oil. The nitrogen containing compounds can be present as basic or non-basic nitrogen species. Examples of nitrogen species can include quinolones, substituted quinolones, carbazoles, and substituted carbazoles.

The sulfur content of a catalytic slurry oil feed can be at least about 500 wppm elemental sulfur, based on total weight of the catalytic slurry oil. Generally, the sulfur content of a catalytic slurry oil can range from about 500 wppm to about 100,000 wppm elemental sulfur, or from about 1000 wppm to about 50,000 wppm, or from about 1000 wppm to about 30,000 wppm, based on total weight of the heavy component. Sulfur can usually be present as organically bound sulfur. Examples of such sulfur compounds include the class of heterocyclic sulfur compounds such as thiophenes, tetrahydrothiophenes, benzothiophenes and their higher homologs and analogs. Other organically bound sulfur compounds include aliphatic, naphthenic, and aromatic mercaptans, sulfides, di- and polysulfides.

Catalytic slurry oils can include n-heptane insolubles (NHI) or asphaltenes. In some aspects, the catalytic slurry oil feed (or alternatively a ~650° F.+/−343° C.+ portion of a feed) can contain at least about 1.0 wt % of n-heptane insolubles or asphaltenes, or at least about 2.0 wt %, or at least about 3.0 wt %, or at least about 5.0 wt %, such as up to about 10 wt % or more. In particular, the catalytic slurry oil feed (or alternatively a ~343° C.+ portion of a feed) can contain about 1.0 wt % to about 10 wt % of n-heptane insolubles or asphaltenes, or about 2.0 wt % to about 10 wt %, or about 3.0 wt % to about 10 wt %. Another option for characterizing the heavy components of a catalytic slurry oil can be based on the amount of micro carbon residue (MCR) in the feed. In various aspects, the amount of MCR in the catalytic slurry oil feed (or alternatively a ~343° C.+ portion of a feed) can be at least about 5 wt %, or at least about 8 wt %, or at least about 10 wt %, such as up to about 15 wt % or more.

Based on the content of NHI and/or MCR in a catalytic slurry oil feed, the insolubility number (IN) for such a feed can be at least about 60, such as at least about 70, at least about 80, or at least about 90. Additionally or alternately, the IN for such a feed can be about 140 or less, such as about 130 or less, about 120 or less, about 110 or less, about 100 or less, about 90 or less, or about 80 or less. Each lower bound noted above for IN can be explicitly contemplated in conjunction with each upper bound noted above for IN. In particular, the IN for a catalytic slurry oil feed can be about 60 to about 140, or about 60 to about 120, or about 80 to about 140.

Feedstock for Low Temperature/High Conversion FCC Operation

In some aspects, a reaction system including an FCC unit can be configured to allow the FCC unit to operate at low temperature while providing an elevated level of conversion on the input to the FCC unit. This type of operation can be enabled in part by appropriately treating the input feed to the FCC unit so that the input feed can have one or more desired characteristics. The appropriate treatment prior to the FCC unit can be performed by hydroprocessing, which can include hydrotreatment, hydrofinishing, and/or catalytic dewaxing of a feed.

The input feed to an FCC unit during low temperature operation can correspond to a feed having a hydrogen content of at least about 12.0 wt %, such as at least about 12.2 wt %, at least about 12.4 wt %, at least about 12.6 wt %, at least about 12.8 wt %, at least about 13.0 wt %, at least about 13.2 wt %, at least about 13.4 wt %, at least about 13.6 wt %, at least about 13.8 wt %, or at least about 14.0 wt %. In particular, the hydrogen content can be about 12.0 wt % to about 16.0 wt %, or about 13.0 wt % to about 16.0 wt %, or about 14.0 wt % to about 15.8 wt %.

The input feed to an FCC unit during low temperature operation can correspond to a feed having a T90 distillation point of about 1100° F. (~593° C.) or less, or about 1050° F. (~566° C.) or less, or about 1000° F. (~538° C.) or less. Additionally or alternately, the input feed can have a T50 distillation point of about 700° F. (~371° C.) to about 900° F. (~482° C.). Additionally or alternately, the input feed can include about 15 wt % or less of ~566° C.+ compounds, or about 12 wt % or less, or about 10 wt % or less, or about 8 wt % or less, or about 6 wt % or less, or about 4 wt % or less. In particular, the input feed can include about 0 wt % to about 15 wt % of ~566° C.+ compounds, or about 0 wt % to about 10 wt %, or about 0.1 wt % to about 8 wt %.

The input feed to an FCC unit during low temperature operation can have a low content of micro carbon residue and/or a low content of metals. The micro carbon residue content of the input feed can be 5.0 wt % or less, such as about 4.0 wt % or less, about 3.0 wt % or less, about 2.0 wt % or less, or about 1.0 wt % or less. In particular, the micro carbon residue content of the input feed can be about 0 wt % to about 5.0 wt %, or about 0 wt % to about 3.0 wt %, or about 0.1 wt % to about 5.0 wt %. Additionally or alternately, the metals content of the input feed can be less than about 3.0 wppm, such as less than about 2.0 wppm, less than about 1.0 wppm, less than about 0.5 wppm, or less than about 0.1 wppm. In particular, the metals content can be about 0 wppm to about 3.0 wppm, or about 0 wppm to about 1.0 wppm, or about 0 wppm to about 0.5 wppm.

The input feed to an FCC unit during low temperature operation can have an aromatics content of about 40 wt % or less, such as about 30 wt % or less, about 25 wt % or less, about 20 wt % or less, about 15 wt % or less, about 10 wt % or less, or about 5 wt % or less, such as down to about 0.1 wt % or less (substantially no aromatics content). In particular, the aromatics content of the input feed can be about 0 wt % to about 40 wt %, or about 0.1 wt % to about 15 wt %, or about 1 wt % to about 25 wt %.

An input feed for FCC processing at low temperature/high conversion conditions can be generated by hydroprocessing of feed including a portion that boils in the lubricant and/or vacuum gas oil boiling range. A wide range of petroleum and chemical feedstocks can be hydroprocessed to form an FCC input feed suitable for low temperature/high conversion FCC processing. Suitable feedstocks include whole and reduced petroleum crudes, atmospheric, cycle oils, gas oils, including vacuum gas oils and coker gas oils, light to heavy distillates including raw virgin distillates, hydrocrackates, hydrotreated oils, extracts, slack waxes, Fischer-Tropsch waxes, raffinates, and mixtures of these materials.

Suitable feeds for hydroprocessing to form an FCC input feed can include, for example, feeds with an initial boiling point and/or a T5 boiling point and/or T10 boiling point of at least ~600° F. (~316° C.), or at least ~650° F. (~343° C.), or at least ~700° F. (~371° C.), or at least ~750° F. (~399° C.). Additionally or alternately, the final boiling point and/or T95 boiling point and/or T90 boiling point of the feed can be ~1100° F. (~593° C.) or less, or 1050° F. (~566° C.) or less, or 1000° F. (~538° C.) or less, or ~950° F. (~510° C.) or less. In particular, a feed can have a T5 to T95 boiling range of ~316° C. to ~593° C., or a T5 to T95 boiling range of ~343° C. to ~566° C., or a T10 to T90 boiling range of ~343° C. to ~566° C. Optionally, it can be possible to use a feed including a lower boiling range portion. Such a feed can have an initial boiling point and/or a T5 boiling point and/or T10 boiling point of at least ~350° F. (~177° C.), or at least ~400° F. (~204° C.), or at least ~450° F. (~232° C.). In particular, such a feed can have a T5 to T95 boiling range of ~177° C. to ~593° C., or a T5 to T95 boiling range of ~232° C. to ~566° C., or a T10 to T90 boiling range of ~177° C. to ~566° C.

In some optional aspects, the aromatics content of the feed for hydroprocessing to form an FCC input feed can be at least ~20 wt %, such as at least ~30 wt %, at least ~40 wt %, at least ~50 wt %, or at least ~60 wt %. In particular, the aromatics content can be ~20 wt % to ~90 wt %, or ~40 wt % to ~80 wt %, or ~50 wt % to ~80 wt %.

In some aspects, the feed for hydroprocessing to form an FCC input feed can have a sulfur content of ~500 wppm to ~50000 wppm or more, or ~500 wppm to ~20000 wppm, or ~500 wppm to ~10000 wppm. Additionally or alternately, the nitrogen content of such a feed can be ~20 wppm to ~8000 wppm, or ~50 wppm to ~4000 wppm. In some aspects, the feed can correspond to a "sweet" feed, so that the sulfur content of the feed can be ~10 wppm to ~500 wppm and/or the nitrogen content can be ~1 wppm to ~100 wppm.

In some aspects, at least a portion of the feed can correspond to a feed derived from a biocomponent source. In this discussion, a biocomponent feedstock refers to a hydrocarbon feedstock derived from a biological raw material component, from biocomponent sources such as vegetable, animal, fish, and/or algae. Note that, for the purposes of this document, vegetable fats/oils can refer generally to any plant based material, and can include fat/oils derived from a source such as plants of the genus Jatropha. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds insoluble in water, but soluble in nonpolar (or fat) solvents. Non-limiting examples of such solvents can include alcohols, ethers, chloroform, alkyl acetates, benzene, and combinations thereof.

Fixed Bed Hydrotreatment to Form FCC Input Feed

Prior to FCC processing, an input feed can be hydrotreated. An example of a suitable type of hydrotreatment can be hydrotreatment under trickle bed conditions. Hydrotreatment can be used, optionally in conjunction with other hydroprocessing, to form an input feed for FCC processing based on an initial feed. As noted above, the initial feed can correspond to a catalytic slurry oil and/or a feed including a vacuum gas oil boiling range portion.

Conventionally, feeds having an IN of greater than about 50 have been viewed as unsuitable for fixed bed (such as trickle bed) hydroprocessing. This conventional view can be due to the belief that feeds with an IN of greater than about 50 are likely to cause substantial formation of coke within a reactor, leading to rapid plugging of a fixed reactor bed. Instead of using a fixed bed reactor, feeds with a high IN value are conventionally processed using other types of reactors that can allow for regeneration of catalyst during processing, such as a fluidized bed reactor or an ebullating bed reactor. Alternatively, during conventional use of a fixed bed catalyst for processing of a high IN feed, the conditions can be conventionally selected to achieve a low amount of conversion in the feed relative to a conversion temperature of ~1050° F. (~566° C.), such as less than about 30% to about 50% conversion. Based on conventional understanding, performing a limited amount of conversion on a high IN feed can be required to avoid rapid precipitation and/or coke formation within a fixed bed reactor.

In various aspects, a feed composed substantially of a catalytic slurry oil can be hydrotreated under effective hydrotreating conditions to form a hydrotreated effluent. Optionally, the effective hydrotreating conditions can be selected to allow for reduction of the n-heptane asphaltene content of the hydrotreated effluent to less than about 1.0 wt %, or less than about 0.5 wt %, or less than about 0.1 wt %, and optionally down to substantially no remaining n-heptane asphaltenes. Additionally or alternately, the effective hydrotreating conditions can be selected to allow for reduction of the micro carbon residue content of the hydrotreated effluent to less than about 2.5 wt %, or less than about 1.0 wt %, or less than about 0.5 wt %, or less than about 0.1 wt %, and optionally down to substantially no remaining micro carbon residue.

Additionally or alternately, in various aspects, the combination of processing conditions can be selected to achieve a desired level of conversion of a feedstock, such as conversion relative to a conversion temperature of ~700° F. (~371° C.). For example, the process conditions can be selected to achieve at least about 40% conversion of the ~700° F.+ (~371° C.+) portion of a feedstock, such as at least about 50 wt %, or at least about 60 wt %, or at least about 70 wt %. Additionally or alternately, the conversion percentage can be about 80 wt % or less, or about 75 wt % or less, or about 70 wt % or less. In particular, the amount of conversion relative to 371° C. can be about 40 wt % to about 80 wt %, or about 50 wt % to about 70 wt %, or about 60 wt % to about 80 wt %. Further additionally or alternately, the amount of conversion of ~1050° F.+ (~566° C.+) components to ~1050° F.− (~566° C.−) components can be at least about 50 wt %, or at least about 60 wt %, or at least about 70 wt %, or at least about 80 wt %, such as up to substantially complete conversion of ~566° C.+ components of a catalytic slurry oil. In particular, the amount of conversion of ~566° C.+ components to ~566° C.− components can be about 50 wt % to about 100 wt %, or about 60 wt % to about 100 wt %, or about 70 wt % to about 100 wt %.

Hydroprocessing (such as hydrotreating) can be carried out in the presence of hydrogen. A hydrogen stream can be fed or injected into a vessel or reaction zone or hydroprocessing zone corresponding to the location of a hydroprocessing catalyst. Hydrogen, contained in a hydrogen "treat gas," can be provided to the reaction zone. Treat gas, as referred to herein, can be either pure hydrogen or a hydrogen-containing gas stream containing hydrogen in an amount that for the intended reaction(s). Treat gas can optionally include one or more other gasses (e.g., nitrogen and light hydrocarbons such as methane) that do not adversely interfere with or affect either the reactions or the products. Impurities, such as $H_2S$ and $NH_3$ are undesirable and can typically be removed from the treat gas before conducting the treat gas to the reactor. In aspects where the treat gas stream can differ from a stream that substantially consists of hydrogen (i.e., at least about 99 vol % hydrogen), the treat gas stream introduced into a reaction stage can contain at least about 50 vol %, or at least about 75 vol % hydrogen, or at least about 90 vol % hydrogen.

During hydrotreatment, a feedstream can be contacted with a hydrotreating catalyst under effective hydrotreating conditions which include temperatures in the range of about 450° F. to about 800° F. (~232° C. to ~427° C.), or about 550° F. to about 750° F. (~288° C. to ~399° C.); pressures in the range of about 1.5 MPag to about 20.8 MPag (~200 psig to ~3000 psig), or about 2.9 MPag to about 13.9 MPag (~400 psig to ~2000 psig); a liquid hourly space velocity (LHSV) of from about 0.1 $hr^{-1}$ to about 10 $hr^{-1}$, or about 0.1 $hr^{-1}$ to 5 $hr^{-1}$; and a hydrogen treat gas rate of from about 430 $Nm^3/m^3$ to about 2600 $Nm^3/m^3$ (~2500 SCF/bbl to ~15000 SCF/bbl), or about 850 $Nm^3/m^3$ to about 1700 $Nm^3/m^3$ (~5000 SCF/bbl to ~10000 SCF/bbl).

In an aspect, the hydrotreating step may comprise at least one hydrotreating reactor, and optionally may comprise two or more hydrotreating reactors arranged in series flow. A vapor separation drum can optionally be included after each hydrotreating reactor to remove vapor phase products from the reactor effluent(s). The vapor phase products can include hydrogen, $H_2S$, $NH_3$, and hydrocarbons containing four (4) or less carbon atoms (i.e., "$C_4$-hydrocarbons"). Optionally, a portion of the $C_3$ and/or $C_4$ products can be cooled to form liquid products. The effective hydrotreating conditions can be suitable for removal of at least about 70 wt %, or at least about 80 wt %, or at least about 90 wt % of the sulfur content in the feedstream from the resulting liquid products. Additionally or alternately, at least about 50 wt %, or at least about 75 wt % of the nitrogen content in the feedstream can be removed from the resulting liquid products. In some aspects, the final liquid product from the hydrotreating unit can contain less than about 1000 ppmw sulfur, or less than about 500 ppmw sulfur, or less than about 300 ppmw sulfur, or less than about 100 ppmw sulfur.

The effective hydrotreating conditions can optionally be suitable for incorporation of a substantial amount of additional hydrogen into the hydrotreated effluent. During hydrotreatment, the consumption of hydrogen by the feed in order to form the hydrotreated effluent can correspond to at least about 1500 SCF/bbl (~260 $Nm^3/m^3$) of hydrogen, or at least about 1700 SCF/bbl (~290 $Nm^3/m^3$), or at least about 2000 SCF/bbl (~330 $Nm^3/m^3$), or at least about 2200 SCF/bbl (~370 $Nm^3/m^3$), such as up to about 5000 SCF/bbl (~850 $Nm^3/m^3$) or more. In particular, the consumption of hydrogen can be about 1500 SCF/bbl (~260 $Nm^3/m^3$) to about 5000 SCF/bbl (~850 $Nm^3/m^3$), or about 2000 SCF/bbl (~340 $Nm^3/m^3$) to about 5000 SCF/bbl (~850 $Nm^3/m^3$), or about 2200 SCF/bbl (~370 $Nm^3/m^3$) to about 5000 SCF/bbl (~850 $Nm^3/m^3$).

Hydrotreating catalysts suitable for use herein can include those containing at least one Group 6 metal and at least one Group 8-10 metal, including mixtures thereof. Examples of suitable metals include Ni, W, Mo, Co, and mixtures thereof, for example CoMo, NiMoW, NiMo, or NiW. These metals or mixtures of metals are typically present as oxides or sulfides on refractory metal oxide supports. The amount of metals for supported hydrotreating catalysts, either individually or in mixtures, can range from ~0.5 to ~35 wt %, based on the weight of the catalyst. Additionally or alternately, for mixtures of Group 6 and Group 8-10 metals, the Group 8-10 metals can be present in amounts of from ~0.5 to ~5 wt % based on catalyst, and the Group 6 metals can be present in amounts of from 5 to 30 wt % based on the catalyst. A mixture of metals may also be present as a bulk metal catalyst wherein the amount of metal can comprise ~30 wt % or greater, based on catalyst weight.

Suitable metal oxide supports for the hydrotreating catalysts include oxides such as silica, alumina, silica-alumina, titania, or zirconia. Examples of aluminas suitable for use as a support can include porous aluminas such as gamma or eta. In some aspects where the support can correspond to a porous metal oxide support, the catalyst can have an average pore size (as measured by nitrogen adsorption) of about 30 Å to about 1000 Å, or about 50 Å to about 500 Å, or about 60 Å to about 300 Å. Pore diameter can be determined, for example, according to ASTM Method D4284-07 Mercury Porosimetry. Additionally or alternately, the catalyst can have a surface area (as measured by the BET method) of about 100 $m^2/g$ to about 350 $m^2/g$, or about 150 $m^2/g$ to about 250 $m^2/g$. In some aspects, a supported hydrotreating catalyst can have the form of shaped extrudates. The extrudate diameters can range from $1/32^{nd}$ to $1/8^{th}$ inch (~0.7 to ~3.0 mm), from $1/20^{th}$ to $1/10^{th}$ inch (~1.3 to ~2.5 mm), or from $1/20^{th}$ to $1/16^{th}$ inch (~1.3 to ~1.5 mm). The extrudates can be cylindrical or shaped. Non-limiting examples of extrudate shapes include trilobes and quadralobes.

Additional Hydroprocessing of Feed to Low Temperature/High Conversion FCC

Additionally or alternately, the hydrotreating conditions described above can be generally suitable for preparing a feed including a vacuum gas oil boiling range for use in a low temperature/high conversion FCC process. For example, hydrotreatment can be used to convert an initial feed including a vacuum gas oil boiling range portion to form a FCC input feed as described above. Optionally, other types of hydroprocessing can be used to form the FCC input feed. For example, catalytic dewaxing can be used as part of the hydroprocessing.

In various aspects, catalytic dewaxing can be included as part of a second or subsequent processing stage. Preferably, the dewaxing catalysts according to the invention are zeolites (and/or zeolitic crystals) that perform dewaxing primarily by isomerizing a hydrocarbon feedstock. More preferably, the catalysts are zeolites with a unidimensional pore structure. Suitable catalysts include 10-member ring pore zeolites, such as EU-1, ZSM-35 (or ferrierite), ZSM-11, ZSM-57, NU-87, SAPO-11, and ZSM-22. Preferred materials are EU-2, EU-11, ZBM-30, ZSM-48, or ZSM-23. ZSM-48 can be most preferred. Note that a zeolite having the ZSM-23 structure with a silica to alumina ratio of from 20:1 to 40:1 can sometimes be referred to as SSZ-32. Other zeolitic crystals isostructural with the above materials include Theta-1, NU-10, EU-13, KZ-1, and NU-23.

In various aspects, the dewaxing catalysts can include a metal hydrogenation component. The metal hydrogenation component can typically be a Group 6 and/or a Group 8-10 metal. Preferably, the metal hydrogenation component comprises a Group 8-10 noble metal. Preferably, the metal hydrogenation component comprises Pt, Pd, or a mixture thereof. In an alternative preferred embodiment, the metal hydrogenation component can be a combination of a non-noble Group 8-10 metal with a Group 6 metal. Suitable combinations can include Ni, Co, or Fe with Mo or W, preferably Ni with Mo or W.

The metal hydrogenation component may be added to the catalyst in any convenient manner. One technique for adding the metal hydrogenation component can be by incipient wetness. For example, after combining a zeolite and a binder, the combined zeolite and binder can be extruded into catalyst particles. These catalyst particles can then be exposed to a solution containing a suitable metal precursor. Alternatively, metal can be added to the catalyst by ion exchange, where a metal precursor can be added to a mixture of zeolite (or zeolite and binder) prior to extrusion.

The amount of metal in the catalyst can be at least ~0.1 wt % based on catalyst, or at least ~0.2 wt %, or at least ~0.3 wt %, or at least ~0.5 wt % based on catalyst. The amount of metal in the catalyst can be ~20 wt % or less based on catalyst, or ~10 wt % or less, or ~5 wt % or less, or ~3 wt % or less, or ~1 wt % or less. For aspects where the metal comprises Pt, Pd, another Group 8-10 noble metal, or a combination thereof, the amount of metal can be from ~0.1 to ~5 wt %, preferably from ~0.1 to ~2 wt %, or ~0.2 to ~2 wt %, or ~0.5 to 1.5 wt %. For aspects where the metal comprises a combination of a non-noble Group 8-10 metal with a Group 6 metal, the combined amount of metal can be from ~0.5 wt % to ~20 wt %, or ~1 wt % to ~15 wt %, or ~2 wt % to ~10 wt %.

Preferably, the dewaxing catalysts can be catalysts with a low molar ratio of silica to alumina. For example, for ZSM-48, the ratio of silica to alumina in the zeolite can be less than ~200:1, such as less than ~110:1, less than ~100:1, less than 90:1, or less than 80:1. In particular, the ratio of silica to alumina can be ~30:1 to ~200:1, or ~60:1 to ~110:1, or ~70:1 to ~100:1.

The dewaxing catalysts can optionally include a binder. In some embodiments, the dewaxing catalysts used in process according to the invention are formulated using a low surface area binder, a low surface area binder represents a binder with a surface area of ~100 $m^2/g$ or less, or ~80 $m^2/g$ or less, or ~70 $m^2/g$ or less, such as down to ~40 $m^2/g$ or still lower.

Optionally, the binder and the zeolite particle size can be selected to provide a catalyst with a desired ratio of micropore surface area to total surface area. In dewaxing catalysts used according to the invention, the micropore surface area can correspond to surface area from the unidimensional pores of zeolites in the dewaxing catalyst. The total surface can correspond to the micropore surface area plus the external surface area. Any binder used in the catalyst will not contribute to the micropore surface area and will not significantly increase the total surface area of the catalyst. The external surface area can represent the balance of the surface area of the total catalyst minus the micropore surface area. Both the binder and zeolite can contribute to the value of the external surface area. Preferably, the ratio of micropore surface area to total surface area for a dewaxing catalyst can be equal to or greater than ~25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can be used to modify the extrusion flow properties of the zeolite and binder mixture. The amount of framework alumina in the catalyst may range from ~0.1 to ~3.3 wt %, or ~0.1 to ~2.7 wt %, or ~0.2 to ~2.0 wt %, or ~0.3 to ~1.0 wt %.

In some embodiments, a binder composed of two or more metal oxides can be used. In such embodiments, the weight percentage of the low surface area binder can preferably be greater than the weight percentage of the higher surface area binder.

Optionally, if both metal oxides used for forming a mixed metal oxide binder have a sufficiently low surface area, the proportions of each metal oxide in the binder are less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion. In yet another aspect, the dewaxing catalyst can be self-bound and does not contain a binder. Process conditions in a catalytic dewaxing zone can include a temperature of ~200 to ~450° C., preferably ~270 to ~400° C., a hydrogen partial pressure of ~1.8 MPa to ~34.6 MPa (~250 psi to 5000 psi), preferably ~4.8 MPa to ~20.8 MPa, a liquid hourly space velocity of ~0.2 to ~10 $hr^{-1}$, preferably ~0.5 to ~3.0 $hr^{-1}$, and a hydrogen treat gas rate of about 35 $Nm^3/m^3$ to about 1700 $Nm^3/m^3$ (~200 to ~10000 SCF/bbl), preferably about 170 $Nm^3/m^3$ to about 850 $Nm^3/m^3$ (~1000 to ~5000 SCF/bbl).

FCC of Catalytic Slurry Feed and/or Low Temperature High Conversion FCC

In various aspects, at least a portion of the hydrotreated effluent from the hydrotreating of the catalytic slurry oil can be used as a feed for further processing in a Fluid Catalytic Cracking ("FCC") unit. The at least a portion of the hydrotreated effluent can be processed alone in the FCC process, or the hydrotreated effluent can be combined with another suitable feed for processing in an FCC process. Such other suitable feedstreams can include feeds boiling in the range of about 430° F. to about 1050° F. (~221° C. to ~566° C.), such as gas oils, heavy hydrocarbon oils comprising materials boiling above 1050° F. (~566° C.); heavy and reduced petroleum crude oil; petroleum atmospheric distillation bottoms; petroleum vacuum distillation bottoms; pitch, asphalt, bitumen, other heavy hydrocarbon residues; tar sand oils; shale oil; liquid products derived from coal liquefaction processes; and mixtures thereof. The FCC feed may comprise recycled hydrocarbons, such as light or heavy cycle oils.

In some aspects, an input feed for low temperature/high conversion FCC processing can be introduced into an FCC reactor.

An example of a suitable reactor for performing an FCC process can be a riser reactor. Within the reactor riser, the FCC feedstream can be contacted with a catalytic cracking catalyst under cracking conditions thereby resulting in spent catalyst particles containing carbon deposited thereon and a lower boiling product stream. The cracking conditions can typically include: temperatures from about 900° F. to about 1060° F. (~482° C. to ~571° C.), or about 950° F. to about 1040° F. (~510° C. to ~560° C.); hydrocarbon partial pressures from about 10 psia to about 50 psia (~70 kPaa to ~350 kPaa), or from about 20 psia to about 40 psia (~140 kPaa to ~280 kPaa); and a catalyst to feed (wt/wt) ratio from about 3 to 8, or about 5 to 6, where the catalyst weight can correspond to total weight of the catalyst composite. Steam may be concurrently introduced with the feed into the reaction zone. The steam may comprise up to about 5 wt % of the feed. In some aspects, the FCC feed residence time in the reaction zone can be less than about 5 seconds, or from about 3 to 5 seconds, or from about 2 to 3 seconds.

In some aspects, the FCC can be operated at low temperature, high conversion conditions. During low temperature operation, the FCC unit can be operated at a temperature from about 850° F. (~454° C.) to about 950° F. (~510° C.), or about 850° F. (~454° C.) to about 920° F. (~493° C.), or about 850° F. (~454° C.) to about 900° F. (~482° C.); hydrocarbon partial pressures from about 10 psia to about 50 psia (~70 kPaa to ~350 kPaa), or from about 20 psia to about 40 psia (~140 kPaa to ~280 kPaa); and a catalyst to feed (wt/wt) ratio from about 3 to 8, or about 5 to 6, where the catalyst weight can correspond to total weight of the catalyst composite. Steam may be concurrently introduced with the feed into the reaction zone. The steam may comprise up to about 5 wt % of the feed. The residence time for the input feed can be from about 2 seconds to about 8 seconds, or about 4 seconds to about 8 seconds, or about 4 seconds to about 6 seconds.

Catalysts suitable for use within the FCC reactor herein can be fluid cracking catalysts comprising either a large-pore molecular sieve or a mixture of at least one large-pore molecular sieve catalyst and at least one medium-pore molecular sieve catalyst. Large-pore molecular sieves suitable for use herein can be any molecular sieve catalyst having an average pore diameter greater than ~0.7 nm typically used to catalytically "crack" hydrocarbon feeds. In various aspects, both the large-pore molecular sieves and the medium-pore molecular sieves used herein be selected from those molecular sieves having a crystalline tetrahedral framework oxide component. For example, the crystalline tetrahedral framework oxide component can be selected from the group consisting of zeolites, tectosilicates, tetrahedral aluminophosphates (ALPOs) and tetrahedral silicoaluminophosphates (SAPOs). Preferably, the crystalline framework oxide component of both the large-pore and medium-pore catalyst can be a zeolite. More generally, a molecular sieve can correspond to a crystalline structure having a framework type recognized by the International Zeolite Association. It should be noted that when the cracking catalyst comprises a mixture of at least one large-pore molecular sieve catalyst and at least one medium-pore molecular sieve, the large-pore component can typically be used to catalyze the breakdown of primary products from the catalytic cracking reaction into clean products such as naphtha and distillates for fuels and olefins for chemical feedstocks.

Large pore molecular sieves typically used in commercial FCC process units can be suitable for use herein. FCC units used commercially generally employ conventional cracking catalysts which include large-pore zeolites such as USY or REY. Additional large pore molecular sieves that can be employed in accordance with the present invention include both natural and synthetic large pore zeolites. Non-limiting examples of natural large-pore zeolites include gmelinite, chabazite, dachiardite, clinoptilolite, faujasite, heulandite, analcite, levynite, erionite, sodalite, cancrinite, nepheline, lazurite, scolecite, natrolite, offretite, mesolite, mordenite, brewsterite, and ferrierite. Non-limiting examples of synthetic large pore zeolites are zeolites X, Y, A, L. ZK-4, ZK-5, B, E, F, H, J, M, Q, T, W, Z, alpha and beta, omega, REY and USY zeolites. In some aspects, the large pore molecular sieves used herein can be selected from large pore zeolites. In such aspects, suitable large-pore zeolites for use herein can be the faujasites, particularly zeolite Y, USY, and REY.

Medium-pore size molecular sieves suitable for use herein include both medium pore zeolites and silicoaluminophosphates (SAPOs). Medium pore zeolites suitable for use in the practice of the present invention are described in "Atlas of Zeolite Structure Types", eds. W. H. Meier and D. H. Olson, Butterworth-Heineman, Third Edition, 1992, hereby incorporated by reference. The medium-pore size zeolites generally have an average pore diameter less than about 0.7 nm, typically from about 0.5 to about 0.7 nm and includes for example, MFI, MFS, MEL, MTW, EUO, MTT, HEU, FER, and TON structure type zeolites (IUPAC Commission of Zeolite Nomenclature). Non-limiting examples of such medium-pore size zeolites, include ZSM-5, ZSM-12, ZSM-22, ZSM-23, ZSM-34, ZSM-35, ZSM-38, ZSM-48, ZSM-50, silicalite, and silicalite 2. An example of a suitable medium pore zeolite can be ZSM-5, described (for example) in U.S. Pat. Nos. 3,702,886 and 3,770,614. Other suitable zeolites can include ZSM-11, described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. As mentioned above SAPOs, such as SAPO-11, SAPO-34, SAPO-41, and SAPO-42, described (for example) in U.S. Pat. No. 4,440,871 can also be used herein. Non-limiting examples of other medium pore molecular sieves that can be used herein include chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651 and iron aluminosilicates. All of the above patents are incorporated herein by reference.

The medium-pore size zeolites (or other molecular sieves) used herein can include "crystalline admixtures" which are thought to be the result of faults occurring within the crystal or crystalline area during the synthesis of the zeolites. Examples of crystalline admixtures of ZSM-5 and ZSM-11 can be found in U.S. Pat. No. 4,229,424, incorporated herein by reference. The crystalline admixtures are themselves medium-pore size zeolites, in contrast to physical admixtures of zeolites in which distinct crystals of crystallites of different zeolites are physically present in the same catalyst composite or hydrothermal reaction mixtures.

In some aspects, the large-pore zeolite catalysts and/or the medium-pore zeolite catalysts can be present as "self-bound" catalysts, where the catalyst does not include a separate binder. In some aspects, the large-pore and medium-pore catalysts can be present in an inorganic oxide matrix component that binds the catalyst components together so that the catalyst product can be hard enough to survive inter-particle and reactor wall collisions. The inorganic oxide matrix can be made from an inorganic oxide sol or gel which can be dried to "glue" the catalyst components together. Preferably, the inorganic oxide matrix can be comprised of oxides of silicon and aluminum. It can be preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, δ-alumina, ε-alumina, κ-alumina, and ρ-alumina can be employed. Preferably, the alumina species can be an aluminum trihydroxide such as gibbsite, bayerite, nordstrandite, or doyelite. Additionally or alternately, the matrix material may contain phosphorous or aluminum phosphate. Optionally, the large-pore catalysts and medium-pore catalysts be present in the same or different catalyst particles, in the aforesaid inorganic oxide matrix.

While the above catalysts are generally suitable for FCC processing, some types of catalysts can be beneficial for use under low temperature, high conversion conditions. During low temperature, high conversion FCC processing of an input feed, it can be beneficial to use a cracking catalyst that provides reduced/minimized hydrogen transfer. For a cracking catalyst based on a molecular sieve of a given framework type, one or more of the following considerations can be used to identify a cracking catalyst with reduced/minimized tendency for hydrogen transfer. One consideration can be to select a catalyst with a reduced/minimized content of atoms other than Si, Al, and O. For example, reducing/minimizing the content of rare earth atoms (optionally for a large pore framework structure catalyst) and/or the content of phosphorous atoms (optionally for a medium pore framework structure catalyst) can be beneficial for reducing the amount of hydrogen transfer catalyzed by the cracking catalyst in an FCC processing environment. Another consideration can be to select a catalyst with a reduced crystal size. Still another consideration can be to select a catalyst with an increase content of zeolite relative to binder and/or other support type materials. Yet another consideration can be to reduce/minimize the amount of dealumination performed on the catalyst. This can include reducing/minimizing the exposure of the catalyst to steam at elevated temperatures, such as in the catalyst regenerator. Still another consideration can be to increase or maximize catalyst circulation.

With regard to rare earth metal content, in some aspects, a cracking catalyst can have a rare earth metal content of about 1.5 wt % or less, or about 1.0 wt % or less, or about 0.5 wt % or less, such as down to being substantially free of rare earth metal content. In some aspects, a cracking catalyst can have a rare earth metal content of 0.1 wt % or less, such as down to being substantially free of rare earth metal content. A catalyst being substantially free of rare earth metal content can comprise less than about 0.01 wt % of rare earth metals.

The nature of operating an FCC process at low temperature, high conversion conditions can assist with reducing/minimizing hydrogen transfer. For example, the hydrotreating (and/or other hydroprocessing conditions) used to form a suitable input feed can require higher severity hydrotreating than conventionally required for FCC processing. The additional severity can result in an input feed with an increased hydrogen content and/or a reduced amount of aromatics, micro carbon residue, and/or metals content. As a result, the input feed can allow for reduced/minimized formation of coke during a low temperature FCC process. The reduced amount of coke formed during FCC processing can allow a catalyst to maintain cracking activity as the catalyst travels through the FCC reactor, which can assist with reducing the relative amount of hydrogen transfer. Additionally or alternately, reducing the amount of coke formed can assist with reducing the amount of coke on catalyst when the catalyst returns to the FCC reactor from the regenerator, which can further assist in maintaining catalyst activity. Reducing the amount of coke formed during FCC processing can be further facilitated by using a separate fuel source for the regenerator. This can remove the requirement for making sufficient coke during FCC processing to provide the desired regenerator temperature.

In the FCC reactor, the cracked FCC product can be removed from the fluidized catalyst particles. Preferably this can be done with mechanical separation devices, such as an FCC cyclone. The FCC product can be removed from the reactor via an overhead line, cooled and sent to a fractionator tower for separation into various cracked hydrocarbon product streams. These product streams may include, but are not limited to, a light gas stream (generally comprising $C_4$ and lighter hydrocarbon materials), a naphtha (gasoline) stream, a distillate (diesel and/or jet fuel) steam, and other various heavier gas oil product streams. The other heavier stream or streams can include a bottoms stream.

In the FCC reactor, after removing most of the cracked FCC product through mechanical means, the majority of, and preferably substantially all of, the spent catalyst particles can be conducted to a stripping zone within the FCC reactor. The stripping zone can typically contain a dense bed (or "dense phase") of catalyst particles where stripping of volatiles takes place by use of a stripping agent such as steam. There can also be space above the stripping zone with a substantially lower catalyst density which space can be referred to as a "dilute phase". This dilute phase can be thought of as either a dilute phase of the reactor or stripper in that it can typically be at the bottom of the reactor leading to the stripper.

In some aspects, the majority of, and preferably substantially all of, the stripped catalyst particles are subsequently conducted to a regeneration zone wherein the spent catalyst particles are regenerated by burning coke from the spent catalyst particles in the presence of an oxygen containing gas, preferably air thus producing regenerated catalyst particles. This regeneration step restores catalyst activity and simultaneously heats the catalyst to a temperature from about 1200° F. to about 1400° F. (~649° C. to ~760° C.). The majority of, and preferably substantially all of, the hot regenerated catalyst particles can then be recycled to the FCC reaction zone where they contact injected FCC feed.

In some aspects related to low temperature, high conversion FCC processing, the regeneration process can be performed in an alternative manner. In such alternative aspects, a low value fuel stream can be used to provide fuel for the regenerator. This can remove the requirement that sufficient coke can be present on the catalyst during regeneration to achieve the desired regenerator temperature. Suitable alternative fuel sources for the regenerator can include methane, torch oil, and/or various refinery streams that have fuel value. As the reaction temperature in low temperature FCC processing can be lower, the regeneration process can be performed at a lower temperature. A regenerated catalyst temperature of about 550° C. to about 630° C., or about 550° C. to about 600° C., can be sufficient to maintain a FCC riser temperature of about 450° C. to about 482° C.

Product Properties—Hydrotreated Effluent and FCC Products from CSO Processing

The intermediate and/or final products from processing of catalytic slurry oil can be characterized in various manners. One type of product that can be characterized can be the hydrotreated effluent derived from hydrotreatment of a catalytic slurry oil feed (or a feed substantially composed of catalytic slurry oil). Additionally or alternately, the hydrotreated effluent derived from hydrotreatment of a catalytic slurry oil feed (or a feed substantially composed of a catalytic slurry oil) may be fractionated into distillate and residual range portions. The distillate and/or residual range portions can be characterized. A second type of product that can be characterized can be the liquid product from FCC processing of a hydrotreated effluent from hydrotreatment of a catalytic slurry oil.

After hydrotreatment, the liquid ($C_3$+) portion of the hydrotreated effluent can have a volume of at least about 95% of the volume of the catalytic slurry oil feed, or at least about 100% of the volume of the feed, or at least about 105%, or at least about 110%, such as up to about 150% of the volume. In particular, the yield of $C_3$+ liquid products can be about 95 vol % to about 150 vol %, or about 110 vol % to about 150 vol %. Optionally, the $C_3$ and $C_4$ hydrocarbons can be used, for example, to form liquefied propane or butane gas as a potential liquid product. Therefore, the $C_3$+ portion of the effluent can be counted as the "liquid" portion of the effluent product, even though a portion of the compounds in the liquid portion of the hydrotreated effluent may exit the hydrotreatment reactor (or stage) as a gas phase at the exit temperature and pressure conditions for the reactor.

After hydrotreatment, the boiling range of the liquid ($C_3$+) portion of the hydrotreated effluent can be characterized in various manners. In some aspects, the total liquid product can have a T50 distillation point of about 320° C. to about 400° C., or about 340° C. to about 390° C., or about 350° C.

to about 380° C. In some aspects, the total liquid product can have a T90 distillation point of about 450° C. to about 525° C. In some aspects, the total liquid product can have a T10 distillation point of at least about 250° C., which can reflect the low amount of conversion that occurs during hydroprocessing of higher boiling compounds to $C_3$+ compounds with a boiling point below ~200° C. In some aspects, the (weight) percentage of the liquid ($C_3$+) portion that comprises a distillation point greater than about ~566° C. can be about 2 wt % or less, such as about 1.5 wt % or less, about 1.0 wt % or less, about 0.5 wt % or less, about 0.1 wt % or less, or about 0.05 wt % or less (i.e., substantially no compounds with a distillation point greater than about ~1050° F./~566° C.). Additionally or alternately, the (weight) percentage of the liquid portion that comprises a distillation point less than about ~371° C. can be at least about 40 wt %, or at least about 50 wt %, or at least about 60 wt %, such as up to about 90 wt % or more.

The hydrotreated total liquid product and/or a portion of the hydrotreated product can have a favorable energy density. The energy content of the total liquid product and/or a portion of the total liquid product can be at least about 40.0 MJ/kg, such as at least about 40.5 MJ/kg, at least about 41.0 MJ/kg, at least about 41.5 MJ/kg, and/or about 43.0 MJ/kg or less, or about 42.5 MJ/kg or less. In particular, the energy density can be about 40.0 MJ/kg to about 43.0 MJ/kg, or about 41.0 MJ/kg to about 43.0 MJ/kg, or about 40.0 MJ/kg to about 41.5 MJ/kg. This favorable energy density can allow the total liquid product and/or a portion of the total liquid product to be added to various types of fuel products while maintaining the energy density of the fuel product.

In some aspects, the density (at ~15° C.) of the liquid ($C_3$+) portion of the hydrotreated effluent can be about 1.05 g/cc or less, such as about 1.02 g/cc or less, about 1.00 g/cc or less, about 0.98 g/cc or less, about 0.96 g/cc or less, about 0.94 g/cc or less, about 0.92 g/cc or less, such as down to about 0.84 g/cc or lower. In particular, the density can be about 0.84 g/cc to about 1.02 g/cc, or about 0.92 g/cc to about 1.02 g/cc, or about 0.84 g/cc to about 1.00 g/cc.

The sulfur content of the liquid ($C_3$+) portion of the hydrotreated effluent can be about 1000 wppm or less, or about 700 wppm or less, or about 500 wppm or less, or about 300 wppm or less, or about 100 wppm or less, such as at least about 1 wppm. In particular, the sulfur content can be about 1 wppm to about 1000 wppm, or about 1 wppm to about 500 wppm, or about 1 wppm to about 300 wppm.

The micro carbon residue of the liquid ($C_3$+) portion of the hydrotreated effluent can be about 4.0 wt % or less, or about 3.0 wt % or less, or about 2.5 wt % or less, or about 2.0 wt % or less, or about 1.0 wt % or less, or about 0.5 wt % or less, such as substantially complete removal of micro carbon residue. In particular, the micro carbon residue can be about 0 wt % to about 3.0 wt %, or about 0 wt % to about 2.0 wt %, or about 0 wt % to about 1.0 wt %.

The amount of n-heptane insolubles (NHI) in the liquid ($C_3$+) portion of the hydrotreated effluent, as determined by ASTM D3279, can be about 2.0 wt % or less, or about 1.5 wt % or less, or about 1.0 wt % or less, or about 0.5 wt % or less, or about 0.1 wt % or less, such as substantially complete removal of NHI.

The hydrogen content of the liquid ($C_3$+) portion of the hydrotreated effluent can be at least about 9.5 wt %, or at least about 10.0 wt %, or at least about 10.5 wt %, or at least about 11.0 wt %, or at least about 11.5 wt %. In particular, the hydrogen content can be about 9.5 wt % to about 12.0 wt %, or about 10.5 wt % to about 12.0 wt %, or about 11.0 wt % to about 12.0 wt %.

The IN of the liquid ($C_3$+) portion of the hydrotreated effluent can be about 40 or less, or about 30 or less, or about 20 or less, or about 10 or less, or about 5 or less, such as down to about 0.

In some aspects, the portion of the hydrotreated effluent having a boiling range/distillation point of less than about 700° F. (~371° C.) can be used as a low sulfur fuel oil or blendstock for low sulfur fuel oil and/or can be further hydroprocessed (optionally with other distillate streams) to form ultra low sulfur naphtha and/or distillate (such as diesel) fuel products, such as ultra low sulfur fuels or blendstocks for ultra low sulfur fuels. The portion having a boiling range/distillation point of at least about 700° F. (~371° C.) can be used as an ultra low sulfur fuel oil having a sulfur content of about 0.1 wt % or less or optionally blended with other distillate or fuel oil streams to form an ultra low sulfur fuel oil or a low sulfur fuel oil. In some aspects, at least a portion of the liquid hydrotreated effluent having a distillation point of at least about ~371° C. can be used as a feed for FCC processing.

In some aspects, portions of the hydrotreated effluent can be used as fuel products and/or fuel blendstocks. One option can be to use the total liquid product from hydrotreatment as a blendstock for low sulfur fuel oil or ultra low sulfur fuel oil. The sulfur content of the hydrotreated product can be sufficiently low to allow for use as a blendstock to reduce the overall sulfur content of a fuel oil composition. Additionally, the hydrotreated product can have a sufficient content of aromatic compounds to be compatible for blending with a fuel oil. Further, the energy content of the hydrotreated effluent can be comparable to the energy content of a fuel oil.

Another option can be to use a bottoms portion of the total liquid product from hydrotreatment as a fuel oil blendstock. The bottoms portion can correspond to a portion defined based on a convenient distillation point, such as a cut point of about 550° F. (~288° C.) to about 750° F. (~399° C.), or about 600° F. (~343° C.) to about 750° F. (~399° C.), or about 600° F. (~343° C.) to about 700° F. (~371° C.). The remaining portion of the total liquid product can be suitable as a blendstock, optionally after further hydrotreatment, for diesel fuel, fuel oil, heating oil, and/or marine gas oil.

The total liquid product, the bottoms portion of the total liquid product, and/or the lower boiling portion of the total liquid product after removing the bottoms can have an unexpectedly high content of aromatics, naphthenics, or aromatics and naphthenics. The total liquid product (or a fraction thereof) can have a relatively high hydrogen content in comparison with low sulfur fuel oil or ultra low sulfur fuel oil. The relatively high hydrogen content can be beneficial for having at least a comparable energy density in comparison with a fuel oil. The total liquid product (or fraction thereof) can have a relatively low content of paraffins, which can correspond to a product (or fraction) that can have good compatibility with various fuel oils and/or good low temperature operability properties, such as pour point and/or cloud point. The total liquid product (or a fraction thereof) can have a pour point of less than ~30° C., or less than ~15° C., or less than ~0° C., such as down to about −24° C. or lower.

The liquid ($C_3$+) portion of the hydrotreated effluent and/or a bottoms portion of the hydrotreated effluent can have an aromatics content of about 50 wt % to about 80 wt %, or about 60 wt % to about 75 wt %, or about 55 wt % to about 70 wt %; and a saturates content of about 25 wt % to about 45 wt %, or about 28 wt % to about 42 wt %. Additionally or alternately, the bottoms portion can have a pour point of about 30° C. to about −30° C., or about 30° C.

to about −20° C., or about 0° C. to about −20° C. Additionally or alternately, the bottoms portion can have a kinematic viscosity at 50° C. of about 150 $mm^2/s$ to about 1000 $mm^2/s$, or about 160 $mm^2/s$ to about 950 $mm^2/s$. In some aspects, the total liquid product (or a fraction thereof, such as the bottoms fraction) can provide a beneficial combination of a low pour point with a low sulfur content. In particular, the pour point can be 15° C. or less with a sulfur content of 1000 wppm or less, or the pour point can be 10° C. or less with a sulfur content of 500 wppm or less, or the pour point can be 15° C. or less with a sulfur content of 300 wppm or less.

Potentially due in part to the aromatics content of the bottoms, the bottoms portion of the hydrotreated effluent can have a bureau of mines correlation index (BMCI) value of at least about 70, or at least about 80, or at least about 85, such as up to about 100 or more. Additionally or alternately, the bottoms portion of the hydrotreated effluent can have a calculated carbon aromaticity index (CCAI) of about 900 or less, or about 870 or less, such as down to about 800 or still lower.

With regard to a lower boiling portion ($C_5$+) formed after separating the bottoms from the total liquid product, the lower boiling portion ($C_5$+) can have a naphthenes content of about 50 wt % to about 75 wt %, or about 52 wt % to about 70 wt %; an aromatics content of about 30 wt % to about 50 wt %, or about 30 wt % to about 45 wt %; and/or a paraffin content of about 5 wt % or less, or about 3 wt % or less. Additionally or alternately, the lower boiling portion ($C_5$+) can have a cetane index (D4737) of about 25 to about 35, or about 25 to about 30. Additionally or alternately, the lower boiling portion ($C_5$+) can have a cloud point of about −25° C. to about −70° C., or about −30° C. to about −70° C., or about −35° C. to about −60° C. Additionally or alternately, the lower boiling portion ($C_5$+) can have a kinematic viscosity at 40° C. of about 3 $mm^2/s$ to about 20 $mm^2/s$, or about 4 $mm^2/s$ to about 16 $mm^2/s$.

After FCC processing of at least a portion of the hydrotreated effluent, the liquid ($C_3$+) portion of the FCC products can have a volume of at least about 95% of the volume of the catalytic slurry oil feed, or at least about 100% of the volume of the feed, or at least about 105%, or at least about 110%, or at least about 115%, or at least about 120%, or at least about 125%, such as up to about 150% of the volume. In particular, the yield of $C_3$+ liquid products can be about 100 vol % to about 150 vol %, or about 110 vol % to about 150 vol %, Additionally or alternately, the liquid ($C_3$+) portion of the FCC products can have a volume of at least about 95% of the volume of the portion of the hydrotreated effluent used as the feed for FCC processing, or at least about 100% of the volume of the feed, or at least about 105%, or at least about 110%, such as up to about 150% of the volume. In particular, the yield of $C_3$+ liquid products can be about 95 vol % to about 150 vol %, or about 110 vol % to about 150 vol %.

The density of the liquid portion of the FCC products can be about 0.92 g/cc or less, or about 0.90 g/cc or less, or about 0.88 g/cc or less, or about 0.86 g/cc or less.

The sulfur content of the liquid portion of the FCC products can be about 10000 wppm or less, or about 5000 wppm or less, or about 1000 wppm or less, or about 500 wppm or less, or about 300 wppm or less, or about 100 wppm or less, and/or at least about 1 wppm.

Additionally or alternately, the (weight) percentage of the liquid portion of the FCC products comprising a distillation point greater than about 1050° F. (~566° C.) can be about 2.0 wt % or less, or about 1.5 wt % or less, or about 1.0 wt % or less, or about 0.5 wt % or less, or about 0.1 wt % or less, or about 0.05 wt % or less (i.e., substantially no compounds with a distillation point greater than about 1050° F.). Additionally or alternately, the (weight) percentage of the liquid portion of the FCC products comprising a distillation point less than about 700° F. (~371° C.) can be at least about 50 wt %, or at least about 60 wt %, or at least about 65 wt %, or at least about 70 wt %, or at least about 75 wt %.

After FCC processing of the hydrotreated effluent, the dry gas portion ($C_2$−) of the FCC products can be about 2.0 wt % or less of the total FCC products, or about 1.5 wt % or less, or about 1.0 wt % or less.

After FCC processing of the hydrotreated effluent, the naphtha boiling range portion of the FCC processing effluent can correspond to at least about 45 wt % of the hydrotreated effluent, or at least about 50 wt %. Additionally or alternately, a $C_6$ to ~430° F. (~221° C.) portion of the FCC processing effluent can include at least about 60 wt % aromatics, at least about 80 wt % of combined aromatics and naphthenes, or a combination thereof. Additionally or alternately, the $C_6$ to ~221° C. portion of the FCC processing effluent can have an isoparaffin to n-paraffin weight ratio of at least about 6. In various aspects, portions or fractions of the products from FCC processing of the hydrotreated effluent can be used for forming fuels or fuel blendstocks. For example, a naphtha boiling range portion of the FCC processing effluent can be used to form gasoline and/or gasoline blendstock. A distillate boiling range portion of the FCC processing effluent can be used to form distillate fuel and/or distillate fuel blendstock.

For properties such as micro carbon residue, NHI, and hydrogen content, the values for the liquid ($C_3$+) portion of the FCC products can be similar to those described for the hydrotreated effluent.

Product Properties from Low Temperature/High Conversion FCC Processing

Operating an FCC process at low temperature/high conversion conditions can provide a product slate having one or more unexpected properties. For input feeds to an FCC process having a hydrogen content of at least about 13.0 wt %, or at least about 14.0 wt %, or at least about 14.3 wt %, some unexpected properties can be related to the olefin content of the products. In such aspects, the products can include a $C_3$ to ~430° F. (~221° C.) portion having an olefin content of about 55 wt % to about 80 wt %, or about 55 wt % to about 70 wt %, or about 60 wt % to about 75 wt %. Optionally, the yield of $C_3$ to $C_7$ olefins can correspond to at least about 50 wt % of the total liquid product, or at least about 55 wt %. In some aspects, a weight ratio of olefins to paraffins for $C_4$-$C_6$ compounds, either combined or individually, can be at least about 1.0, or at least about 1.5, or at least about 2.0, or at least about 3.0, or at least about 5.0, or at least about 7.0. In particular, the weight ratio can be from about 1.0 to about 10.0, or about 1.5 to about 10.0, or about 2.0 to about 10.0. In some aspects, a weight ratio of olefins to paraffins for $C_3$-$C_5$ compounds, either combined or individually, can be at least about 1.0, or at least about 1.5, or at least about 2.0, or at least about 3.0, or at least about 5.0, or at least about 7.0. In particular, the weight ratio can be from about 1.0 to about 10.0, or about 2.0 to about 10.0, or about 3.0 to about 10.0. In some aspects, a weight ratio of olefins to paraffins for combined $C_4$-$C_5$ compounds can be at least about 1.0, or at least about 1.5, or at least about 2.0, or at least about 3.0, or at least about 5.0, or at least about 7.0. In particular, the weight ratio can be from about 1.0 to about 10.0, or about 2.0 to about 10.0, or about 3.0 to about 10.0.

In some aspects, a weight ratio of olefins to paraffins for $C_3$ compounds can be at least about 5.0, or at least about 9.0, or at least about 12.0.

In some aspects, the $C_3$ to ~430° F. (~221° C.) portion can include about 30 wt % or less of aromatics, or about 20 wt % or less, or about 10 wt % or less, such as down to substantially no aromatic content. Additionally or alternately, the $C_3$ to ~221° C. portion can include at least about 5 wt % of combined aromatics and naphthenes, or at least about 10 wt %.

In some aspects, a $C_6$ to ~430° F. (~221° C.) portion of the hydrotreated effluent can have a ratio of cyclic compounds (including cycloolefins) to aliphatic compounds of at least about 1.0, or at least about 1.5.

In some aspects, a diesel boiling range fraction from low temperature, high conversion FCC processing of an input feed can be suitable for incorporation into a diesel fuel pool without further hydroprocessing. Such a diesel boiling range fraction can have a cetane of at least about 25 (or at least about 35), an olefin content of about 10 wt % or less, a sulfur content of about 15 wppm or less, and suitable cloud point and/or pour point values for incorporation into a diesel fuel pool, either as a diesel fuel product or as a blendstock. Additionally or alternately, the diesel boiling range fraction can be further hydroprocessed, optionally with other distillate boiling range streams, before incorporation into a diesel fuel pool.

In some aspects, a naphtha boiling range fraction (such as a $C_6$ to ~430° F./~221° C. portion) from low temperature, high conversion FCC processing of an input feed can correspond to a high density naphthenic gasoline. In some aspects, a $C_3$ and/or $C_4$ fraction can be used to form a liquefied petroleum gas product.

FCC—Creation of Catalytic Slurry Oil

A catalytic slurry oil used as a feed for the various processes described herein can correspond to a product from FCC processing. In particular, a catalytic slurry oil can correspond to a bottoms fraction and/or other fraction having a boiling range greater than a typical light cycle oil from an FCC process.

The properties of catalytic slurry oils suitable for use in some aspects are described above. In order to generate such suitable catalytic slurry oils, the FCC process used for generation of the catalytic slurry oil can be characterized based on the feed delivered to the FCC process. For example, performing an FCC process on a light feed, such as a feed that does not contain NHI or MCR components, can tend to result in an FCC bottoms product with an IN of less than about 50. Such an FCC bottoms product can be blended with other feeds for hydroprocessing via conventional techniques. By contrast, the processes described herein can provide advantages for processing of FCC fractions (such as bottoms fractions) that have an IN of greater than about 50, such as about 60 to 140, or about 70 to about 130.

In some aspects, a FCC bottoms fraction having an IN of greater than about 50 and/or an NHI of at least about 1 wt % and/or a MCR of at least about 4 wt % can be formed by performing FCC processing on a feed to generate a FCC bottoms fraction yield of at least about 5 wt %, or at least about 7 wt %, or at least about 9 wt %. The FCC bottoms fraction yield can be defined as the yield of ~650° F.+ (~343° C.+) product from the FCC process. Additionally or alternately, the FCC bottoms fraction can have any one or more of the other catalytic slurry oil feed properties described elsewhere herein.

Examples of Reaction System Configurations

FIG. 1 schematically shows an example of a reaction system for processing a catalytic slurry oil. In FIG. 1, an initial feed 105 comprising and/or substantially composed of a catalytic slurry oil can be introduced into a fixed bed hydrotreatment reactor (or reactors) 110. The hydrotreatment reactor(s) 110 can generate a $C_3$+ or $C_5$+ effluent 115 and a gas phase effluent 113 of light ends and contaminants such as $H_2S$ and $NH_3$. The $C_3$+ effluent 115 can optionally be separated (not shown) to form at least a diesel boiling range fraction and a (ultra) low sulfur fuel oil fraction. Alternatively, at least a portion of effluent 115 can be used as a feed for a fluid catalytic cracking process 120. A portion of the feed to fluid catalytic cracking process 120 can be removed as coke 127 on the cracking catalyst. The product effluent 125 from fluid catalytic cracking process 120 can be optionally fractionated 130 to form a variety of products. For example, the products can include a light ends ($C_2$−) fraction 131, a $C_3$ and/or $C_4$ product fraction 132, a naphtha boiling range fraction 134, a diesel boiling range fraction 136 corresponding to a light cycle oil, and a bottoms fraction 138. Optionally, the naphtha boiling range fraction 134 can be hydroprocessed (not shown) to further reduce the sulfur content prior to use as a gasoline. Similarly, the diesel boiling range fraction 136 can be hydrotreated 140 or otherwise hydroprocessed to form a low sulfur diesel fuel 146.

Figure 5:
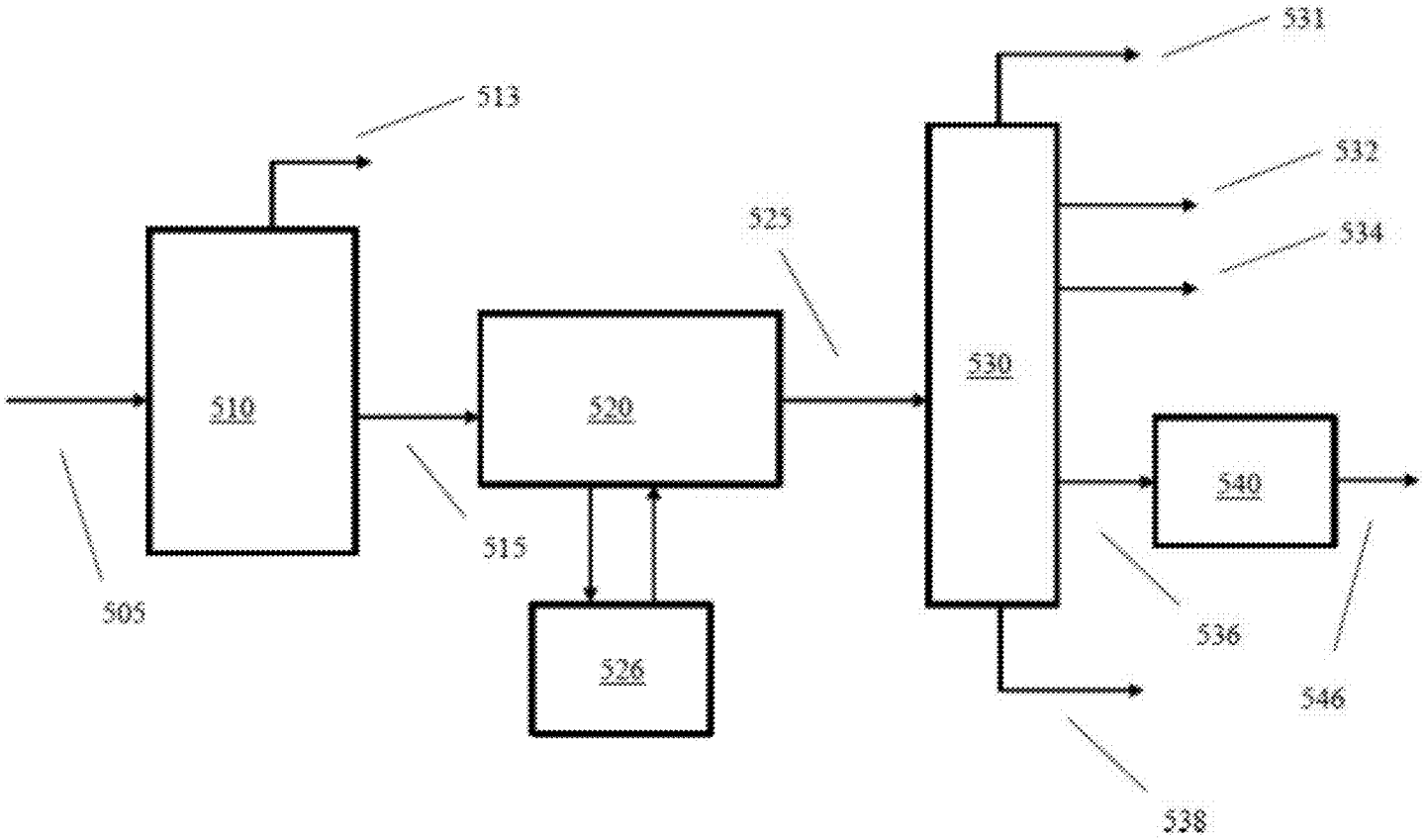
FIG. 5 shows an example of a reaction system including an FCC reactor for processing a feed under low temperature and high conversion conditions in the FCC reactor.

FIG. 5 schematically shows an example of a reaction system for processing a feed including a vacuum gas oil boiling range portion. In FIG. 5, a feed 505 including a vacuum gas oil boiling range portion can be introduced into a (fixed bed) hydroprocessing reactor (or reactors) 510. The hydroprocessing reactor(s) 510 can include at least one reactor containing a hydrotreating catalyst for hydrotreatment of the feed. Optionally, the hydroprocessing reactor(s) 510 can include at least one reactor that contains a dewaxing catalyst and/or an aromatic saturation catalyst for additional hydroprocessing. Hydroprocessing reactors can generate, after separation, at least a liquid effluent 515 and a gas phase effluent 513 of light ends and contaminants such as $H_2S$ and $NH_3$. The liquid effluent 515 can optionally be separated (not shown) to form at least a diesel boiling range fraction and a low sulfur fuel oil fraction. Optionally, at least a portion of effluent 515 can be used as a feed for a low temperature, high conversion fluid catalytic cracking process 520. Because FCC processing under low temperature, high conversion conditions can lead to a reduced/minimized amount of coke formation on the catalyst, the amount of coke on the catalyst can be insufficient for operating the catalyst regenerator 526 at a desired temperature. Instead, the catalyst regenerator can use an external fuel source such as methane for heating the regenerator to a desired temperature. The product effluent 525 from fluid catalytic cracking process 520 can be optionally fractionated 530 to form a variety of products. For example, the products can include a light ends ($C_2$−) fraction 531, a $C_3$ and/or $C_4$ product fraction 532, a naphtha boiling range fraction 534, a diesel boiling range fraction 536, and a bottoms fraction 538. Optionally, the naphtha boiling range fraction 534 can be hydroprocessed (not shown) to further reduce the sulfur content prior to use as a gasoline. Similarly, the diesel boiling range fraction 536 can be optionally hydrotreated 540 or otherwise hydroprocessed to form a (ultra) low sulfur diesel fuel and/or fuel blendstock 546 and/or other distillate fuel or fuel blendstock. Additionally or alternately, diesel boiling range fraction 536 and/or naphtha boiling range fraction 534 can have sufficiently low sulfur and nitrogen contents to be suitable for incorporation (as a fuel and/or fuel blendstock)

into the diesel fuel pool or naphtha fuel pool without further processing, despite potentially containing about 1.0 wt % to about 10 wt % olefins. In such aspects, the diesel boiling range fraction 536 can optionally have a sufficiently high cetane index to allow for incorporation into the diesel fuel pool without further processing, such as a cetane index of at least about 25, or at least about 35. Optionally, $C_4$ product fraction 532 can correspond to $C_4$ olefins and/or $C_4$+ olefins for use in an alkylation process to form alkylate gasoline.

Figure 23:
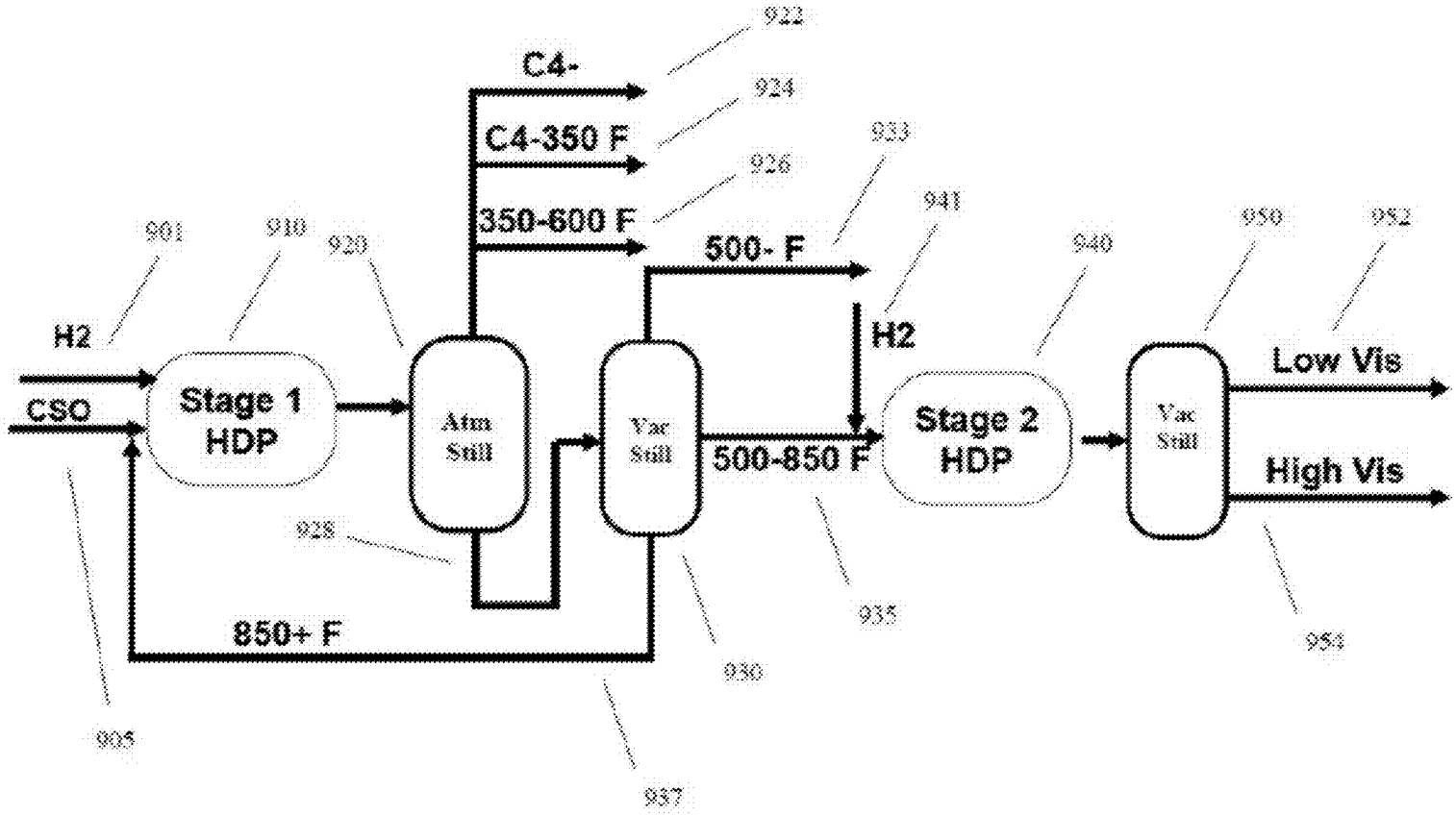
FIG. 23 shows an example of a reaction system for forming naphthenic fluids from a catalytic slurry oil feed.

FIG. 23 schematically shows a reaction system for producing naphthenic fluids from a catalytic slurry oil. A catalytic slurry oil 905 can be introduced into a hydroprocessing reactor 910 along with hydrogen under hydrotreatment conditions to substantially remove sulfur and nitrogen from the feed. Optionally, additional hydroprocessing can be performed, such as hydrocracking, dewaxing, or aromatic saturation. The feed can optionally include a recycled portion 937 of the hydroprocessed effluent, such as a vacuum bottoms fraction. The hydrotreated effluent can then be passed into a separation stage, such as an atmospheric distillation tower 920 followed by a vacuum distillation tower 930. The atmospheric distillation tower 920 can generate a variety of fractions, such as light ends 922, naphtha boiling range fraction 924, kerosene/diesel boiling range fraction 926, and an atmospheric bottoms fraction 928. The atmospheric bottoms 928 can then be passed into vacuum distillation tower 930 for further separation. Any remaining low boiling material can be removed 933. The vacuum bottoms 937 can optionally be recycled back as part of the feed to hydrotreatment reactor 910. The remaining portion of the vacuum gas oil fraction can then be passed into a second stage hydroprocessing reactor 940 (along with hydrogen 941) for additional hydroprocessing. This can correspond to additional hydrocracking, catalytic dewaxing, and or aromatic saturation. The effluent from second hydroprocessing stage 940 can correspond to a substantially completely saturated effluent having an aromatics content of about 5 wt % or less, or 3 wt % or less. The effluent from second hydroprocessing stage 940 can then be separated in another vacuum distillation tower 950 to form desired viscosity grades of naphthenic oils, such as a low viscosity grade 952 and a high viscosity grade 954.

Naphthenic oils produced from a catalytic slurry oil feed can potentially have various unexpected properties. In some aspects, naphthenic oils produced from a catalytic slurry oil feed can have unexpectedly low contents of paraffins. For example, the paraffin content of a naphthenic oil produced from a catalytic slurry oil feed can be about 2.0 wt % or less, or about 1.0 wt % or less, or about 0.5 wt % or less, such as substantially no paraffin content. In some aspects, naphthenic oils produced from a catalytic slurry oil feed can have unexpectedly high viscosities relative to the boiling point distribution for the naphthenic oil. For example, a naphthenic oil having a T10 boiling point of at least about 330° C., a T50 boiling point of about 380° C. or less, and a T90 boiling point of about 425° C. or less can have a viscosity at ~40° C. of at least about 100 cSt, or at least about 120 cSt. Additionally or alternately, the T90 boiling point can be at least about 370° C. Additionally or alternately, the T50 boiling point can be at least about 340° C. In some aspects, naphthenic oils produced from a catalytic slurry oil feed can have an unexpectedly low pour point relative to the viscosity of the naphthenic oil. Additionally or alternately, the naphthenic oils can provide unexpectedly beneficial solvency for a variety of hydrocarbon-like and/or petroleum fractions. In some aspects, naphthenic oils produced from a catalytic slurry oil feed can have an unexpectedly low viscosity index values. For example, a naphthenic oil having a viscosity at ~40° C. of at least about 100 cSt, or at least about 120 cSt can have a corresponding viscosity at ~100° C. of about 7.0 cSt to about 8.0 cSt. In some aspects, naphthenic oils produced from a catalytic slurry oil feed can be resistant to electrical degradation. Without being bound by any particular theory, this can be due in part to a high ring content within the naphthenic oil. In some aspects, the naphthenic oil can have a reduced/minimized amount of toxicity. For example, the toxicity can be reduced/minimized if the naphthenic oil can be sufficiently hydroprocessed to achieve a saturates amount corresponding to at least about 90 wt % of the naphthenic oil, or at least about 94 wt %, or at least about 95 wt %.

ADDITIONAL EMBODIMENTS

Embodiment 1

A hydrocarbonaceous composition comprising a density at ~15° C. of about 0.92 g/cc to about 1.02 g/cc, a T50 distillation point of about 340° C. to about 390° C., and a T90 distillation point of about 450° C. to about 525° C., the hydrocarbonaceous composition comprising about 1.0 wt % or less of n-heptane insolubles, about 50 wt % to about 70 wt % aromatics, a sulfur content of about 1000 wppm or less, and a hydrogen content of about 10.0 wt % to 12.0 wt %, a ~700° F.–(~371° C.–) portion of the hydrocarbonaceous composition comprising less than about 5.0 wt % paraffins, the hydrocarbonaceous composition optionally comprising or consisting of an FCC product fraction (e.g., a $C_3$+ FCC product fraction).

Embodiment 2

A hydrocarbonaceous composition comprising a density at ~15° C. of at least about 0.96 g/cc, a T10 distillation point of at least about 340° C., and a T90 distillation point of about 450° C. to about 525° C., the hydrocarbonaceous composition comprising about 1.0 wt % or less of n-heptane insolubles, about 55 wt % to about 80 wt % aromatics, a sulfur content of about 1000 wppm or less, and a hydrogen content of about 9.5 wt % to 12.0 wt %, the hydrocarbonaceous composition having a BMCI value of at least about 70 and a CCAI value of about 870 or less, the hydrocarbonaceous composition optionally comprising or consisting of an FCC product fraction (e.g., a FCC bottoms product fraction).

Embodiment 3

The hydrocarbonaceous composition of Embodiment 2, wherein the hydrocarbonaceous composition comprises a T10 distillation point of at least about 370° C.; wherein the hydrocarbonaceous composition comprises a kinematic viscosity at ~50° C. of about 1000 $mm^2/s$ or less; or a combination thereof.

Embodiment 4

The hydrocarbonaceous composition of any of the above embodiments, wherein the hydrocarbonaceous composition comprises about 0.5 wt % or less of n-heptane insolubles, e.g., about 0.1 wt % or less.

Embodiment 5

The hydrocarbonaceous composition of any of the above embodiments, wherein the hydrocarbonaceous composition comprises an energy content of at least about 40.0 MJ/kg, or at least about 40.5 MJ/kg, or at least about 41.0 MJ/kg; wherein a ~371° C.+ portion of the hydrocarbonaceous composition exhibits an energy content of at least about 40.0 MJ/kg, or at least about 40.5 MJ/kg; or a combination thereof.

Embodiment 6

The hydrocarbonaceous composition of any of the above embodiments, wherein a ~371° C.+ portion of the hydrocarbonaceous composition comprises at least about 55 wt % aromatics (or at least about 60 wt %); wherein a ~371° C.+ portion of the hydrocarbonaceous composition exhibits a BMCI value of at least about 70 (or at least about 80 or at least about 85); or a combination thereof.

Embodiment 7

The hydrocarbonaceous composition of any of the above embodiments, wherein the hydrocarbonaceous composition and/or a ~371° C.+ portion of the hydrocarbonaceous composition exhibits a pour point of about 30° C. or less (or about 5° C. or less or about −10° C. or less).

Embodiment 8

The hydrocarbonaceous composition of any of Embodiments 1 or 4-7, wherein the hydrocarbonaceous composition comprises a liquid portion of a hydrotreated effluent; wherein the hydrocarbonaceous composition comprises a T10 distillation point of at least about 250° C.; or a combination thereof.

Embodiment 9

A hydrocarbonaceous composition comprising a density at ~15° C. of about 0.84 g/cc to about 0.96 g/cc, a T10 distillation point of at least about 200° C., and a T90 distillation point of about 371° C. or less, the hydrocarbonaceous composition comprising about 5.0 wt % or less of paraffins, at least about 50 wt % naphthenes, at least about 30 wt % aromatics, a sulfur content of about 50 wppm or less, and a hydrogen content of at least about 11.0 wt %, the hydrocarbonaceous composition comprising a cetane index (D4737) of at least about 25 and an energy content of at least about 41.0 MJ/kg, the hydrocarbonaceous composition optionally comprising or consisting of an FCC product fraction (e.g., a FCC fuels fraction).

Embodiment 10

The hydrocarbonaceous composition of Embodiment 9, wherein the hydrocarbonaceous composition comprises about 3.0 wt % or less of paraffins (or about 2.0 wt % or less); wherein the hydrocarbonaceous composition comprises at least about 50 wt % naphthenes (or at least about 55 wt % or at least about 60 wt %); or a combination thereof.

Embodiment 11

The hydrocarbonaceous composition of Embodiment 9 or 10, wherein the hydrocarbonaceous composition comprises a cetane index (D4737) of at least about 25 (or at least about 27); wherein the hydrocarbonaceous composition comprises an energy content of at least about 41.0 MJ/kg (or at least about 41.5 MJ/kg); wherein the hydrocarbonaceous composition comprises a cloud point of about −25° C. to about −70° C. (or about −30° C. to about −70° C.); or a combination thereof.

Embodiment 12

A hydrocarbonaceous composition comprising a $C_3$ to ~430° F. (~221° C.) portion, the $C_3$ to ~430° F. (~221° C.) portion comprising an aromatics content of less than about 30 wt % and a weight ratio of olefins to saturates of at least about 1.0, the $C_3$ to ~430° F. (~221° C.) portion comprising at least 20 wt % of combined $C_4$ and $C_5$ compounds, the hydrocarbonaceous composition optionally comprising or consisting of an FCC product fraction (e.g., a converted FCC product fraction).

Embodiment 13

The hydrocarbonaceous composition of Embodiment 12, wherein the hydrocarbonaceous composition comprises a weight ratio of combined $C_4$ and $C_5$ olefins to combined $C_4$ and $C_5$ paraffins of at least about 2.5 (or at least about 3.0 or at least about 5.0 or at least about 10.0).

Embodiment 14

The hydrocarbonaceous composition of Embodiment 12 or 13, wherein the $C_3$ to ~430° F. (~221° C.) portion further comprises at least about 5 wt % of combined napthenes and aromatics (or at least about 10 wt %); wherein the $C_3$ to ~430° F. (~221° C.) portion comprises about 20 wt % or less of aromatics (or about 10 wt % or less, or substantially no aromatics); or a combination thereof.

Embodiment 15

The hydrocarbonaceous composition of any of Embodiments 12 to 14, wherein the hydrocarbonaceous composition comprises a weight ratio of $C_6$ olefins to $C_6$ paraffins of at least about 2.0 (or at least about 4.0); a weight ratio of $C_3$ olefins to $C_3$ paraffins is at least about 5.0 (or at least about 9.0 or at least about 12.0); or a combination thereof.

Embodiment 16

The hydrocarbonaceous composition of any of Embodiments 12 to 15, wherein the $C_3$ to ~430° F. (~221° C.) portion comprises at least 50 wt % of $C_3$-$C_7$ olefins (or at least about 55 wt % or at least about 60 wt %).

Embodiment 17

A hydrocarbonaceous composition comprising a $C_3$ to ~430° F. (~221° C.) portion, the $C_3$ to ~430° F. (~221° C.) portion comprising a ratio of combined $C_4$ and $C_5$ olefins to combined $C_4$ and $C_5$ paraffins of at least about 0.9 (or at least about 1.0, or at least about 5.0), a $C_6$ to ~430° F. (~221° C.) portion having a weight ratio of cyclic compounds to aliphatic compounds of at least about 1.0, the hydrocarbonaceous composition optionally comprising or consisting of an FCC product fraction (e.g., a converted FCC product fraction).

Embodiment 18

The hydrocarbonaceous composition of Embodiment 17, wherein the hydrocarbonaceous composition comprises a weight ratio of $C_3$ olefins to $C_3$ paraffins of at least about 5.0, or at least about 9.0.

Embodiment 19

A catalytic naphtha composition comprising a $C_6$ to ~430° F. (~221° C.) portion, the $C_6$ to ~430° F. (~221° C.) portion comprising at least about 60 wt % aromatics and at least about 80 wt % of combined aromatics and naphthenes, the $C_6$ to ~430° F. (~221° C.) portion comprising an isoparaffin to n-paraffin weight ratio of at least about 6.

A method of making a fuel oil composition, comprising blending at least a portion of the hydrocarbonaceous composition of any of Embodiments 1 to 8 with one or more fuel oil blendstocks to form a fuel oil composition having a sulfur content of about 5000 wppm or less (or about 1000 wppm or less), the fuel oil composition comprising about 5 wt % to about 95 wt % of the at least a portion of the hydrocarbonaceous composition, the method optionally further comprising fractionating the hydrocarbonaceous composition of claim 1 to form at least a fraction having a T10 distillation point of at least about 340° C., the at least a portion of the hydrocarbonaceous composition comprising the fraction having the T10 distillation point of at least about 340° C., the fuel oil composition optionally further comprising one or more additives.

A method of making a distillate fuel composition comprising blending at least a portion of the hydrocarbonaceous composition of any of Embodiments 9 to 11 with one or more blendstocks to form a distillate fuel composition, the distillate fuel composition comprising about 5 wt % to about 95 wt % of the at least a portion of the hydrocarbonaceous composition, the method optionally further comprising hydrotreating the at least a portion of the hydrocarbonaceous composition prior to blending with the one or more blendstocks, the distillate fuel composition optionally comprising a diesel fuel, a gas oil, a marine gas oil, a heating oil, or a combination thereof, the distillate fuel composition optionally further comprising one or more additives.

A method of making a gasoline composition, comprising blending at least a portion of the composition comprising a $C_3$ to ~430° F. (~221° C.) portion of any of Embodiments 12 to 19 with one or more blendstocks to form a gasoline composition, the gasoline composition comprising about 5 wt % to about 95 wt % of the at least a portion of the composition comprising a $C_3$ to ~430° F. (~221° C.) portion, the at least a portion of the composition comprising a $C_3$ to ~430° F. (~221° C.) portion optionally comprising a $C_5$ to ~430° F. (~221° C.) portion or a $C_6$ to ~430° F. (~221° C.) portion, the gasoline composition optionally further comprising one or more additives.

EXAMPLES

Example 1—Fixed Bed Hydrotreatment of Catalytic Slurry Oil

A catalytic slurry oil derived from an FCC process was hydrotreated in a fixed bed hydroprocessing unit under two different types of conditions. In a first type of processing condition, referred to herein as Fixed Bed Run A, the hydrotreatment was performed using a fixed bed containing about 50 vol % of a commercially available CoMo hydrotreating catalyst (particle size ~20-80 mesh) stacked on top of ~50 vol % of a commercially available NiMo hydrotreating catalyst (particle size ~20-80 mesh). The feed was exposed to the stacked catalyst bed at about 370° C., about 1500 psig (~10.4 MPag), about 8000 SCF/bbl (~1400 $Nm^3/m^3$) of hydrogen as a treat gas, and a liquid hourly space velocity of ~0.3 $hr^{-1}$. Under these conditions, the feed appeared to consume about 2200 SCF/bbl (~370 $Nm^3/m^3$) of hydrogen during hydrotreatment. The properties of the catalytic slurry oil and the liquid portion of the resulting hydrotreated effluent are shown in Table 1. The feed properties shown in Table 1 correspond to the feed prior to addition of 5 wt % toluene. The 5 wt % toluene was added to reduce the viscosity in order to facilitate testing.

In a second type of condition, referred to herein as Fixed Bed Run B the hydrotreatment was performed using a fixed bed containing about 50 vol % of a commercially available medium pore NiMo hydrotreating catalyst (particle size ~20-80 mesh) stacked on top of ~50 vol % of a commercially available bulk NiMo hydrotreating catalyst (particle size ~20-80 mesh). The feed was exposed to the stacked catalyst bed at about 385° C., about 2000 psig (~14 MPag), about 8000 SCF/bbl (~1400 $Nm^3/m^3$) of hydrogen as a treat gas, and a liquid hourly space velocity of ~0.2 $hr^{-1}$. Under these conditions, the feed consumed about 2800 SCF/bbl (~480 $Nm^3/m^3$) of hydrogen during hydrotreatment. The properties of the liquid portion of the resulting hydrotreated effluent are shown in Table 1.

TABLE 1

Feed and Product Properties

| | Feed (prior to toluene addition) | Liquid Product (C3+) Fixed Bed Run A | Liquid Product (C3+) Fixed Bed Run B |
|---|---|---|---|
| Density (g/cc) | ~1.12 | ~0.97 | ~0.94 |
| Sulfur (wt %) | ~3.9 | ~0.06 | ~0.002 |
| Nitrogen (wt %) | ~0.2 | | ~0.0005 |
| Micro Carbon Residue (wt %) | ~9.5 | ~2.5 | ~0.3 |
| n-heptane insoluble (wt %) | ~3.3 | ~0.0 | ~0.0 |
| Hydrogen (wt %) | ~7.2 | ~11 | ~11.9 |
| Viscosity @ ~80° C. (cSt) | ~67 | | |
| Viscosity @ ~105° C. (cSt) | ~20 | | |
| Distillation (wt %) | | | |
| T10 (° C.) | ~356 | ~274 | ~243 |
| T50 (° C.) | ~422 | ~371 | ~333 |
| T90 (° C.) | ~518 | ~479 | ~438 |
| >~566° C. (wt %) | ~6 | ~0 | ~0 |

With regard to Fixed Bed Run A, as shown in Table 1, the initial catalytic slurry oil contained almost 10 wt % of MCR and more than 3 wt % NHI. In spite of a feed that would conventionally be considered as having high potential for creating coke, substantially all of the NHI in the feed was converted. Additionally, conversion of the MCR was greater than about 65%. In this example corresponding to hydrotreatment of a catalytic slurry oil feed, the ~700° F.−(~371° C.) portion of the liquid product was suitable for additional hydrotreatment (such as in combination with other diesel boiling range streams) to produce a low sulfur diesel fuel product. The ~700° F.+(~371° C.+) portion was suitable for blending with other distillate and/or fuel oil streams as part of a low sulfur fuel oil or an ultra low sulfur fuel oil.

With regard to Fixed Bed Run B, as shown in Table 1, the initial catalytic slurry oil contained almost 10 wt % of MCR and more than 3 wt % NHI. In spite of a feed that would conventionally be considered as having high potential for creating coke, substantially all of the NHI in the feed appeared to be converted. Additionally, conversion of the MCR appeared to be greater than about 97%. In this example corresponding to hydrotreatment of a catalytic slurry oil feed, the ~700° F.− (~371° C.) portion of the liquid product appeared to contain <15 ppm S and was a suitable blending component into low sulfur diesel fuel. The ~700° F.+ (~371° C.+) portion was suitable for blending with other distillate and/or fuel oil streams as part of a low sulfur fuel oil or ultra low sulfur fuel oil.

Example 2—Hydrotreatment and FCC Processing

Figure 2:
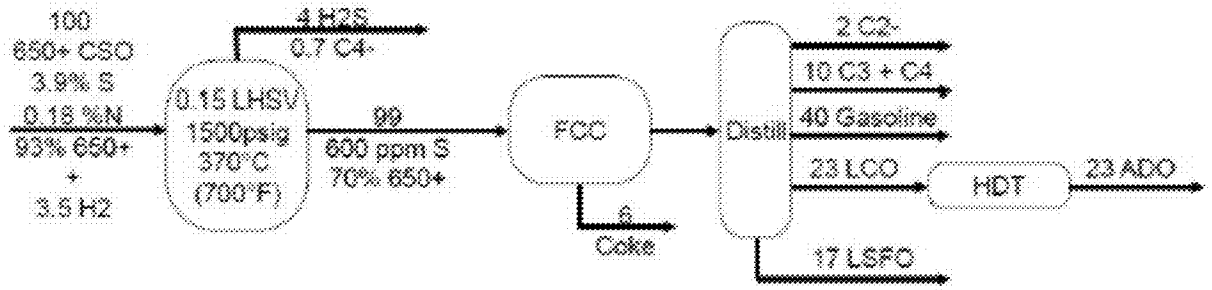
FIG. 2 shows an example of mass flow balance within a reaction system similar to the system shown in FIG. 1 when processing a catalytic slurry oil feed.

A process train similar to the configuration shown in FIG. 1 was used to process a catalytic slurry oil feed. The initial feed corresponded to the feed described in Example 1. Samples of the liquid product from Fixed Bed Run A were processed in a standard FCC pilot plant known as an ACE unit. The ACE unit was run at catalyst to oil ratios of ~4.5, ~5.5, ~6.5, and ~7.5 at a temperature of about 900° F. (~482° C.). By contrast, typical operating conditions for an FCC reactor can include a temperature of about 1010° F. (~543° C.). FIG. 2 schematically shows an example of the mass balance for processing the catalytic slurry oil feed in the process train. The mass balance roughly represents weight percent. Therefore, the mass balance values shown in FIG. 2 do not reflect density changes that can lead to volume swell in the products.

As shown in FIG. 2, the initial catalytic slurry oil feed (with ~5 wt % toluene) included ~93 wt % of ~650° F.+ (~343° C.+) material. Relative to the weight of the feed, about 3.5 wt % of hydrogen was also introduced into a hydrotreatment reactor at conditions similar to those described in Fixed Bed Run A of Example 1. This appeared to produce a small amount of light ends ($C_4$−), a small amount of $H_2S$ and/or $NH_3$, and a remaining liquid effluent ($C_5$+) that was passed into an FCC reactor. After FCC processing, a small amount of coke (~3-5 wt %) was apparently formed on the FCC catalyst. The remaining portion of the FCC products were passed into a distillation column or fractionator to generate $C_2$− light ends (about 2 wt % relative to the initial weight of the catalytic slurry oil feed), a $C_3$ and $C_4$ fraction (about 10 wt %), a naphtha or gasoline fraction (about 40 wt %), a light cycle oil fraction that was further hydrotreated to form low sulfur diesel (about 23 wt %), and a bottoms fraction corresponding to a low sulfur fuel oil fraction (about 17 wt %). As shown in FIG. 2, performing FCC cracking on the $C_5$+ products from hydrotreatment appeared to result in formation of an increased amount of combined naphtha and diesel boiling range products, with a reduction in low sulfur fuel oil. The overall volume of the $C_3$+ products from the fractionator in FIG. 2 appeared to be about 120 vol % of the initial volume of the catalytic slurry oil feed. This apparent increase in volume can be due (at least in part) to the hydrogen addition during hydrotreatment and/or the reduction in density from conversion of aromatic cores to non-aromatic and/or non-cyclic compounds.

Example 3—Hydrotreatment and FCC Processing

Figure 3:
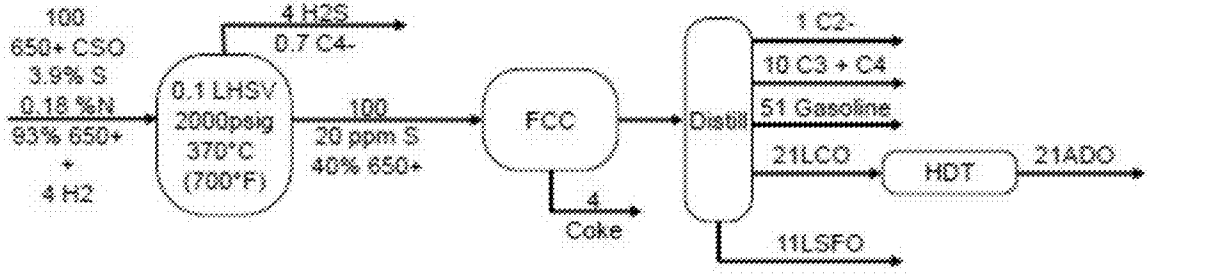
FIG. 3 shows an example of mass flow balance within a reaction system similar to the system shown in FIG. 1 when processing a catalytic slurry oil feed.

A process train similar to the configuration shown in FIG. 1 was used to process a catalytic slurry oil feed. The initial feed corresponded to the feed described in Example 1. Samples of the liquid product from Fixed Bed Run B of Example 1 were processed in a standard FCC pilot plant known as an ACE unit. The ACE unit was run at catalyst to oil ratios of ~4.5, ~5.5, ~6.5, and ~7.5 at a temperature of about 900° F. (~482° C.). FIG. 3 schematically shows an example of the mass balance for processing the catalytic slurry oil feed in the process train.

Figure 4:
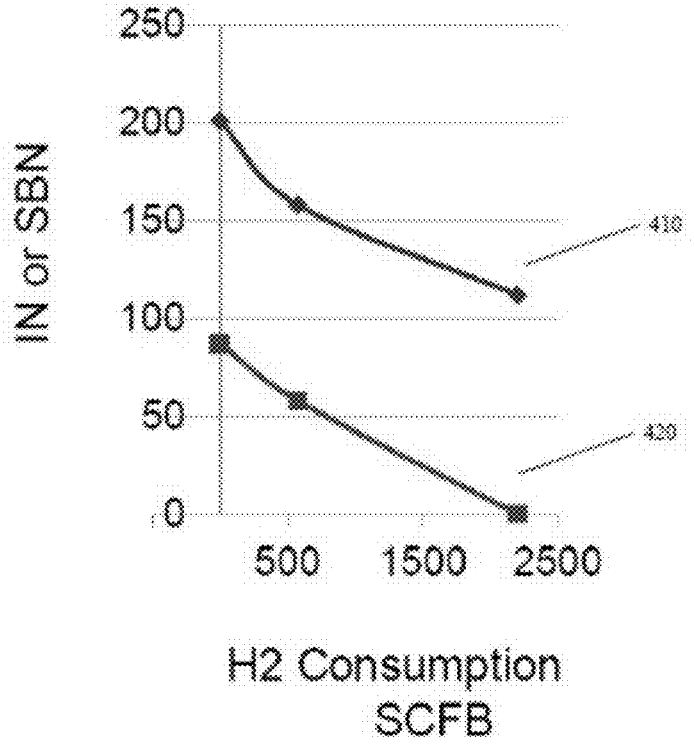
FIG. 4 shows an example of changes in the value of solubility number and insolubility number for a catalytic slurry oil during hydroprocessing.

As shown in FIG. 3, the initial catalytic slurry oil feed included ~93 wt % of ~650° F.+ (~343° C.+) material. Relative to the weight of the feed, about 4 wt % of hydrogen was also introduced into a hydrotreatment reactor at conditions similar to those described in Fixed Bed Run B of Example 1. This appeared to produce a small amount of light ends ($C_4$−), a small amount of $H_2S$ and/or $NH_3$, and a remaining liquid effluent ($C_5$+) that was passed into an FCC reactor. After FCC processing, a small amount of coke (~3-5 wt %) was apparently formed on the FCC catalyst. The remaining portion of the FCC products were passed into a distillation column or fractionator to generate $C_2$− light ends (about 1 wt % relative to the initial weight of the catalytic slurry oil feed), a $C_3$ and $C_4$ fraction (about 10 wt %), a naphtha or gasoline fraction (about 51 wt %), a light cycle oil fraction that was further hydrotreated to form low sulfur diesel (about 21 wt %), and a bottoms fraction corresponding to a low sulfur fuel oil fraction (about 11 wt %). As shown in FIG. 4, performing FCC cracking on the $C_5$+ products from hydrotreatment appeared to result in formation of an increased amount of combined naphtha and diesel boiling range products, with a reduction in low sulfur fuel oil. The overall volume of the $C_3$+ products from the fractionator in FIG. 4 appeared to be about 130 vol % of the initial volume of the catalytic slurry oil feed. This apparent increase in volume can be due (at least in part) to the hydrogen addition during hydrotreatment and/or the reduction in density from conversion of aromatic cores to non-aromatic and/or non-cyclic compounds.

Table 2 provides a comparison between the results of Example 3 and results from processing a typical FCC feed in an FCC unit. The gasoline yield from the process of Example 3 (according to the invention) was ~8 wt % higher than the gasoline yield from a typical FCC feedstock, at the expense of $C_4$− products. The LCCO (light catalytic cycle oil) yield can correspond to a ~343° C.− diesel boiling range product from the FCC process. Dry gas yield was apparently cut in half, and propylene and butylene yields were apparently cut by more than half. The process of Example 3 appeared to result in a feed composed primarily 2-4 ring methyl substituted naphthenes being provided to the FCC unit. Surprisingly to those skilled in the art, the feed to the FCC unit in Example 3 appeared to produce higher yields of gasoline versus a typical FCC feed—particularly at the expense of dry gas and $C_2$-$C_4$ olefins. The process shown in Example 3 was also run at an unusually low temperature. Surprisingly, high conversion of such a naphthenic feed appears to have been achieved at an unexpectedly a low temperature. The ability to operate the FCC process at low temperature while still achieving a desirable conversion of the FCC feed appeared to allow for the low yields of dry gas observed in Example 3. According to conventional understanding, feeding napthenes to an FCC unit can result in reversion of the naphthenes to polynuclear aromatics and hydrogen. By contrast, the product analysis from Example 3 appears to unexpectedly show no reversion, and instead appears to show significantly increased gasoline yield.

TABLE 2

Comparison of FCC of typical FCC Feed versus Hydrotreated Catalytic Slurry Oil

| Product | FCC of typical feed | HDT + FCC of CSO (Example 3) |
|---|---|---|
| Dry Gas (C2−) | ~2.2 | ~0.9 |
| Propane | ~1.4 | ~1.4 |
| Propylene | ~5 | ~2 |
| Butanes | ~5.3 | ~5.6 |

TABLE 2-continued

Comparison of FCC of typical FCC Feed versus Hydrotreated Catalytic Slurry Oil

| Product | FCC of typical feed | HDT + FCC of CSO (Example 3) |
|---|---|---|
| Butenes | ~5.1 | ~1.6 |
| Gasoline | ~43.4 | ~51.4 |
| LCCO | ~20.2 | ~21.3 |
| Bottoms | ~11.9 | ~11.1 |
| Coke | ~5.4 | ~4.5 |

The process flows in Examples 2 and 3 are believed to represent an unusual experiment. When hydrogenated to ~0.94 g/cc, the hydrotreated catalytic slurry oil product was about 60%~343° C.− and about 80%~399° C.−. The process corresponded to feeding low S, diesel boiling range polynuclear naphthenes and aromatics to the FCC unit instead of distilling and selling the <15 ppm S ~343° C.− product as diesel fuel. Feeding mostly ~177° C.-399° C. boiling range material rich in saturates to an FCC unit instead of processing/blending to produce low sulfur diesel can be viewed as unusual. Achieving higher yields of gasoline and lower yields of $C_4$− with such a feed can be surprising. Without being bound by any particular theory, the process appears to be opening internal rings enabling selective conversion of polynuclear naphthenes to gasoline. The apparent hydrogenating of polynuclear aromatics to polynuclear naphthenes followed by cracking in an FCC unit can represent a novel and non-obvious ring opening strategy.

Example 4—Solubility Number and Insolubility Number

In various aspects, one of the unexpected features of the processes described herein can be that severe hydrotreating can be used to process a catalytic slurry oil at high conversion without causing precipitation and/or severe coke formation in the hydrotreatment reactor. This can be understood in the context of how the solubility number (SBN) and the insolubility number (IN) change during processing of a conventional feed versus a feed substantially composed of catalytic slurry oil. Generally, the IN for a catalytic slurry oil can be about 70 to about 130. This can be lower than the SBN for various feeds, such as a vacuum resid feed or a feed to a pre-hydrotreatment stage for FCC processing. As a result, a catalytic slurry oil can be blended with such feeds without causing substantial precipitation. However, during hydrotreatment the SBN of the blended feed can drop more quickly than the IN of the blended feed, leading to precipitation and/or coking within the reactor.

By contrast, a feed substantially composed of catalytic slurry oil can be hydrotreated without causing such precipitation and/or coking. FIG. 4 shows an example of the behavior of the SBN and IN for the catalytic slurry oil from Examples 1 and 2 during hydrotreatment. For the catalytic slurry oil shown in FIG. 4, the SBN (410) of the catalytic slurry oil was initially about 200 while the IN (420) was about 90. FIG. 4 shows the SBN and IN of the liquid product resulting from hydrotreatment under two sets of conditions that caused the hydrogen consumption shown on the X-axis. The condition corresponding to about 500 SCF/bbl (~85 $Nm^3/m^3$) of hydrogen consumption was based on hydrotreating the catalytic slurry oil at about 340° C., about 400 psig (~2.8 MPag), about 8000 SCF/bbl (~1400 $Nm^3/m^3$) of hydrogen treat gas, and a liquid hourly space velocity of ~0.75 $hr^{-1}$. The condition corresponding to consumption of about 2200 SCF/bbl (~370 $Nm^3/m^3$) can correspond to the hydrotreatment conditions described in Example 1. As shown in FIG. 4, the SBN and IN of the catalytic slurry oil appeared to decrease in a roughly proportional manner during hydrotreatment, so that a similar gap could be apparently maintained between the SBN and the IN of the resulting products as process severity was increased. As the process severity was further increased, an IN value of about zero was apparently achieved, indicating that no further asphaltene-type compounds (or other compounds likely to precipitate) remained in the product. Thus, the process was apparently able to unexpectedly convert effectively all asphaltene type compounds in the catalytic slurry oil, such as n-heptane insoluble compounds.

Examples 5 and 6—Products from Hydrotreatment of Catalytic Slurry Oil

Conditions similar to those described in Example 1 were used to hydrotreat two different catalytic slurry oil feeds. Prior to hydrotreatment, the catalytic slurry oil samples were conventionally processed to remove catalyst fines. FIGS. 6 to 8 show product characterization details for one hydrotreated effluent, while FIGS. 9 to 11 show product characterization details for the second hydrotreated effluent.

FIG. 6 shows properties for the total liquid product ($C_3$+) resulting from hydrotreatment of a catalytic slurry oil. The weight percentages of various compound classes (saturates, polars, types of aromatics) shown in FIG. 6 were determined based on an initial quantitative analysis using high performance liquid chromatography followed by application of an empirical model to adjust or fit the quantitative analysis to match other measured analytical properties of the sample. This methodology can be referred to as "START", and further description can be found in U.S. Pat. No. 8,114,678. The boiling point profile can correspond to a simulated distillation, such as the simulated distillation specified in ASTM D2887. The hydrotreatment conditions were selected to produce a hydrotreated effluent having a sulfur content of roughly 100 wppm (~117 wppm in FIG. 6). As shown in FIG. 6, the hydrotreatment appeared to result in formation of only a minimal amount of liquid product below ~200° C. The hydrotreatment conditions appeared to result in sufficient hydrogenation to raise the hydrogen content to about 11.2 wt %. About 60 wt % of the liquid product appeared to correspond to aromatics, while about 35 wt % appeared to correspond saturates. The liquid product appeared to have a sulfur content of about 117 wppm and a nitrogen content of less than about 100 wppm. The total liquid product appeared to have a CCAI value of less than about 870 and a BMCI value of about 82. The total liquid product appeared to have a low pour point of about ~9° C.

The hydrotreated effluent shown in FIG. 6 was fractionated to form a ~600° F.− (~316° C.−) fraction and a ~600° F.+ (~316° C.+) fraction. FIG. 7 shows properties for the ~316° C.− fraction. The ~316° C.− fraction appeared to have a density at ~15° C. of about 0.92 g/cc and appeared to be suitable for use as a distillate fuel blendstock (such as diesel fuel, heating oil, gas oil, and/or marine gas oil), and/or as a blendstock for fuel oil, such as low sulfur fuel oil or ultra low sulfur fuel oil. The fraction appeared to have a cetane index (ASTM D4737) of about 29, a hydrogen content of more than 12 wt %, and an energy content of about 42 MJ/kg. The fraction also appeared to have good low temperature operability properties, with a cloud point of about ~56° C. and a cold filter plugging point of about ~19° C. About 63 wt % of the fraction appeared to be naphthenes, with about 60 wt % corresponding to 2-ring naphthenes. About 35 wt % of the fraction appeared to be aromatics, and about 1.5 wt % or less of the fraction appeared to correspond to paraffins.

Due to the high energy content, low sulfur content, and good low temperature operability properties, this lower boiling effluent fraction can serve as a blendstock for a diesel fuel pool to correct for sulfur and/or low temperature operability deficiencies in the fuel pool while maintaining the overall energy content. Alternatively, this lower boiling effluent fraction can also be a suitable blendstock for marine gas oil, heating oil, fuel oil, and/or as a flux material to lower density, viscosity, sulfur, and/or another property for a distillate fuel blend or fuel oil blend. This type of lower boiling effluent fraction may be blended with other streams including and/or not limited to any of the following, and any combination thereof, to make a distillate fuel product, such as diesel fuel, marine gas oil, gas oil, and/or heating oil: low sulfur diesel (sulfur content ≤500 wppm); ultra low sulfur diesel (sulfur content ≤10 wppm or ≤15 wppm); (ultra) low sulfur heating oil; (ultra) low sulfur gas oil; (ultra) low sulfur kerosene; (hydrotreated) straight run diesel, gas oil, and/or kerosene; (hydrotreated) cycle oil, thermally cracked diesel, thermally cracked gas oil, thermally cracked kerosene, coker diesel, coker gas oil, and/or coker kerosene; hydrocracker diesel, hydrocracker gas oil, and/or hydrocracker kerosene; gas-to-liquid diesel, kerosene, wax, and/or other hydrocarbons; and (hydrotreated) natural fats or oils such as vegetable oil, biomass-to-liquids diesel, and/or fatty acid alkyl esters such as fatty acid methyl esters.

FIG. 8 shows properties for the ~316° C.+ fraction. The ~316° C.+ fraction appeared to have a density at ~15° C. of about 0.99 g/cc and was suitable for use as a blendstock for fuel oil, such as low sulfur fuel oil. The fraction had a kinematic viscosity of less than about 180 $mm^2/s$. The fraction appeared to have a hydrogen content of about 10.9 wt % and an estimated energy content of about 41 MJ/kg. The estimate of energy content was based on ISO 8217, and was based on estimates of ash content and water content as shown in FIG. 8. The hydrotreatment conditions appeared to be suitable for reducing the n-heptane insolubles content to an estimated value of about 0.03 wt %, while the micro carbon reside (ASTM D4530-2) was estimated at about 1.4 wt %. The BMCI index for the fraction appeared to be greater than about 85 and the CCAI appeared to be less than about 860. The aromatics content appeared to be about 60 wt % while the saturates content was about 39 wt %. In addition to potentially being suitable for use as a fuel or fuel blendstock, the fraction shown in FIG. 8 can also be suitable for use as a flux, such as a flux for (ultra) low sulfur fuel oil.

FIG. 9 shows properties for the total liquid product ($C_3$+) resulting from hydrotreatment of another catalytic slurry oil. The hydrotreatment conditions were selected to produce a hydrotreated effluent having a sulfur content of roughly 100 wppm (~125 wppm in FIG. 9). As shown in FIG. 9, the hydrotreatment appeared to result in formation of only a minimal amount of liquid product below ~200° C. The hydrotreatment conditions resulted in sufficient hydrogenation to raise the hydrogen content to about 11.0 wt %. About 57 wt % of the liquid product appeared to correspond to aromatics, while about 35 wt % were saturates. The total liquid product appeared to have a CCAI value of less than about 870 and a BMCI value of about 82. The total liquid product appeared to have a low pour point of about ~12° C.

Due to the high energy content, low sulfur content, and good low temperature operability properties, this bottoms fraction can serve as a blendstock for ultra low sulfur fuel oil or low sulfur fuel oil while maintaining the overall energy content. This type of bottoms fraction may be blended with other streams including and/or not limited to any of the following, and any combination thereof, to make a low sulfur fuel oil or ultra low sulfur fuel oil: low sulfur diesel (sulfur content ≤500 wppm); ultra low sulfur diesel (sulfur content ≤10 wppm or ≤15 wppm); (ultra) low sulfur gas oil; (ultra) low sulfur kerosene; (hydrotreated) straight run diesel, gas oil, and/or kerosene; (hydrotreated) cycle oil, thermally cracked diesel, thermally cracked gas oil, thermally cracked kerosene, coker diesel, coker gas oil, and/or coker kerosene; hydrocracker diesel, hydrocracker gas oil, and/or hydrocracker kerosene; gas-to-liquid diesel, kerosene, wax, and/or other hydrocarbons; (hydrotreated) natural fats or oils such as vegetable oil, biomass-to-liquids diesel, and/or fatty acid alkyl esters, such as fatty acid methyl esters; and atmospheric tower bottoms, vacuum tower bottoms, and/or other residue derived from a low sulfur crude slate. Still other suitable streams can include (hydrotreated) catalytic slurry oils, other non-hydrotreated gas oil/cycle oils, (hydrotreated) deasphalted oils, lube oil aromatic extracts, slack waxes, steam cracker tar, and other fuel oil blendstocks.

The hydrotreated effluent was fractionated to form a ~700° F.− (~371° C.−) fraction and a ~700° F.+ (~371° C.+) fraction. FIG. 10 shows properties for the ~371° C.− fraction. The ~371° C.− fraction appeared to have a density at ~15° C. of about 0.94 g/cc and was suitable for use as a blendstock for diesel fuel, marine gas oil, gas oil, heating oil, and/or fuel oil, such as low sulfur fuel oil or ultra low sulfur fuel oil. The fraction appeared to have a cetane index (ASTM D4737) of about 27, a hydrogen content of about 11.8 wt %, and an estimated energy content of about 41.6 MJ/kg. The fraction appeared to have a cloud point of about ~36° C. and a cold filter plugging point of about 7° C. The cold flow plugging point may have been impacted by the fraction having a kinematic viscosity at ~40° C. of about 13 $mm^2/s$. About 56 wt % of the fraction appeared to be naphthenes, with about 53 wt % corresponding to 2-ring naphthenes. About 43 wt % of the fraction appeared to be aromatics, and about 1.2 wt % was paraffins.

FIG. 11 shows properties for the ~371° C.+ fraction. The ~371° C.+ fraction had a density at ~15° C. of about 1.00 g/cc and was suitable for use as a blendstock for fuel oil. The fraction appeared to have a kinematic viscosity at ~50° C. of about 920 $mm^2/s$ to about 940 $mm^2/s$. The fraction appeared to have a hydrogen content of about 10.0 wt % and an energy content of about 41 MJ/kg. The hydrotreatment conditions appeared to be suitable for reducing the n-heptane insolubles content to an estimated amount of about 0.14 wt %, while the micro carbon reside (ASTM D4530-2) was estimated at about 2.5 wt %. The BMCI index for the fraction appeared to be about 90 and the CCAI value appeared to be less than about 870. The aromatics content appeared to be about 68 wt % while the saturates content was about 29 wt %.

Example 7—Feeds for Low Temperature/High Conversion FCC Processing

FIG. 12 shows a series of potential feeds for processing under low temperature and high conversion FCC processing conditions. A first feed can correspond to an ~8 cSt GTL lube feed. A second feed can correspond to a bottoms fraction (~343° C.+) of a hydrotreated catalytic slurry oil. A third feed can correspond to a hydraulic oil. For the second and third feeds, typical properties of the feed are shown along with properties for a fully hydrotreated version.

In the following examples, feeds were FCC processed under one of two types of conditions. In a first type of condition, feeds were processed using a conventional FCC catalyst under low temperature conditions (~900° F./~482° C.). The conventional FCC catalyst corresponded to a USY catalyst with a high rare earth content, such as a rare earth content of at least about 2.0 wt %. In particular, in the following examples the conventional/high rare earth USY catalyst had a rare earth content corresponding to about 2.1 wt % of lanthanum. This type of catalyst can have high activity for hydrogen transfer. In a second type of condition, feeds were processed using a USY catalyst with a low rare earth content at ~482° C., such as a rare earth content of about 1.5 wt % or less, or about 1.0 wt % or less. In particular, in the following examples the low rare earth USY catalyst had a rare earth content corresponding to about 0.8 wt % of lanthanum. Additionally, a third type of condition was simulated based on incorporation of the experimental results from the first two types of conditions into the model. For the third type of condition, the model was used to simulate processing of feeds using a USY catalyst with substantially no rare earth content at ~482° C., which corresponded to a catalyst with ultra low hydrogen transfer activity. Optionally, each of the conditions (including the model ultra low hydrogen transfer catalyst conditions) could be modified by including about 10 wt % of ZSM-5 as part of the FCC catalyst.

For the results shown in the following examples, FCC processing of a feed was performed in a pilot scale unit. The feeds that were processed in the pilot scale unit corresponded to the first feed (GTL) and the "typical" versions of the second feed (hydrotreated bottoms) and the third feed (hydrotreated hydraulic oil) as shown in FIG. 12. Measured composition and property values associated with each processing run were then incorporated into an empirical model. The empirical model was based in part on prior laboratory scale and commercial scale data. For the examples related to the first feed (GTL), the empirical model was used to adjust measured product distributions so that the products were in mass balance with the initial feed. Modeling was also used to generate mass balanced product distributions for exposure of the first feed to the ultra low hydrogen transfer catalyst. The mass balanced product distributions are shown in FIGS. 13 to 18. For the examples related to the second feed and third feed, after incorporation of the measured composition and property values, the empirical model was used to predict product distributions (mass balanced) for FCC processing of the fully hydrotreated versions of the second and third feeds. The resulting product distributions for processing (and modeling of processing) of the second and third feeds are shown in FIGS. 19 to 22.

Example 8—Low Temperature/High Conversion Processing of Paraffinic Feed

FIGS. 13 to 15 show results from FCC processing of the GTL lube feed shown in FIG. 12 under the three types of conditions. FIG. 13 shows results from FCC processing of the GTL lube feed at ~900° F. (~482° C.) with the USY catalyst having a high (~2.1 wt %) rare earth content. Due to the more substantial amount of hydrogen transfer that occurs when using this type of catalyst, an FCC effluent with a relatively conventional product distribution was generated. More than ~30 wt % of the resulting product distribution appeared to correspond to ~430° F.+ (~221° C.+) compounds. This appears to contrast with the apparent product distributions in FIG. 14, where the GTL lube feed was processed using USY catalysts with low (~0.8 wt %) rare earth content. For the product distributions in both FIGS. 14 and 15, the weight ratio of olefins to paraffins for $C_3$-$C_7$ compounds individually appeared to be greater than about 2.0, and in many instances substantially greater. As a result, the FCC processing effluents shown in FIGS. 14 and 15 can correspond to beneficial sources of olefins. This can be valuable, for example, for use in alkylation reactions to form alkylated naphtha fractions. The product distributions in FIGS. 14 and 15 also appeared to have large weight ratios of isoparaffins to paraffins in the $C_3$ to ~221° C. portion of the products. Finally, even though the GTL input feed had an initial boiling point above ~427° C., less than ~15 wt % of the resulting products in FIG. 14 appeared to have a boiling point above ~221° C. Additionally, effectively no coke on catalyst was apparently produced. This appears to demonstrate that substantial feed conversion can be performed at a low FCC processing temperature while avoiding substantial coke production and/or producing a product distribution unexpectedly enriched in olefins relative to a conventional process.

Still greater amounts of feed conversion relative to ~221° C. can be performed under low temperature conditions if a medium pore cracking catalyst can be included as part of the FCC catalyst. FIGS. 16 to 18 correspond to FCC processing of the ~8 cSt GTL feed under conditions similar to FIGS. 13 to 15, but with a catalyst system including about 10 wt % of a ZSM-5 based catalyst. In FIG. 16, addition of ZSM-5 to the catalyst system including the high rare earth content USY catalyst appeared to result in additional conversion of naphtha boiling range compounds to light ends. Further, the additional light ends appeared to correspond to an increased amount of $C_3$ and $C_4$ olefins, resulting in a net increase in the olefin to paraffin ratio for the product distribution. FIG. 16 also shows that about 28 wt % of ~221° C. compounds were apparently made, indicating that addition of ZSM-5 did not result in substantially higher amounts of conversion relative to ~221° C.

The addition of ZSM-5 to the low rare earth USY catalyst (and modeled no rare earth catalyst) had effects similar to those observed in combination with the high rare earth USY catalyst. As shown in FIGS. 17 and 18, addition of ZSM-5 appeared to result in increased production of $C_3$ and $C_4$ olefins while reducing the amount of $C_6$+ compounds. However, FIGS. 17 and 18 also appear to show that the beneficial selectivity of the low rare earth and no rare earth USY catalysts was retained. This can be seen, for example, in the high ratios of olefins to paraffins for the $C_3$ to $C_6$ compounds in FIGS. 17 and 18.

The low rare earth (and modeled no rare earth) catalyst systems were also used to process a fully hydrotreated version of the hydraulic oil feed. As shown in FIG. 12, the fully hydrotreated hydraulic oil can correspond to a naphthenic feed with little or no paraffin content. FIGS. 19 and 20 show results from FCC processing (or modeling of such processing) of the naphthenic feed in the presence of FCC catalyst systems that include 10 wt % of ZSM-5, while FIG. 21 can correspond to processing using the low rare earth catalyst without ZSM-5.

FIGS. 19-21 appear to show that the product distribution from low temperature (~482° C.) processing of a naphthenic feed had some common features with processing of the GTL feed. For each of FIGS. 19-21, the amount of ~221° C.+ material in the product distribution appeared to be about 16 wt % or less with little or no coke make. The use of ZSM-5 as part of the catalyst system appeared to have a similar effect. FIG. 21 appears to show a roughly 2:1 weight ratio of $C_6$ to ~221° C. compounds as compared to $C_5$− compounds, while FIGS. 19 and 20 appear to have a roughly 1:1 weight ratio or lower of $C_6$ to ~221° C. compounds as compared to $C_5$− compounds.

Relative to FIGS. 14, 15, 17, and 18, the weight ratios of small olefins to paraffins appear to be lower in FIGS. 19-21. Another notable difference can be seen in the amount of cycloolefins produced in FIGS. 19 and 21. Using a catalyst system with low hydrogen transfer activity appeared to result in substantial production of up to about 5.0 wt % cycloolefins. More generally, using a catalyst system with low hydrogen transfer activity can allow for production of about 1.5 wt % to about 6.0 wt % cycloolefins, or about 2.0 wt % to about 5.0 wt %. This can be in contrast to any of the other products made by FCC processing.

FIG. 22 shows results from FCC processing of the hydrotreated catalytic slurry oil bottoms feed using a conventional (high) rare earth USY catalyst. This appeared to result in a product distribution with a substantial (≥60 wt %) content of aromatics in the $C_6$ to ~221° C. portion of the products. The combined naphthene and aromatic content for the $C_6$ to ~221° C. portion appeared to be greater than about 80 wt %. Similar to other runs with a high rare earth catalyst, the weight ratios of olefins to paraffins for $C_3$-$C_7$ compounds all appeared to be less than 1.0.

Example 9—Improved Gasoline Yield from Hydroprocessing of Catalytic Slurry Oil A catalytic slurry oil was hydrotreated under severe conditions for long residence times to create a substantially fully saturated hydrotreated effluent. Prior to hydrotreatment, the catalytic slurry oil had a T10 distillation point of about 343° C., a T50 distillation point of about 414° C., and a T90 distillation point of about 509° C., with about 6 wt % of the catalytic slurry oil boiling above ~566° C. The sulfur content was about 2.9 wt %, the nitrogen content was about 2200 wppm, the hydrogen content was about 7.5 wt %, and the density at 15° C. was about 1.12 g/cc. About 72% of the carbons corresponded to carbons in an aromatic ring. The catalytic slurry oil included about 8 wt % of Conradson Carbon Residue and about 0.8 wt % of n-heptane insolubles.

The catalytic slurry oil was hydrotreated at long residence times at ~370° C. and ~2000 psig (~14 MPag) of hydrogen in the presence of a commercial NiMo hydrotreating catalyst. The conditions appeared to be sufficient for removal of more than ~99% of sulfur and nitrogen from the feed. After hydrotreatment, about 60 wt % of the products appeared to be saturates while about 15 wt % were aromatics. About 3 wt % appeared to correspond to $H_2S$, about 1.5 wt % was $C_4$− hydrocarbons, about 3 wt % was $C_5$-$C_9$ hydrocarbons, and the remaining ~92.5 wt % was $C_9$+ compounds. The total liquid product ($C_5$+) appeared to have a T10 distillation point of about 242° C., a T50 distillation point of about 337° C., and a T90 distillation point of about 435° C. The T50 and T90 values were unexpectedly low, as the feed included a substantial portion with a boiling point greater than ~566° C., while the catalyst was a commercial hydrotreating catalyst that was believed to be selective for heteroatom removal and aromatic saturation.

A ~260° C.-343° C. fraction from the total liquid product was used as a feed for an FCC process at about 482° C. with a convention FCC catalyst. The input fraction included about 5 wt % paraffins, about 70 wt % naphthenes, about 21 wt % 1-ring aromatics, and about 4 wt % 2-ring aromatics. The resulting FCC effluent included about 10 wt % $C_4$− compounds (light ends), about 66 wt % naphtha boiling range compounds ($C_5$ to ~221° C.), about 18 wt % cycle oil (~221° C. to ~343° C.), about 4 wt %~343° C.+, and about 2 wt % coke. This appeared to demonstrate that portions of a catalytic slurry oil can be converted to naphthenic gasoline type fractions with unexpectedly high yields.

Example 10—Product Yield Improvement with Feed Wax Reduction

A feed including vacuum gas oil and heavy coker gas oil was hydroprocessed at high severity to achieve substantially complete removal of nitrogen and sulfur. The initial sulfur content was about 4 wt %. The liquid portion ($C_5$+) of the hydrotreated effluent included less than about 5 wt % aromatics. The liquid portion also included about 10 wt % of combined n-paraffins and mono-methyl paraffins.

FCC processing of the ~204° C.+ portion of the hydrotreated effluent was modeled using an empirical model that was based on laboratory scale and commercial scale data. Based on modeling runs, it was predicted that an FCC processing temperature of about 543° C. was needed to generate a wax-free ~343° C.+ product. At this temperature, the model product slate included about 2 wt % of dry gas and about 65 wt % of naphtha boiling range compounds ($C_5$ to ~221° C.). In an alternative model run at a temperature of about 482° C., the product slate included about 11 wt % light ends ($C_4$−) and about 70 wt % naphtha boiling range compounds. The combined light ends and products represented a volume swell of more than 30 vol % relative to the feed.

The hydrotreated effluent was isomerized in the presence of a dewaxing catalyst under conditions sufficient for converting ~95 wt % of the n-paraffins and mono-methyl paraffins to aliphatic compounds with two or more side chains. The FCC model was then used to model processing of the ~204° C.+ portion of the isomerized effluent. The model was used to determine that a processing temperature of about 482° C. would be needed to generate a wax-free ~343° C.+ portion. At this temperature, the model product slate included about 0.4 wt % dry gas and about 75 wt % of naphtha boiling range compounds.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

What is claimed is:

1. A hydrotreated catalytic slurry oil composition comprising a density at ~15° C. of about 0.92 g/cc to about 1.02 g/cc, a T50 distillation point of about 340° C. to about 390° C., and a T90 distillation point of about 450° C. to about 525° C., the hydrotreated catalytic slurry oil composition comprising about 1.0 wt % or less of n-heptane insolubles, about 50 wt % to about 70 wt % aromatics, a sulfur content of about 1000 wppm or less, and a hydrogen content of about 10.0 wt % to 12.0 wt %, a ~700° F.– (~371° C.–) portion of the hydrotreated catalytic slurry oil composition comprising less than about 5.0 wt % paraffins.

2. The hydrotreated catalytic slurry oil composition of claim 1, wherein the hydrotreated catalytic slurry oil composition comprises about 0.5 wt % or less of n-heptane insolubles.

3. The hydrotreated catalytic slurry oil composition of claim 1, wherein the hydrotreated catalytic slurry oil composition exhibits an energy content of at least about 40.0 MJ/kg.

4. The hydrotreated catalytic slurry oil composition of claim 1, wherein a ~371° C.+ portion of the hydrotreated catalytic slurry oil composition comprises a) at least about 55 wt % aromatics, b) a BMCI value of at least about 70, c) a pour point of about 30° C. or less, d) an energy content of at least about 40.0 MJ/kg, e) a combination of two or more of a)-d), or f) a combination of all of a)-d).

5. The hydrotreated catalytic slurry oil composition of claim 1, wherein the hydrotreated catalytic slurry oil composition exhibits a T10 distillation point of at least about 250° C.

6. A hydrotreated catalytic slurry oil fraction comprising a density at ~15° C. of about 0.84 g/cc to about 0.96 g/cc, a T10 distillation point of at least about 200° C., and a T90 distillation point of about 371° C. or less, the hydrotreated catalytic slurry oil fraction comprising about 5.0 wt % or less of paraffins, at least about 50 wt % naphthenes, at least about 30 wt % aromatics, a sulfur content of about 50 wppm or less, and a hydrogen content of at least about 11.0 wt %, the hydrotreated catalytic slurry oil fraction having a cetane index (D4737) of at least about 25 and an energy content of at least about 41.0 MJ/kg.

7. The hydrotreated catalytic slurry oil fraction of claim 6, wherein the hydrotreated catalytic slurry oil fraction comprises about 3.0 wt % or less of paraffins, at least about 50 wt % naphthenes, or a combination thereof.

8. The hydrotreated catalytic slurry oil fraction of claim 6, wherein the hydrotreated catalytic slurry oil fraction exhibits a cetane index (D4737) of at least about 25, an energy content of at least about 41.0 MJ/kg, or a combination thereof.

9. The hydrotreated catalytic slurry oil fraction of claim 6, wherein the hydrotreated catalytic slurry oil fraction comprises a cloud point of about −25° C. to about −70° C.

10. A hydrotreated catalytic slurry oil fraction comprising a density at ~15° C. of at least about 0.96 g/cc, a T10 distillation point of at least about 340° C., and a T90 distillation point of about 450° C. to about 525° C., the hydrotreated catalytic slurry oil fraction comprising about 1.0 wt % or less of n-heptane insolubles, about 60 wt % to about 80 wt % aromatics, a sulfur content of about 1000 wppm or less, and a hydrogen content of about 9.5 wt % to 12.0 wt %, the hydrotreated catalytic slurry oil fraction having a BMCI value of at least about 70 and a CCAI value of about 870 or less.

11. The hydrotreated catalytic slurry oil fraction of claim 10, wherein the hydrotreated catalytic slurry oil fraction comprises a T10 distillation point of at least about 370° C., a kinematic viscosity at 50° C. of about 1000 $mm^2/s$ or less, or a combination thereof.

12. A fluid catalytic cracking effluent fraction comprising a $C_3$ to ~430° F. (~221° C.) portion, the $C_3$ to ~430° F. (~221° C.) portion comprises an aromatics content of less than about 30 wt % and a weight ratio of olefins to saturates of at least about 1.0, the $C_3$ to ~430° F. (~221° C.) portion comprising at least 20 wt % of combined $C_4$ and $C_5$ compounds.

13. The fluid catalytic cracking effluent fraction of claim 12, wherein the fluid catalytic cracking effluent fraction comprises a weight ratio of combined $C_4$ and $C_5$ olefins to combined $C_4$ and $C_5$ paraffins of at least about 2.5.

14. The fluid catalytic cracking effluent fraction of claim 12, wherein the $C_3$ to ~430° F. (~221° C.) portion comprises at least about 5 wt % of combined napthenes and aromatics, about 20 wt % or less of aromatics, or a combination thereof.

15. The fluid catalytic cracking effluent fraction of claim 12, wherein the fluid catalytic cracking effluent fraction comprises a weight ratio of $C_6$ olefins to $C_6$ paraffins of at least about 2.0.

16. The fluid catalytic cracking effluent fraction of claim 12, wherein the fluid catalytic cracking effluent fraction comprises a weight ratio of $C_3$ olefins to $C_3$ paraffins of at least about 9.0.

17. The fluid catalytic cracking effluent fraction of claim 12, wherein the $C_3$ to ~430° F. (~221° C.) portion comprises at least 50 wt % of $C_3$-$C_7$ olefins.

18. A fluid catalytic cracking effluent fraction comprising a $C_3$ to ~430° F. (~221° C.) portion, the $C_3$ to ~430° F. (~221° C.) portion comprising a ratio of combined $C_4$ and $C_5$ olefins to combined $C_4$ and $C_5$ paraffins of at least about 0.9, a $C_6$ to ~430° F. (~221° C.) portion having a weight ratio of cyclic compounds to aliphatic compounds of at least about 1.0.

19. The fluid catalytic cracking effluent fraction of claim 18, wherein the fluid catalytic cracking effluent fraction comprises a weight ratio of $C_3$ olefins to $C_3$ paraffins of at least about 5.0.

20. A catalytic naphtha composition comprising a $C_6$ to ~430° F. (~221° C.) portion, the $C_6$ to ~430° F. (~221° C.) portion comprising at least about 60 wt % aromatics and at least about 80 wt % of combined aromatics and naphthenes, the $C_6$ to ~430° F. (~221° C.) portion comprising an isoparaffin to n-paraffin weight ratio of at least about 6.

* * * * *